US010767397B2

(12) United States Patent
Ottino et al.

(10) Patent No.: US 10,767,397 B2
(45) Date of Patent: Sep. 8, 2020

(54) SINGLE MOTOR LATCH ASSEMBLY WITH POWER CINCH AND POWER RELEASE HAVING SOFT OPENING FUNCTION

(71) Applicant: Magna Closures S.p.A., Guasticce (Leghorn) (IT)

(72) Inventors: Franco Giovanni Ottino, S. Giuliano Terme (IT); Francesco Cumbo, Pisa (IT); Marco Taurasi, Leghorn (IT); Enrico Margheritti, Lucca (IT)

(73) Assignee: MAGNA CLOSURES S.P.A., Guasticce (Leghorn) (IT)

( * ) Notice: Subject to any disclaimer, the term of this patent is extended or adjusted under 35 U.S.C. 154(b) by 0 days.

(21) Appl. No.: 15/050,657

(22) Filed: Feb. 23, 2016

(65) Prior Publication Data

US 2016/0245000 A1 Aug. 25, 2016

Related U.S. Application Data

(60) Provisional application No. 62/120,451, filed on Feb. 25, 2015, provisional application No. 62/157,088, filed on May 5, 2015.

(51) Int. Cl.
*E05B 81/20* (2014.01)
*E05B 85/26* (2014.01)
(Continued)

(52) U.S. Cl.
CPC ..... *E05B 81/20* (2013.01); *E05B 81/06* (2013.01); *E05B 81/18* (2013.01); *E05B 81/68* (2013.01);
(Continued)

(58) Field of Classification Search
CPC ..... E05B 81/06; E05B 77/06; E05B 81/14; E05B 81/20; E05B 79/04; E05B 79/20; E05B 3/12; E05B 81/18; E05B 85/26; E05B 85/243; E05B 81/68; E05B 77/36; E05B 77/02; E05B 81/34; E05B 81/74; Y10T 292/1047; Y10T 292/1079; Y10T 292/1078; Y10T 292/1082; Y10T 292/1076; Y10S 292/23
(Continued)

(56) References Cited

U.S. PATENT DOCUMENTS 5,288,115 A * 2/1994 Inoue ..... E05B 81/20 292/201
5,639,130 A * 6/1997 Rogers, Jr. ..... E05B 81/20 292/199
(Continued)

FOREIGN PATENT DOCUMENTS

EP 0978609 A1 2/2000
EP 1176273 A2 1/2002

*Primary Examiner* — Kristina R Fulton
*Assistant Examiner* — Faria F Ahmad
(74) *Attorney, Agent, or Firm* — Dickinson Wright PLLC

(57) ABSTRACT

A power latch assembly for a motor vehicle closure system configured to provide a power cinching feature and a power release feature. The power cinching feature is configured to retain the ratchet in a cinched striker capture position with the pawl disengaged from the ratchet. The power release feature is configured to move the ratchet from its cinched striker capture position to a cinch release striker capture position for unloading the seals prior to release of the ratchet to its striker release position.

29 Claims, 45 Drawing Sheets

(51) Int. Cl.

| | |
|---|---|
| ***E05B 85/24*** | (2014.01) |
| ***E05B 81/68*** | (2014.01) |
| ***E05B 81/06*** | (2014.01) |
| ***E05B 81/18*** | (2014.01) |
| ***E05B 77/36*** | (2014.01) |
| ***E05B 81/16*** | (2014.01) |
| ***E05B 79/04*** | (2014.01) |
| ***E05B 81/14*** | (2014.01) |
| ***E05B 77/06*** | (2014.01) |

(52) U.S. Cl.
CPC ..... *E05B 85/243* (2013.01); *E05B 85/26* (2013.01); *E05B 77/06* (2013.01); *E05B 77/36* (2013.01); *E05B 79/04* (2013.01); *E05B 81/14* (2013.01); *E05B 81/16* (2013.01); *Y10S 292/23* (2013.01); *Y10T 292/1047* (2015.04); *Y10T 292/1076* (2015.04); *Y10T 292/1078* (2015.04); *Y10T 292/1079* (2015.04); *Y10T 292/1082* (2015.04)

(58) Field of Classification Search
USPC ..... 292/216, 199, 198, 201, DIG. 23
See application file for complete search history.

(56) References Cited

U.S. PATENT DOCUMENTS 5,785,364 A * 7/1998 Kleefeldt ..... E05B 81/22 292/201
5,899,508 A * 5/1999 Cetnar ..... E05B 81/16 292/216
5,941,579 A * 8/1999 Baniak ..... E05B 85/26 292/201
6,053,542 A * 4/2000 Ostrowski ..... E05B 81/20 292/201
6,321,488 B1 * 11/2001 Bigoszewski ..... E05F 15/638 49/139
6,341,448 B1 1/2002 Murray et al.
6,550,825 B2 4/2003 Ostrowski et al.
6,719,333 B2 * 4/2004 Rice ..... E05B 81/14 292/201
6,764,113 B1 * 7/2004 Cetnar ..... E05B 81/06 292/201
6,805,386 B2 * 10/2004 Ehret ..... E05B 81/20 292/141
6,848,727 B1 * 2/2005 Cetnar ..... E05B 81/20 292/201
7,175,228 B2 * 2/2007 Mrkovic ..... E05B 81/20 192/35
7,261,334 B2 8/2007 Oberheide et al.
7,367,598 B2 * 5/2008 Arabia, Jr. ..... E05B 81/22 292/201
7,445,258 B2 * 11/2008 Rice ..... E05B 81/22 292/341.16
7,627,986 B2 * 12/2009 Hirai ..... E05B 81/22 49/280
7,827,836 B2 11/2010 Cetnar
8,336,929 B2 * 12/2012 Halliwell ..... E05B 15/021 292/201
8,474,888 B2 7/2013 Tomaszewski
8,528,950 B2 * 9/2013 Organek ..... E05B 17/007 292/216
8,733,804 B1 * 5/2014 Park ..... E05C 3/16 292/199
8,740,263 B2 * 6/2014 Singh ..... E05B 85/243 292/200
2002/0000725 A1 * 1/2002 Ostrowski ..... E05B 81/20 292/199
2002/0027365 A1 * 3/2002 Rogers, Jr. ..... E05B 81/20 292/201
2005/0121922 A1 * 6/2005 Cetnar ..... E05B 81/20 292/216
2005/0184534 A1 * 8/2005 Oberheide ..... E05B 81/14 292/201
2006/0006671 A1 * 1/2006 Noel ..... E05B 77/26 292/216
2006/0066114 A1 * 3/2006 Oberheide ..... F16D 11/14 292/199
2006/0284425 A1 * 12/2006 Torka ..... E05B 81/20 292/201
2008/0073917 A1 * 3/2008 Ciavaglia ..... E05B 81/20 292/201
2008/0073918 A1 * 3/2008 Arabia, Jr. ..... E05B 81/20 292/201
2009/0151257 A1 6/2009 Dominique
2010/0052337 A1 * 3/2010 Arabia, Jr. ..... E05B 81/82 292/216
2010/0117379 A1 * 5/2010 Mitchell ..... E05B 81/36 292/216
2015/0233157 A1 * 8/2015 Bendel ..... E05B 85/243 292/199
2015/0300052 A1 * 10/2015 Barmscheidt ..... E05B 77/02 292/201
2015/0308156 A1 * 10/2015 Hunt ..... E05B 79/20 292/201
2015/0368934 A1 * 12/2015 Tomaszewski ..... B60Q 9/00 292/199
2016/0032626 A1 * 2/2016 Margheritti ..... E05B 77/32 292/220
2016/0060922 A1 3/2016 Clark et al.
2016/0090762 A1 * 3/2016 Strole ..... E05B 81/20 292/201
2016/0186468 A1 * 6/2016 Ilea ..... E05B 79/04 292/201

* cited by examiner

SINGLE MOTOR LATCH ASSEMBLY WITH POWER CINCH AND POWER RELEASE HAVING SOFT OPENING FUNCTION

CROSS-REFERENCE TO RELATED APPLICATIONS

This application claims the benefit of U.S. Provisional Application No. 62/120,451, filed Feb. 25, 2015 and U.S. Provisional Application No. 62/157,088 filed May 5, 2015. The entire disclosure of each of the above applications is incorporated herein by reference.

FIELD OF THE INVENTION

The present disclosure relates generally to a closure latch for a vehicle closure panel and, more particularly, to a power latch assembly providing at least one of a power cinching feature and a power release feature having a soft opening function.

BACKGROUND OF THE INVENTION

This section provides background information related to the present disclosure which is not necessarily prior art.

In view of increased consumer demand for motor vehicles equipped with advanced comfort and convenience features, many modern motor vehicles are now provided with passive entry systems to permit locking and release of closure panels (i.e., doors, tailgates, liftgates and decklids) without use of a traditional key-type entry system. In this regard, some popular features now available with vehicle latch systems include power locking/unlocking, power release and power cinching. These "powered" features are provided by a latch assembly mounted to the closure panel and which includes a ratchet and pawl type of latching mechanism controlled via at least one electric actuator. Typically, the closure panel is held in a closed position by virtue of the ratchet being positioned in a striker capture position to releasably retain a striker that is mounted to a structural portion of the vehicle. The ratchet is held in its striker capture position by the pawl engaging the ratchet in a ratchet holding position. In most ratchet and pawl type of latching mechanisms, the pawl is operable in its ratchet holding position to retain the ratchet in one of an initial or soft close striker capture position and a primary or hard close striker capture position. Latch assemblies providing a power cinching feature are typically equipped with a cinching mechanism operated by an electric actuator. Commonly, the cinching mechanism is directly connected to the ratchet and, when actuated, is operable for moving the ratchet from its initial striker capture position into its primary striker capture position, thereby cinching the closure panel in its closed position. To subsequently release the closure panel from its closed position, a release mechanism is actuated for moving the pawl from its ratchet holding position into a ratchet release position, whereby a ratchet biasing arrangement forcibly pivots the ratchet from its primary striker capture position into a striker release position so as to release the striker. In latch assemblies providing a power release feature, the release mechanism is controlled by an electric actuator. A common electric actuator or separate electric actuators can be used in associated with the power release and power cinching features. However, the power release feature is typically independent from the power cinch feature. As an alternative, it is also known to employ a double pawl type of latching mechanism to reduce the release effort required for the electric actuator to release the latching mechanism.

In most latch assemblies equipped with a power cinching feature, the cinching mechanism is normally maintained in a non-actuated or "stand-by" condition and is only shifted into an actuated condition once the sensors indicate that the ratchet is located in its initial striker capture position. Following completion of the cinching operation, when the sensors indicate that the ratchet is located in its primary striker capture position, the cinching mechanism must be "reset", that is returned to its stand-by condition, to permit subsequent uninhibited movement of the ratchet to its striker release position via actuation of the release mechanism. If the closure panel is initially closed with a sufficient closing force to locate the ratchet in its primary striker capture position, then the cinching operation is bypassed and the cinching mechanism is retained in its stand-by condition. One example of a power cinching latch assembly is disclosed in U.S. Pat. No. 6,341,448 as having a cable-type cinching mechanism.

To ensure that precipitation and road debris do not enter the vehicle, virtually all vehicle closure panels are equipped with weather seals around their peripheral edge and which are configured to seal against a mating surface of the vehicle body surrounding the closure opening. These weather seals also function to reduce wind noise. The seals are typically made from an elastomeric material and are configured to compress upon closing the closure panel by virtue of the latch assembly. As is recognized, increasing the compressive clamping force applied to the weather seals provides improved noise reduction within the passenger compartment. As will be appreciated, with the weather seals held in a highly compressed condition, they tend to force the closure panel toward its open position and this "opening" force is resisted by the pawl and ratchet latching mechanism of the power latch assembly. Because the seal loads exerted on the latching mechanism are increased, the forces required to release the latching mechanism are also increased which, in turn, impacts the size and power requirements of the electric actuator. Further, an audible "pop" sound is sometimes generated following actuation of the electric actuator during a power release operation due to the quick release of the seal loads while the ratchet of the latching mechanism is forcibly driven from its primary striker capture position into its striker release position.

To address this dichotomy between high seal loads and low release efforts, it is known to provide an arrangement for controllably releasing the seal loading in coordination with release of the latching mechanism. For example, European Publication No. EP1176273 discloses a single ratchet/double pawl type of power-operated latching mechanism that is configured to provide a progressive releasing of the ratchet for reducing noise associated with its release. In addition, European Publication EP0978609 utilizes an eccentric mechanism in association with a single pawl latching mechanism to reduce seal loads prior to release of the ratchet.

While current power latch assemblies are sufficient to meet regulatory requirements and provide enhanced comfort and convenience, a need still exists to advance the technology and provide alternative power latch assemblies and arrangements that address and overcome at least some of the known shortcomings.

SUMMARY OF THE INVENTION

This section provides a general summary of the disclosure and is not intended to be a comprehensive disclosure of all features, advantages, aspects and objectives associated with the inventive concepts described and illustrated in the detailed description provided herein.

It is an aspect of the present disclosure to provide a power latch assembly for a motor vehicle closure system configured to provide at least one of a power cinching feature and a soft opening power release feature.

It is a related aspect of the present disclosure to provide the power latch assembly with a power-operated latch cinch mechanism operable to cinch a striker retained by a ratchet of a ratchet and pawl latch mechanism by moving the ratchet from one of a soft close striker capture position and a hard close striker capture position into a cinched striker capture position.

It is another related aspect of the present disclosure to utilize the power-operated latch cinch mechanism to establish a first or Cinch mode and a second or Uncinch/Release mode. The Cinch mode is established when the power-operated latch cinch mechanism engages and forcibly drives the ratchet to move from one of its soft close and hard close striker capture positions into its cinched striker capture position. The Uncinch/Release mode is established when the power-operated latch cinch mechanism initially moves the ratchet from its cinched striker capture position to a cinch release striker capture position and subsequently moves the ratchet from its cinch release striker capture position to a ratchet released position.

It is another related aspect of the present disclosure to utilize the power-operated latch cinch mechanism to mechanically hold the ratchet in its cinched striker capture position.

It is another related aspect of the present disclosure to utilize the power-operated latch cinch mechanism to maintain engagement with the ratchet during movement of the ratchet from its cinched striker capture position into its cinch release striker position for uncinching the striker and to subsequently release engagement with the ratchet upon movement of the ratchet from its cinch release striker capture position into its ratchet release position.

It is yet another related aspect of the present disclosure to provide the power latch assembly with a power-operated latch release mechanism operable, in cooperation with the latch cinch mechanism, to permit movement of the ratchet from its cinched striker capture position into its cinch release striker capture position for uncinching the striker prior to permitting movement of the ratchet from its ratchet release position to a striker release position so as to provide the soft opening power release feature.

It is another aspect of the present disclosure to provide the power latch assembly with an actuation mechanism operable to coordinate the power cinching feature and the soft opening power release feature.

In accordance with these and other aspects, a power latch assembly is provided which comprises: a ratchet moveable between a striker release position whereat the ratchet is positioned to release a striker and three distinct striker capture positions whereat the ratchet is positioned to retain the striker, wherein the three distinct striker capture positions include a soft close striker capture position, a hard close striker capture position and a cinched striker capture position; a ratchet biasing member for normally biasing the ratchet toward its striker release position; a pawl moveable between a ratchet checking position whereat the pawl is positioned to hold the ratchet in one of its soft close and hard close striker capture positions and a ratchet release position whereat the pawl is located to permit movement of the ratchet to its striker release position; a pawl biasing member for normally biasing the pawl toward its ratchet checking position; a latch release mechanism engaging the pawl and operable in a first latch release mode for locating the pawl in its ratchet checking position and a second latch release mode for locating the pawl in its ratchet release position; a latch cinch mechanism including a cinch link lever having an engagement surface configured to selectively engage a ratchet projection extending from the ratchet when the ratchet is initially rotated by the striker from its striker release position into one of its soft close striker capture and hard close striker capture positions; and an actuation mechanism operably moveable in a cinching direction from a cinch start position to a cinch stop position to provide a power cinching function after the ratchet has been rotated by the striker into one of its soft close striker capture and hard close striker capture positions and the pawl has moved into its ratchet checking position, wherein movement of the actuation mechanism from its cinch start position to its cinch stop position causes pivotal movement of the cinch link lever which forcibly rotates the ratchet into its cinched striker capture position due to continued engagement of the ratchet projection with the engagement surface of the cinch link lever, and wherein the pawl is located in its ratchet checking position but is disengaged from the ratchet when the ratchet is held in its cinched striker capture position. The power latch assembly is also configured to provide a soft release function for uncinching the striker prior to release of the ratchet projection from the engagement surface on the cinch link lever by moving the actuation mechanism in a releasing direction from its cinch stop position toward its cinch start position for moving the ratchet from its cinched striker capture position to a cinch release striker capture position.

In accordance with these and other aspects, a power latch assembly is provided which comprises: a ratchet moveable between a striker release position whereat the ratchet is positioned to release a striker and three distinct striker capture positions whereat the ratchet is positioned to retain the striker, wherein the three distinct striker capture positions of the ratchet include a first or soft close striker capture position, a second or hard close striker capture position, and a third or cinched striker capture position; a ratchet biasing member configured to normally bias the ratchet toward its striker release position; a pawl moveable between a ratchet checking position whereat the pawl is positioned to hold the ratchet in one of its soft closed and hard closed striker capture positions and a ratchet release position whereat the pawl is located to permit movement of the ratchet to its striker release position; a pawl biasing member configured to normally bias the pawl toward its ratchet checking position; a latch cinch mechanism having a cinch lever and a cinch link lever, the cinch lever having a first segment pivotably mounted to a cinch pivot pin and a second segment pivotably connected to a first segment of the cinch link lever, wherein a second segment of the cinch link lever is configured to include an engagement shoulder adapted to selectively engage and retain a ratchet projection extending from the ratchet in response to the striker moving the ratchet from its striker release position into its soft close striker capture position; and an actuation mechanism operable for providing a power cinching function, wherein the actuation mechanism includes an electric motor driving a gear having a drive slot within which a drive post on the second segment of the cinch lever is retained for coordinating pivotal movement of the cinch lever with rotation of the gear, wherein the power cinching function is provided by actuating the electric motor to rotate the gear in a cinching direction from a cinch start position to a cinch stop position which causes the latch cinch mechanism to forcibly rotate the ratchet from its soft close striker capture position or its hard close striker capture position into its cinched striker capture position due to engagement between the ratchet projection and the engagement shoulder on the cinch link lever while the pawl is maintained in its ratchet checking position.

In accordance with the power latch assembly constructed as described above, a power release function is also made available by further providing: a latch release mechanism having a pawl lever and a release lever, the pawl lever engaging the pawl and being moveable between a first pawl lever position whereat the pawl is located in its ratchet release position and a second pawl lever position whereat the pawl is located in its ratchet release position. The release lever being selectably engageable with the pawl lever and a cam segment formed on the gear and moveable between a non-actuated position whereat the pawl lever is located in its first pawl lever position and an actuated position whereat the pawl lever is located in its second pawl lever position; and a cinch disengage mechanism including a disengage lever having a first segment pivotably mounted on the cinch pivot pin and a second segment with a follower disposed in a lost motion slot formed in the cinch link lever. The power release function is provided by actuating the electric motor to rotate the gear in a releasing direction from its cinch stop position toward its cinch start position for causing its cam segment to move the release lever from its non-actuated position into its actuated position. Such movement of the release lever causes the pawl lever to move the pawl from its ratchet checking position toward its ratchet release position while concurrently acting on the cinch disengage mechanism to cause movement of the cinch link lever toward a released position whereat the ratchet projection is released from engagement with the engagement shoulder, thereby permitting the ratchet to rotate from its ratchet release position into its striker release position due to the biasing of the ratchet biasing member. The soft open feature is provided by the ratchet being initially rotated from its cinched striker capture position to its cinch release striker capture position in response to initial rotation of the gear in the releasing direction from it cinch stop position toward an uncinch position while the ratchet projection is maintained in engagement with the shoulder on the cinch link lever. This limited rotation of the gear in the releasing direction causes the latch cinch mechanism to move and permit rotation of the ratchet from its cinch striker capture position into its cinch release striker capture position, thereby uncinching the striker prior to release of the ratchet for uninhibited movement from its ratchet release position into its striker release position.

In accordance with these and other aspects, a one-motor version of a power latch assembly is provided which comprises a ratchet moveable between a striker release position whereat the ratchet is positioned to release a striker and three distinct striker capture positions whereat the ratchet is positioned to retain the striker, wherein the three distinct striker capture positions include a soft close striker capture position, a hard close striker capture position and a cinched striker capture position; a ratchet biasing member for normally biasing the ratchet toward its striker release position; a pawl moveable between a ratchet checking position whereat the pawl is positioned to hold the ratchet in one of its soft close and hard close striker capture positions and a ratchet release position whereat the pawl is positioned to permit movement of the ratchet to its striker release position; a pawl biasing member for normally biasing the pawl toward its ratchet checking position; a latch release mechanism having a pawl lever and a release lever, the pawl lever engaging the pawl and being moveable between a first pawl lever position whereat the pawl is located in its ratchet checking position and a second pawl lever position whereat the pawl is located in its ratchet release position, the release lever being selectably engageable with the pawl lever and moveable between a non-actuated position whereat the pawl lever is positioned in its first pawl lever position and an actuated position whereat the pawl lever is moved to its second pawl lever position; a latch cinch mechanism having a cinch lever and a cinch link lever, the cinch lever having a first segment pivotably mounted to a cinch pivot pin and a second segment pivotably connected to a first segment of the cinch link lever, wherein a second segment of the cinch link lever includes an engagement shoulder configured to selectively engage a ratchet projection extending from the ratchet when the ratchet is positioned in its soft close striker capture position; a cinch disengage mechanism including a disengage lever having a first segment pivotably mounted on the cinch pivot pin and a second segment with a follower disposed in a lost motion slot formed in the cinch link lever; and an actuation mechanism operable for providing a power cinching function and a power release function, the actuation mechanism including an electric motor and a gearset having a first gear driven by the motor and which is meshed with a second gear supported for rotation on the cinch pivot pin, wherein the second gear includes an edge section defining a drive slot, a recessed segment and a cam segment, and wherein a drive post extending from the second end of the cinch lever is disposed within the drive slot for coordinating pivotal movement of the cinch lever with rotation of the second gear.

In accordance with the one-motor version of the power latch assembly constructed as described above, the power cinching function is provided by actuating the electric motor to rotate the second gear in a cinching direction from a cinch start position to a cinch stop position. The power cinching function is initiated following the ratchet being rotated by the striker into one of its soft close and hard close striker capture positions while the pawl is located in its ratchet checking position. Such rotation of the second gear to its cinch stop position causes pivotal movement of the cinch lever and the cinch link lever which forcibly rotates the ratchet into its cinched striker capture position due to engagement of the ratchet projection with the engagement shoulder on the cinch link lever, and wherein the pawl is positioned in its ratchet checking position but is disengaged from the ratchet when the ratchet is rotated to its cinched striker capture position.

In accordance with the one-motor version of the power latch assembly constructed as above, the power release function is provided by actuating the electric motor to rotate the second gear in a releasing direction from its cinch stop position toward its cinch start position while the ratchet is held in its cinched striker capture position by the latch cinch mechanism. This rotation of the second gear causes the cam segment to engage and move the release lever from its non-actuated position toward its actuated position for causing the pawl lever to move the pawl from its ratchet checking position toward its ratchet release position. This movement of the pawl lever also causes the cinch disengage mechanism to engage the cinch link lever and forcibly move it to a release position whereat the cinch link lever is released from engagement with the ratchet projection, whereby the ratchet is released and permitted to rotate from its ratchet released position to its striker release position. To provide the soft open function, the second gear is initially rotated in the releasing/uncinching direction from its cinch stop position into an uncinch position. Such rotation of the second gear causes the latch cinch mechanism to permit the ratchet to be initially rotated from its cinched striker capture position to a cinch released striker capture position while the ratchet projection is maintained in engagement with the shoulder on the cinch link lever, thereby uncinching the striker. Continued rotation of the second gear in the releasing/uncinching direction causes the ratchet to move from its cinch released striker capture position into its ratchet release position whereat the ratchet projection is disengaged from the shoulder on the cinch link lever, thereby releasing the ratchet for subsequent movement to its striker release position following the uncinching process.

Further areas of applicability will become apparent from the detailed description provided herein. The description and specific examples in this summary are intended for purposes of illustration only and are not intended to limit the scope of the present disclosure.

DRAWINGS

The drawings described herein are for illustrative purposes only of selected embodiments and not all possible implementations such that the drawings are not intended to limit the scope of the present disclosure.

Figure 13A:
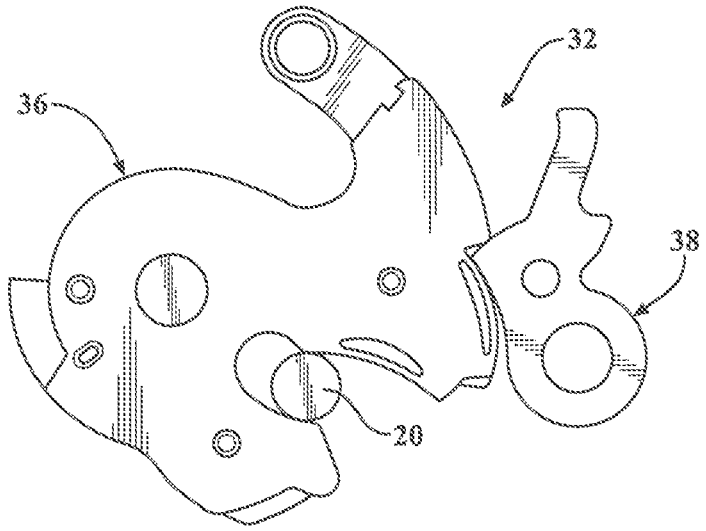
Figure 13B:
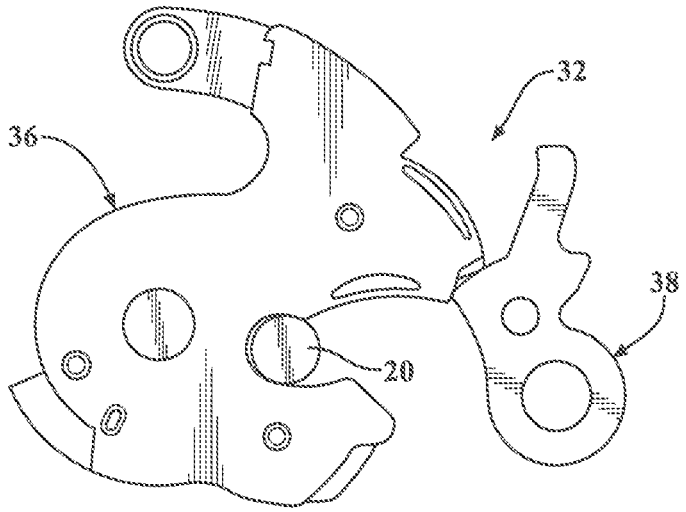
Figure 13C:
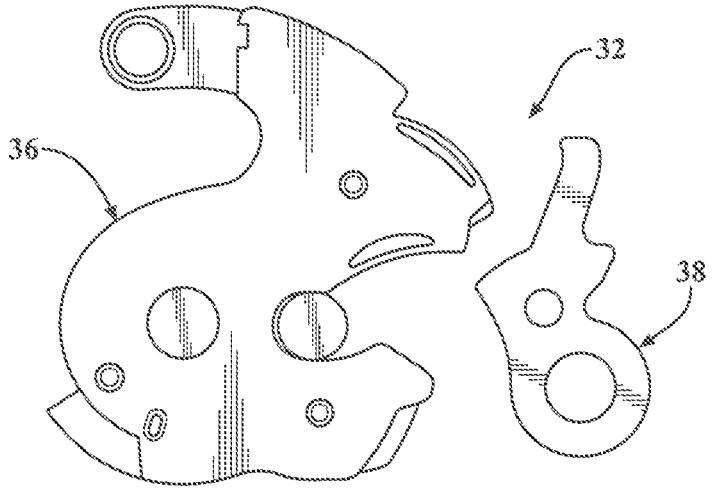
Figure 14A:
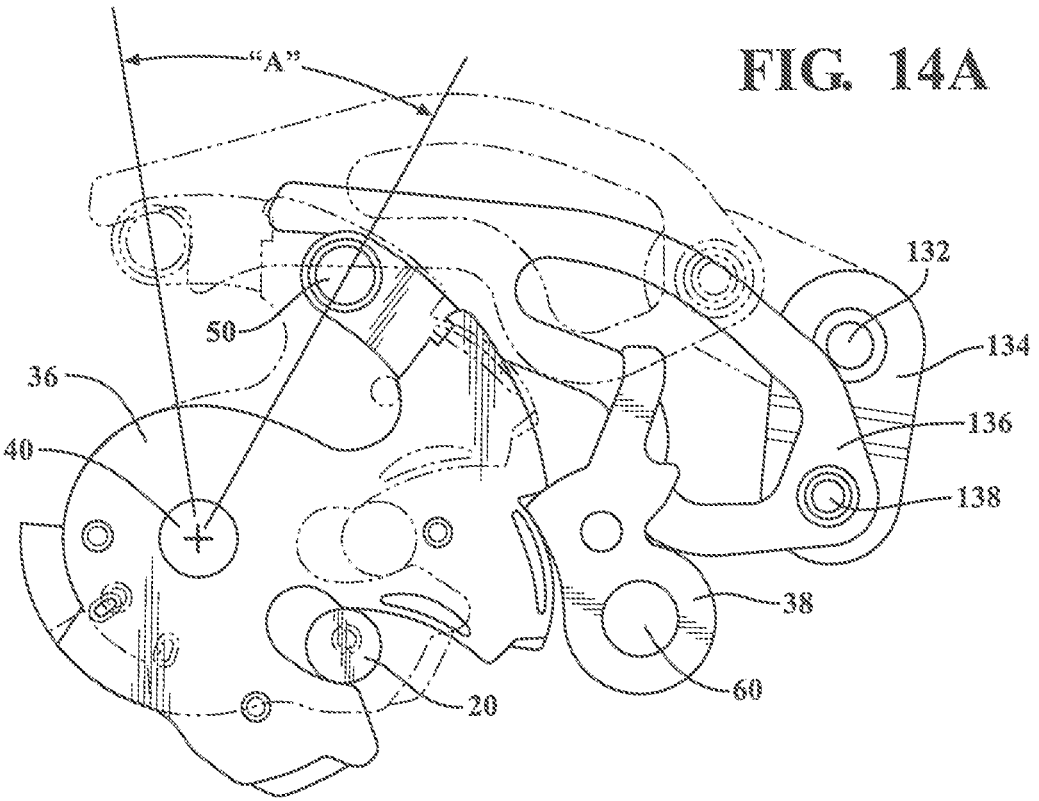
Figure 14B:
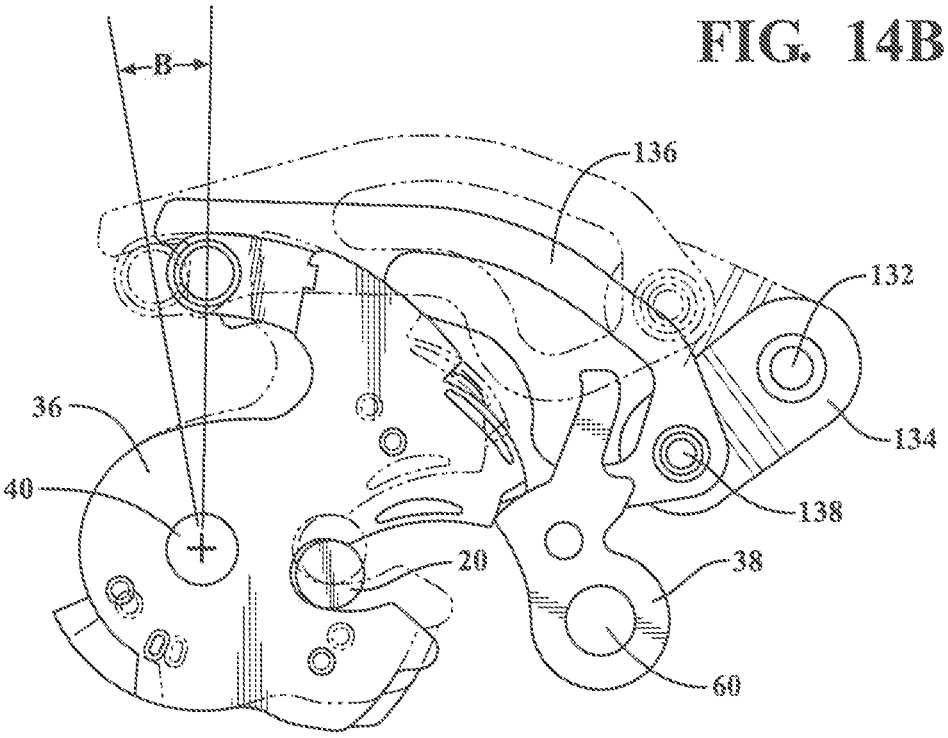
Figure 17A:
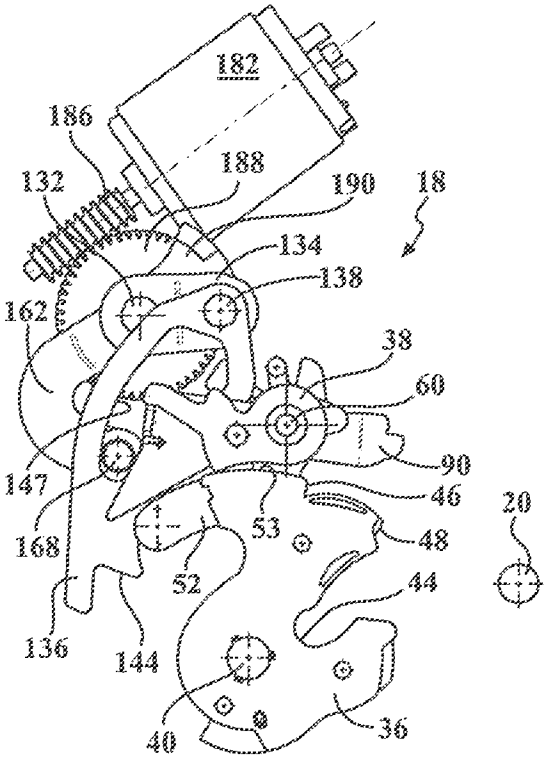
Figure 16A:
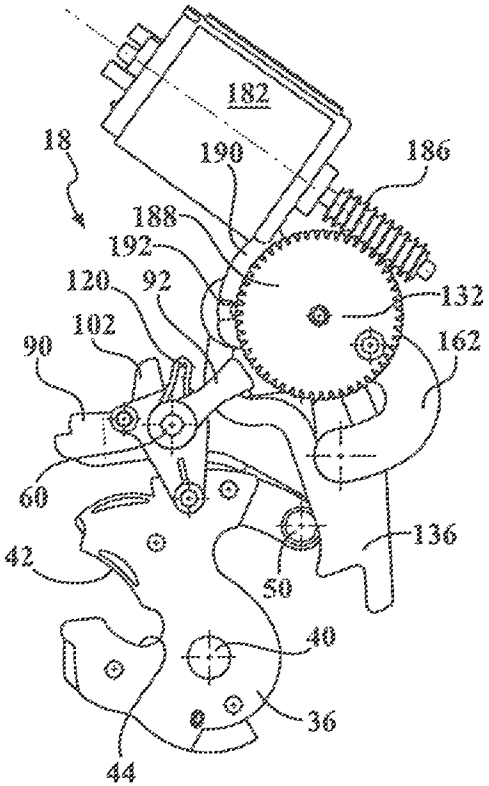
Figure 15A:
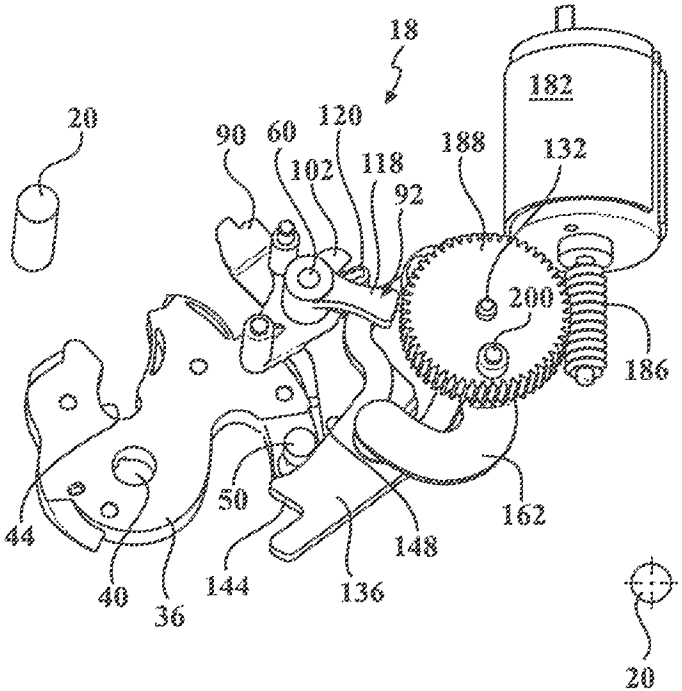
Figure 17B:
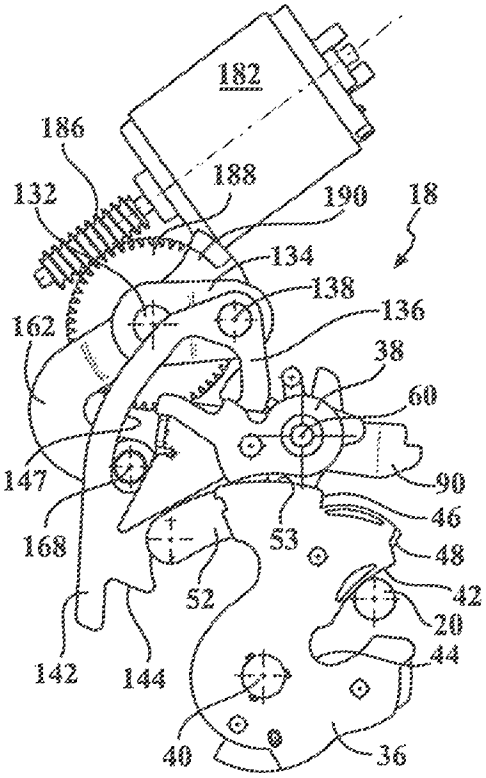
Figure 16B:
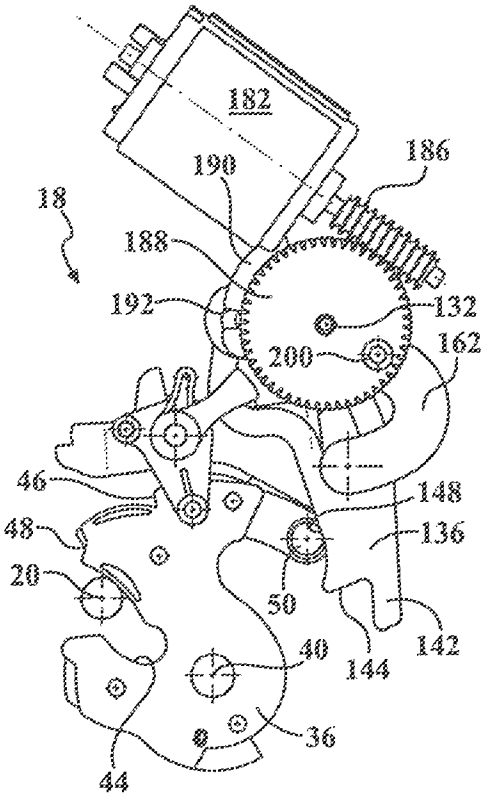
Figure 15B:
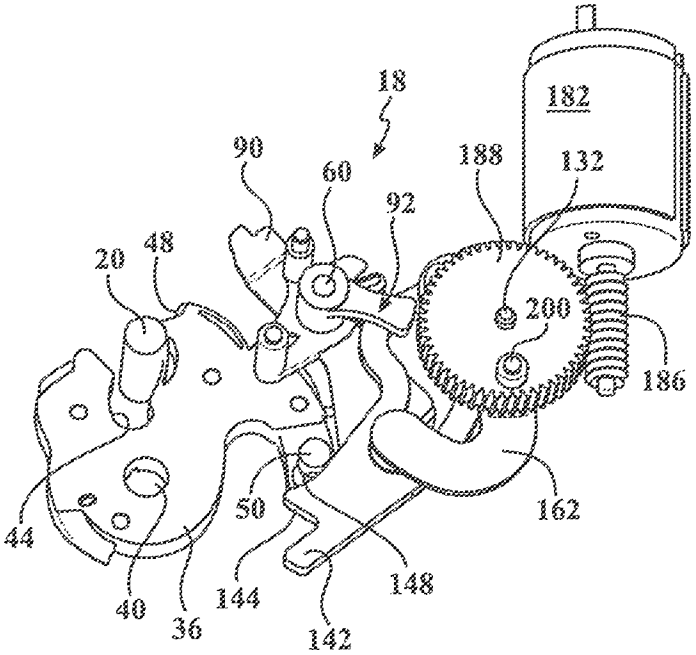
Figure 17C:
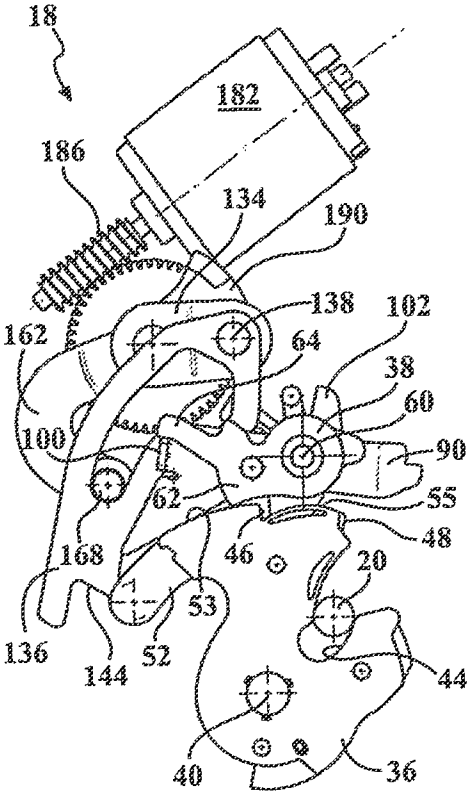
Figure 16C:
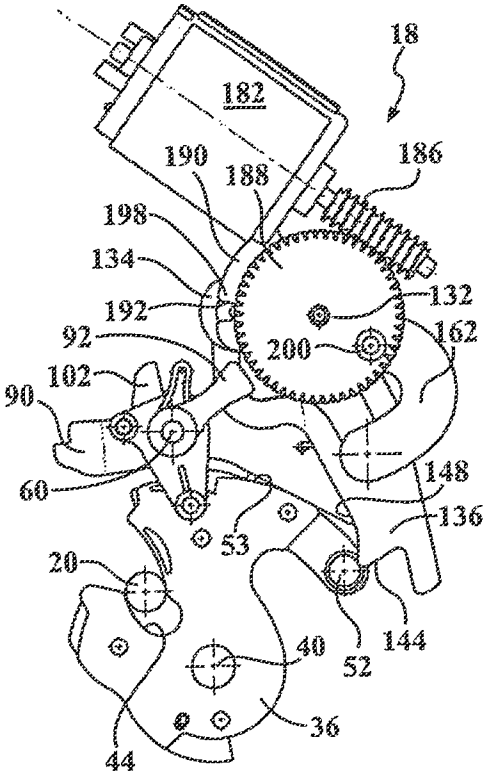
Figure 15C:
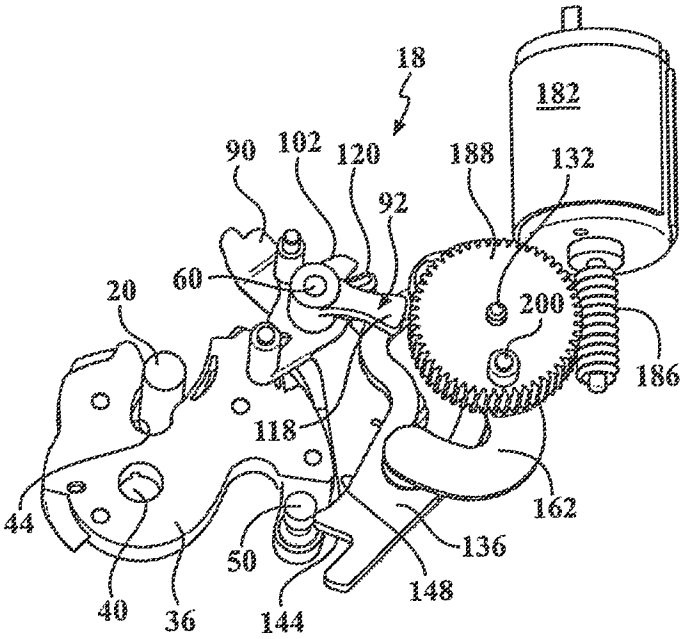
Figure 17D:
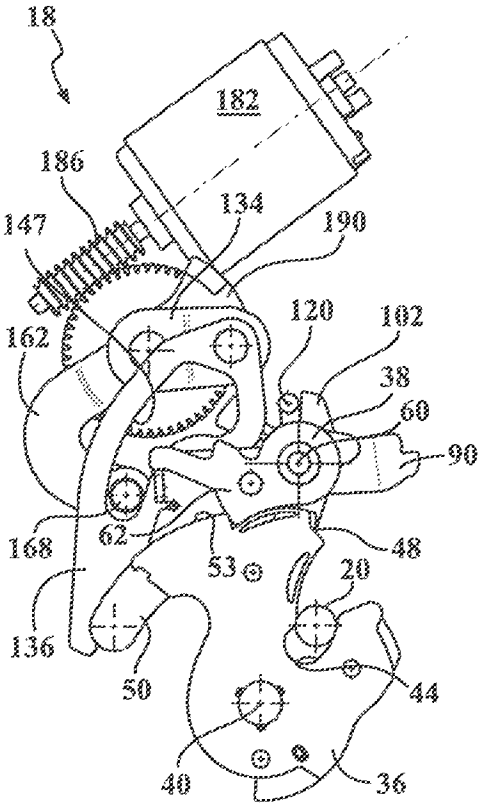
Figure 16D:
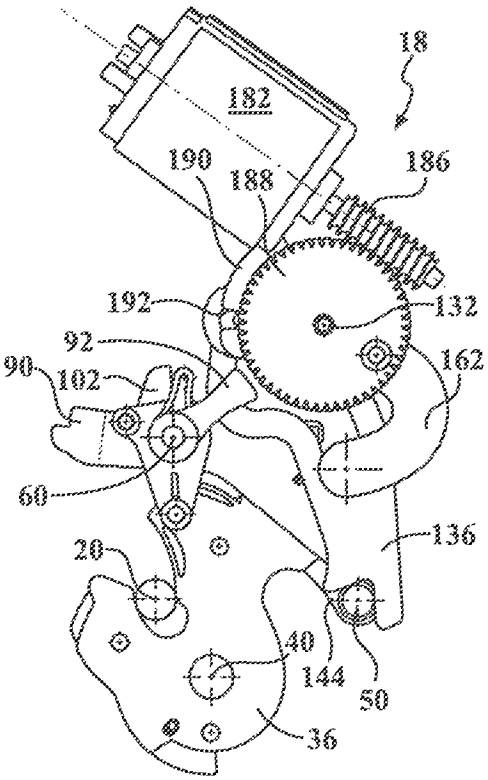
Figure 15D:
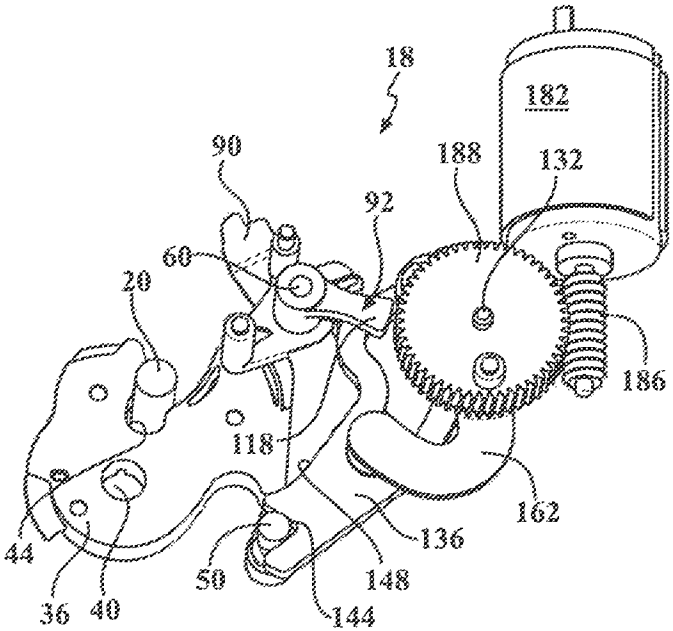
Figure 17E:
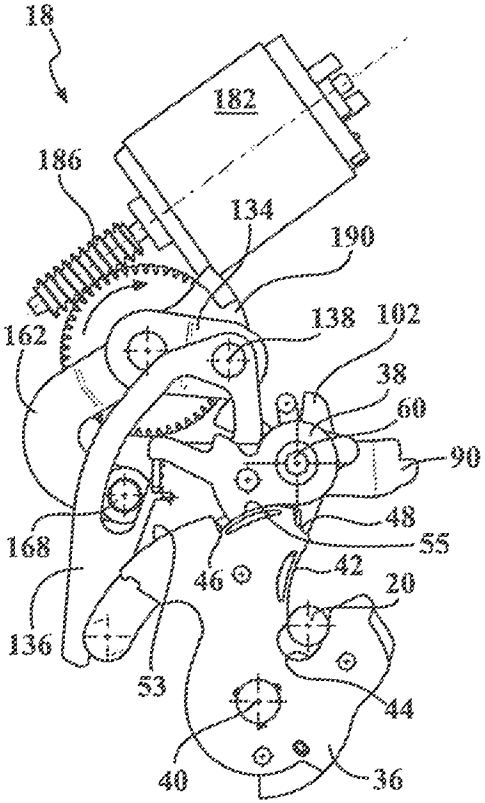
Figure 16E:
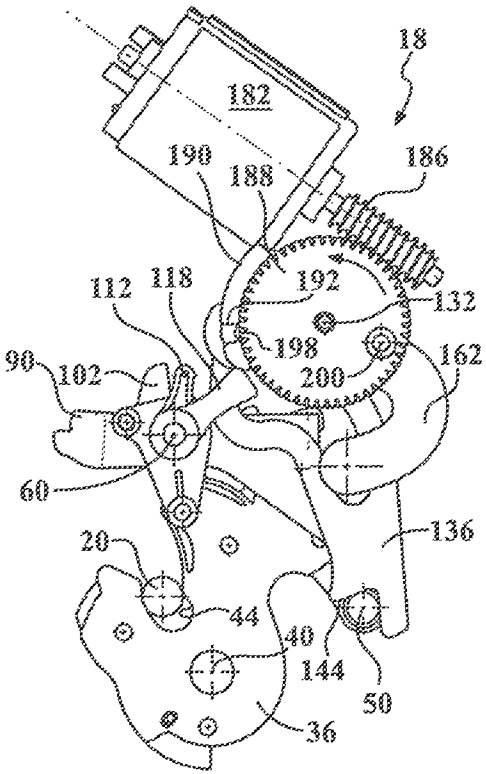
Figure 15E:
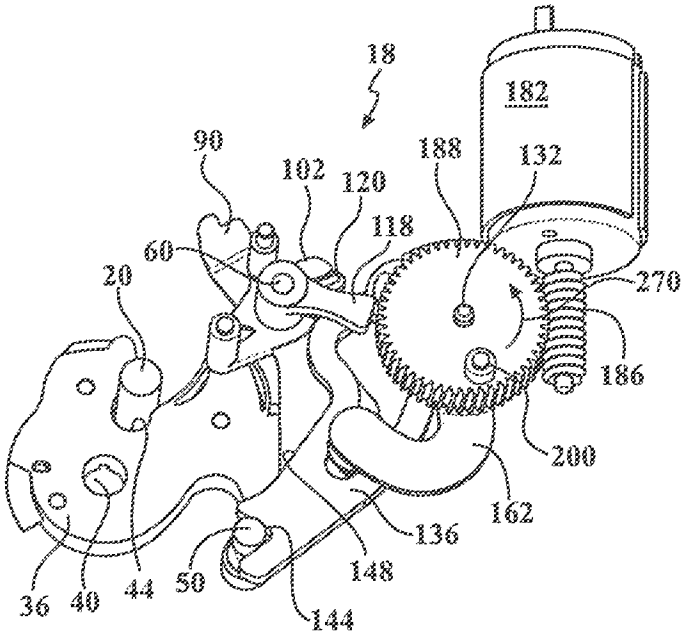
Figure 17F:
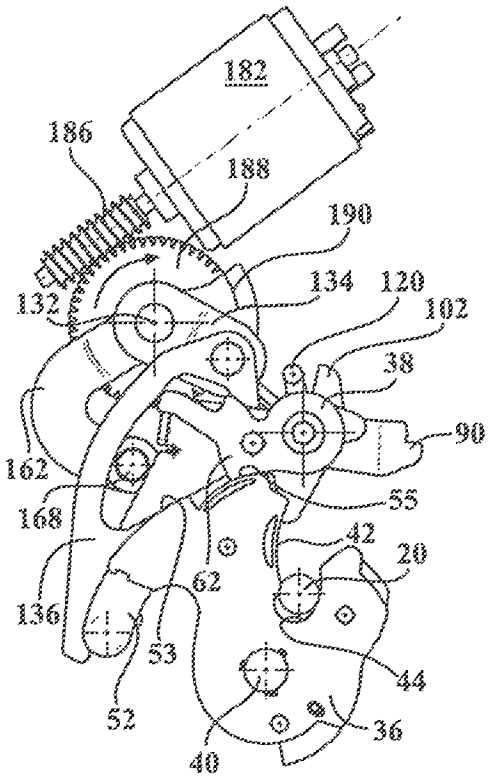
Figure 16F:
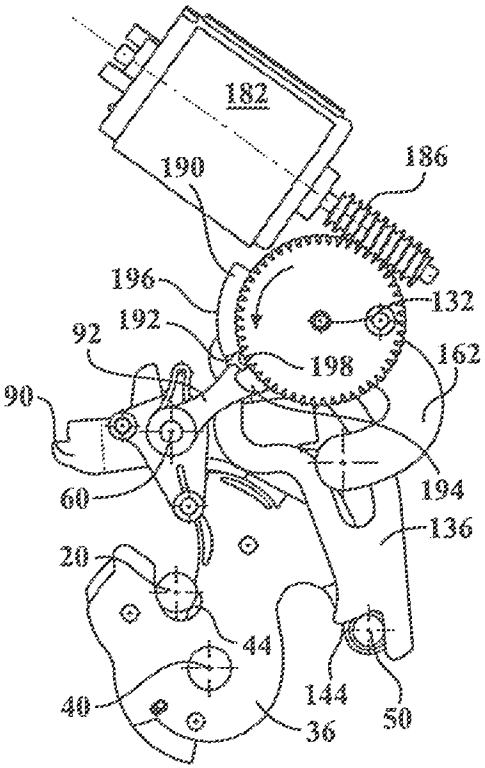
Figure 15F:
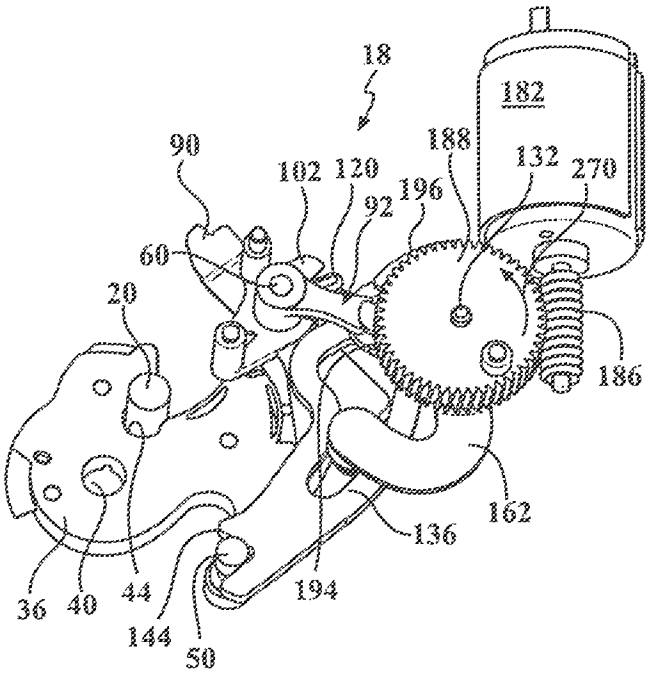
Figure 17G:
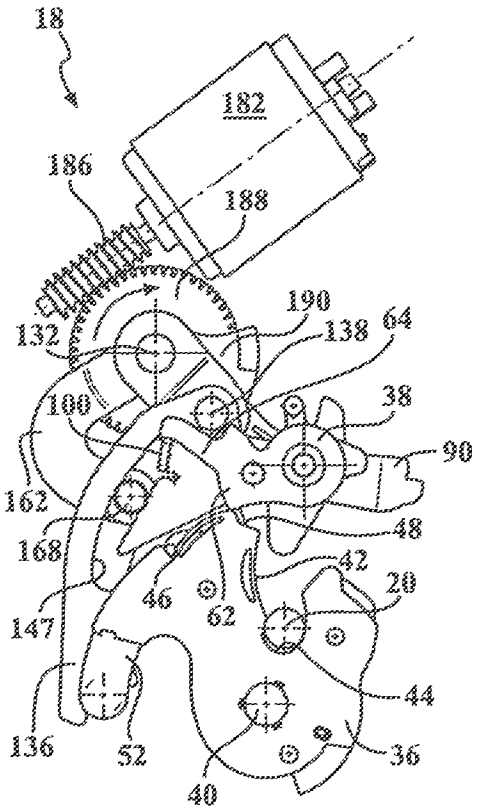
Figure 16G:
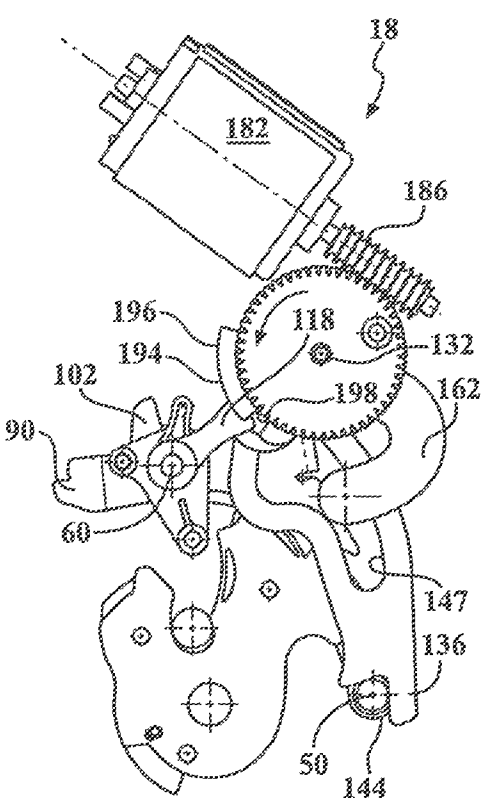
Figure 15G:
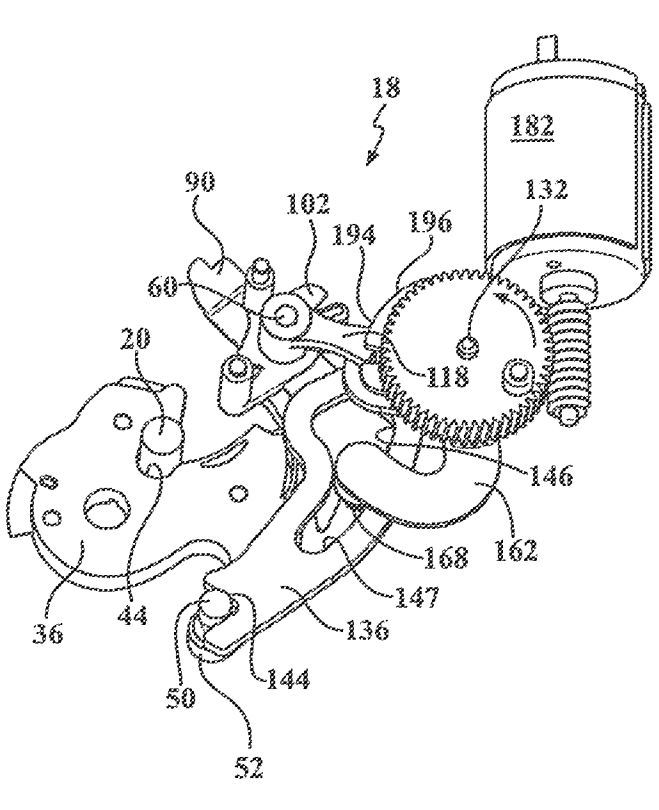
Figure 17H:
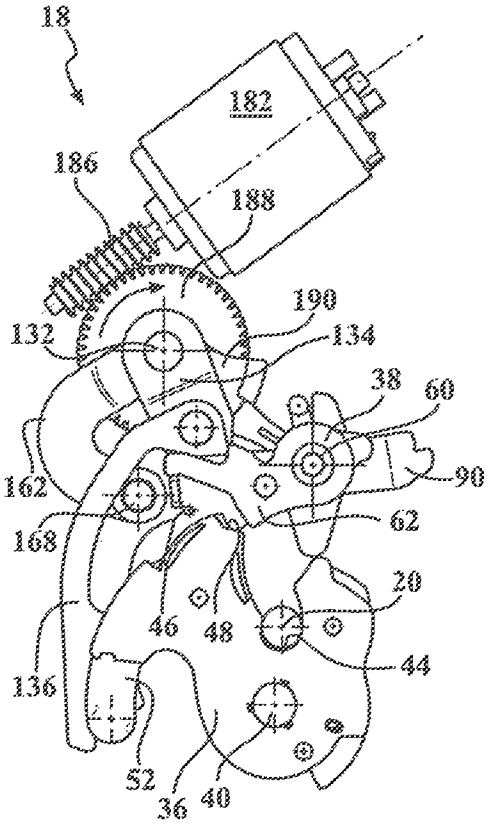
Figure 16H:
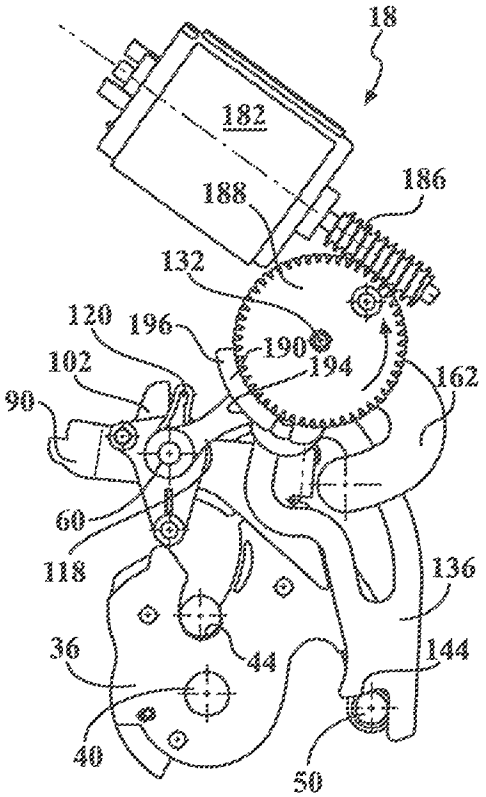
Figure 15H:
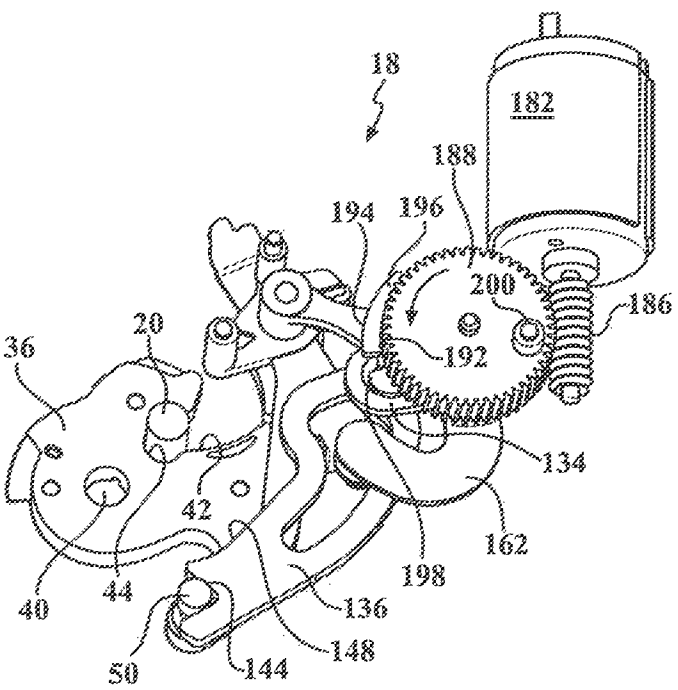
Figure 17I:
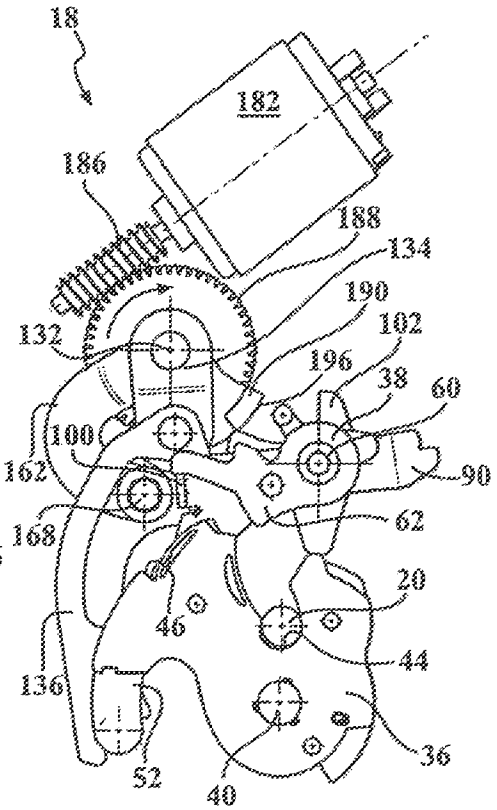
Figure 16I:
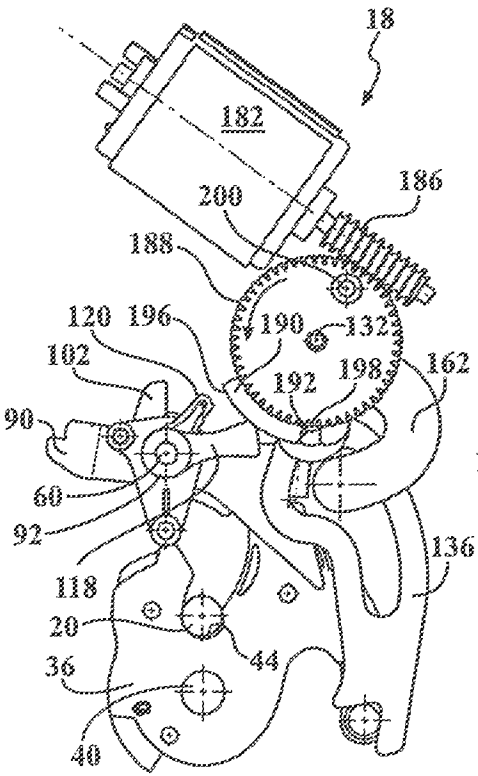
Figure 15I:
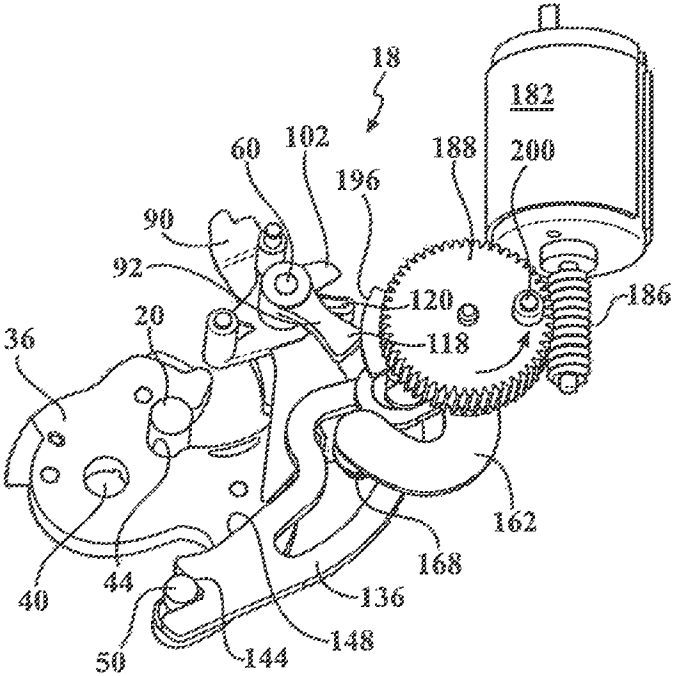
Figure 17J:
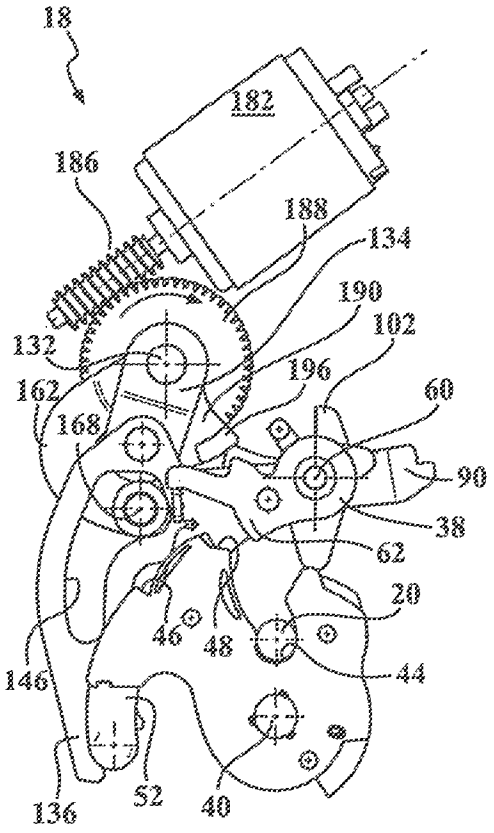
Figure 16J:
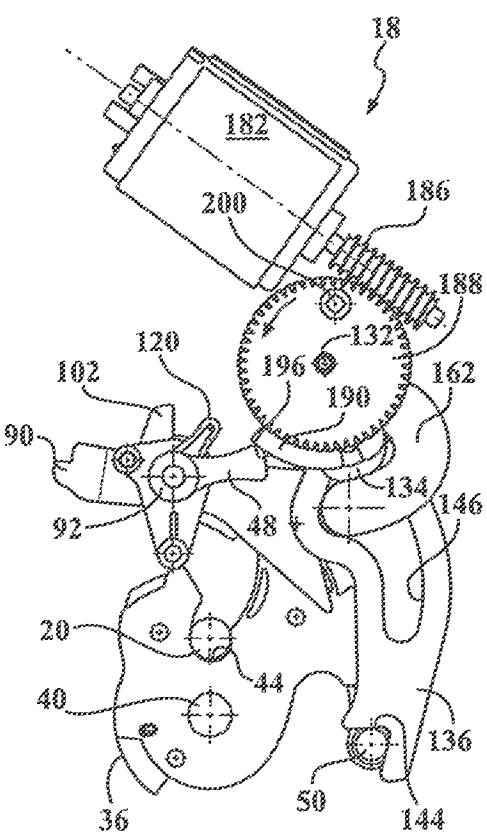
Figure 15J:
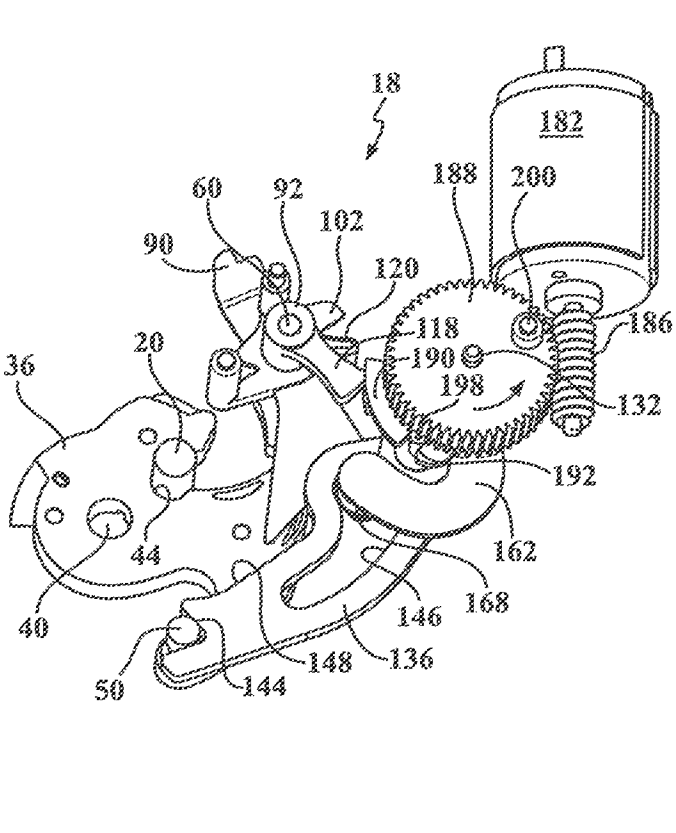
Figure 17K:
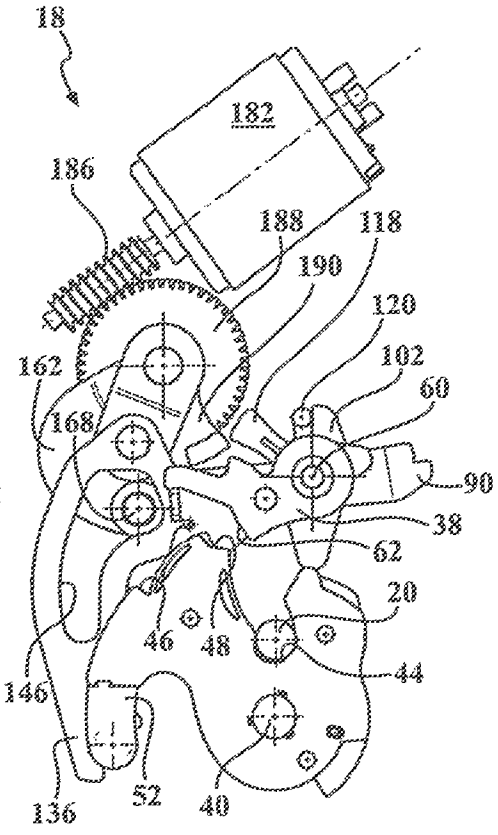
Figure 16K:
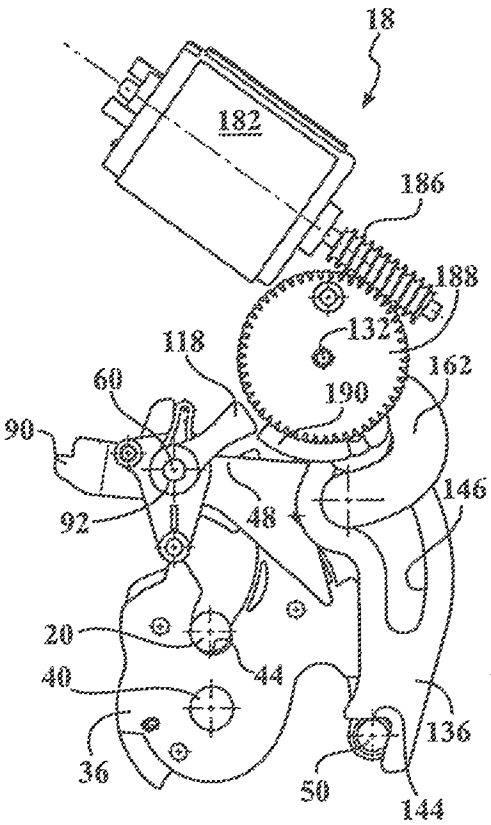
Figure 15K:
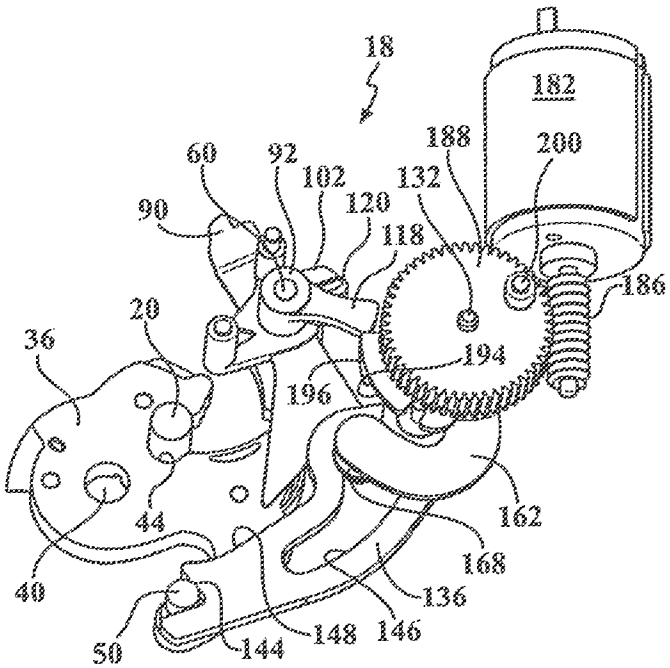
Figure 17L:
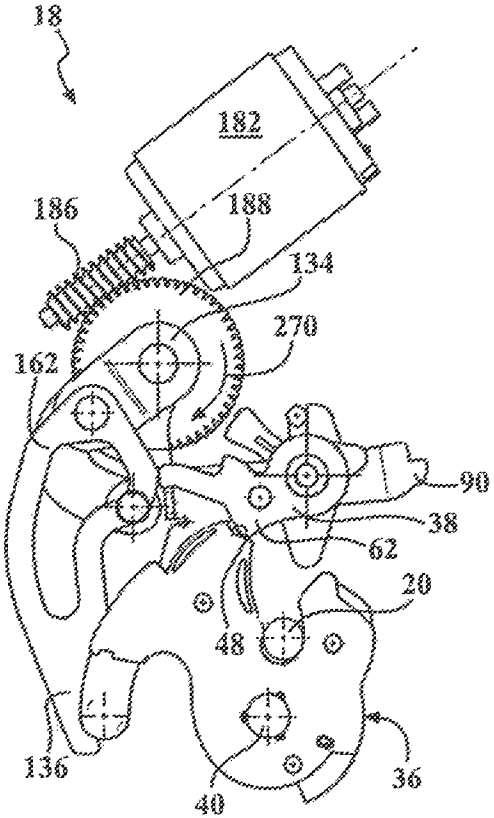
Figure 16L:
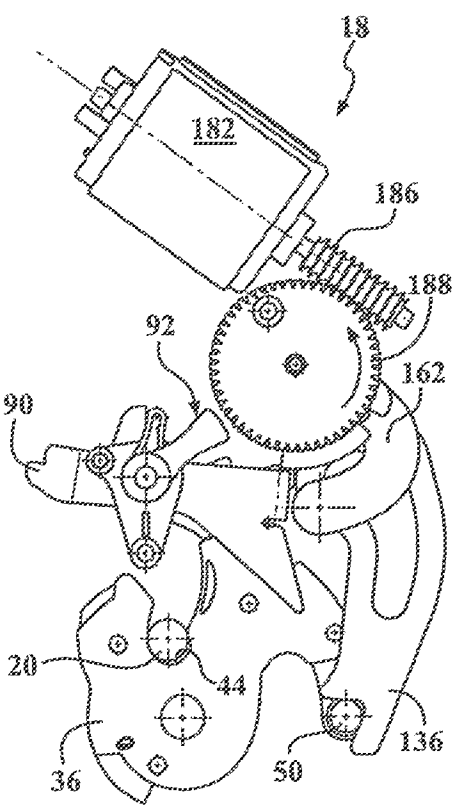
Figure 15L:
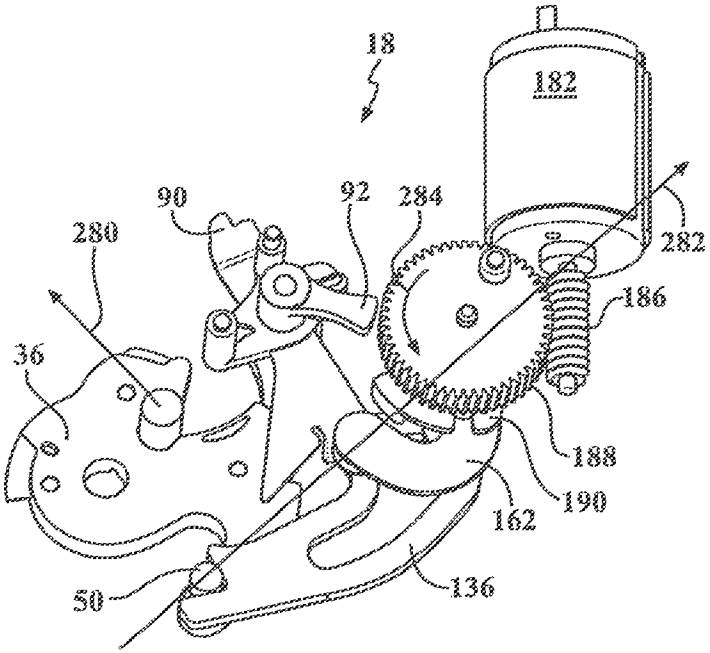
Figure 23:
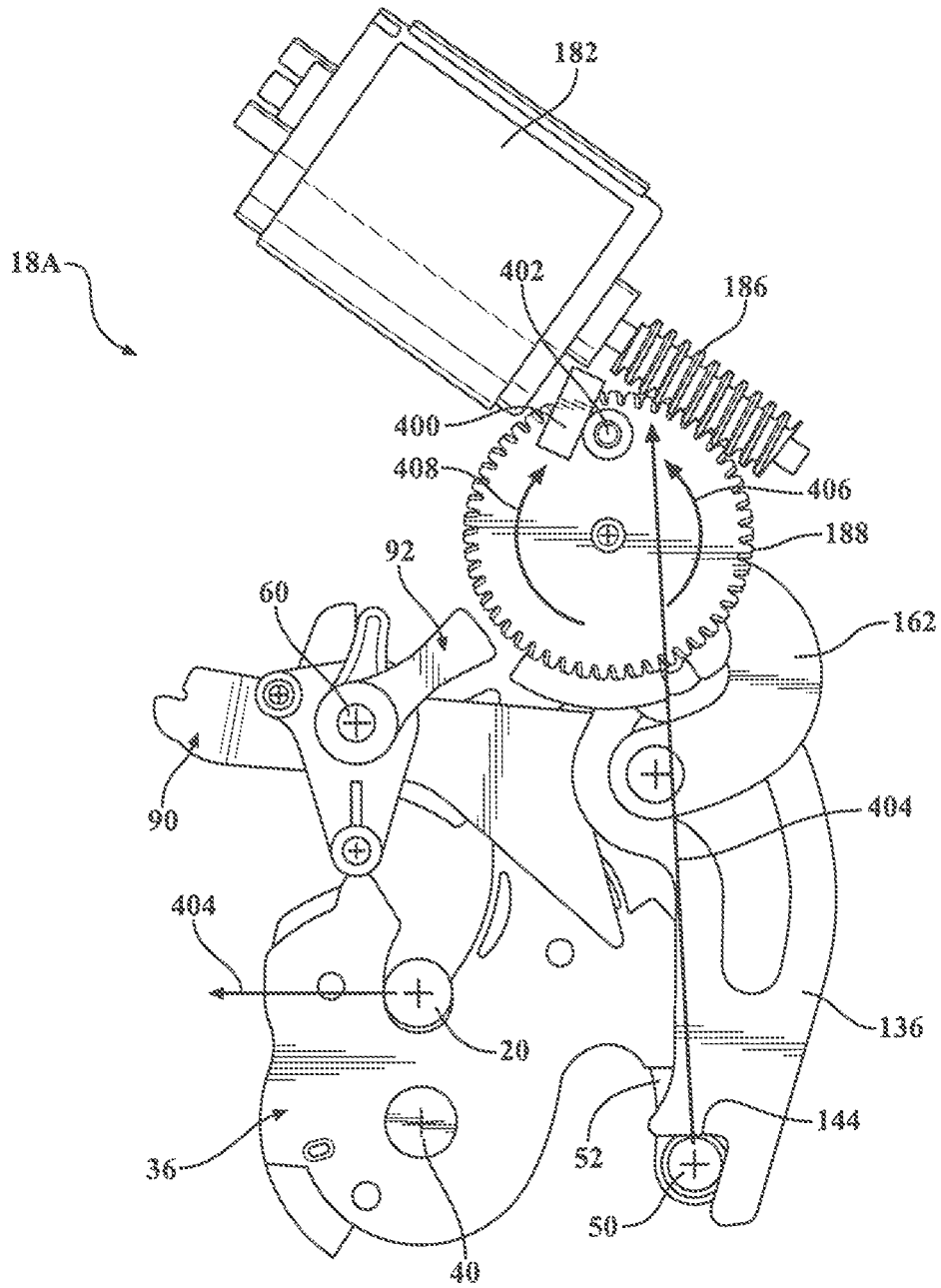
Figure 24:
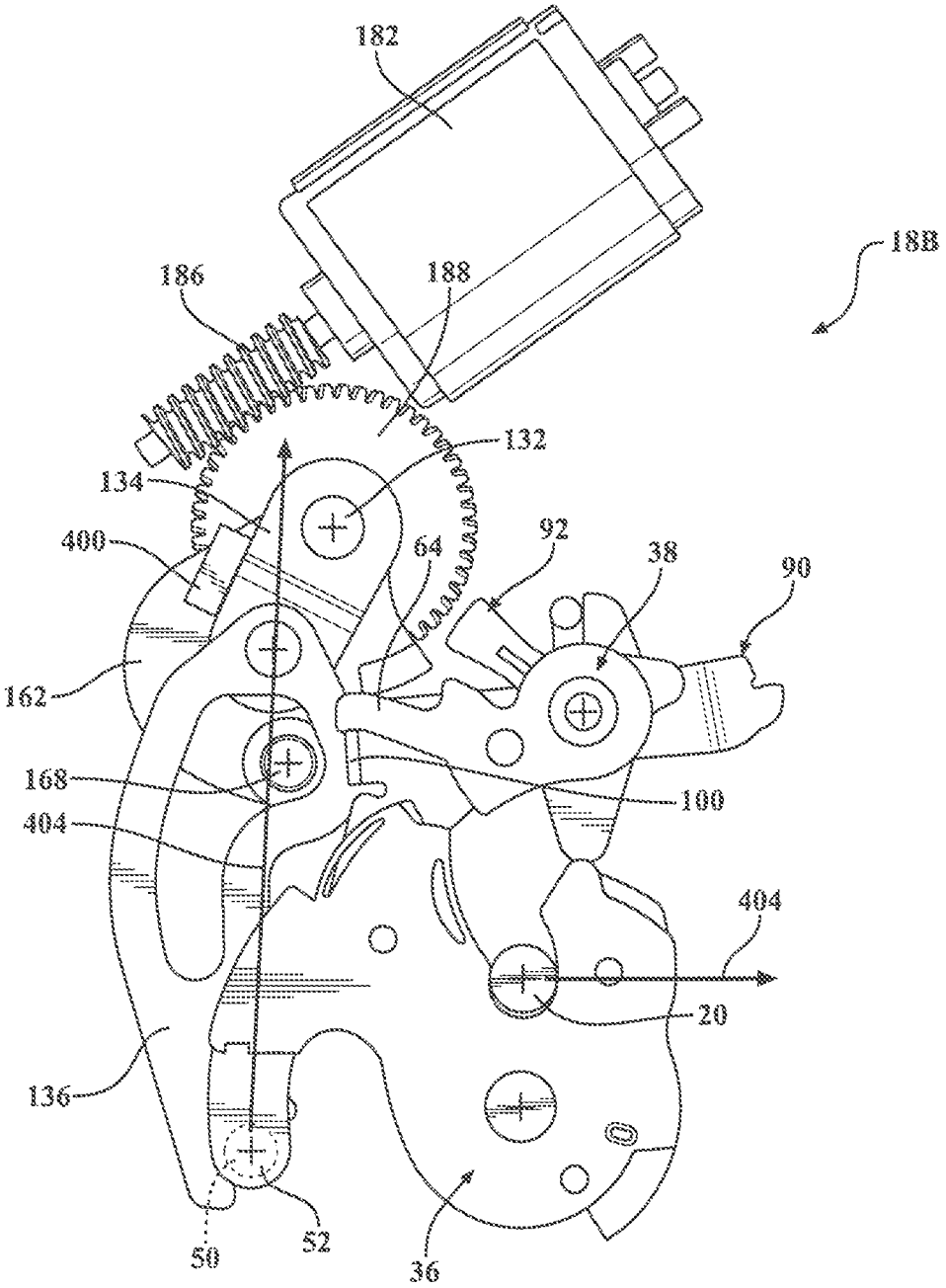

FIGS. 13A through 13C respectively illustrate orientations of the ratchet and pawl components of the latch mechanism for establishing the first, second and third closed positions of the closure panel;

FIGS. 14A and 14B illustrate different orientations of the ratchet and pawl components of the latch mechanism and the cinch lever and cinch link lever components of the latch cinch mechanism during a power cinching operation of the power latch assembly causing movement of the closure panel from its first closed position into its third closed position (FIG. 14A) and from its second closed position into its third closed position (FIG. 14B);

FIGS. 15A through 15K illustrate a series of sequential isometric views showing the interaction and relative movement of various components of the one-motor power latch assembly upon movement of the closure panel from its open position into its third closed position via operation of a power cinching feature in accordance with the present disclosure;

FIGS. 16A through 16K are a series of sequential top elevational views of the one-motor power latch assembly which correspond to FIGS. 15A through 15K and which further illustrate the power cinching feature;

FIGS. 17A through 17K are a series of sequential bottom elevational views of the one-motor power latch assembly which also correspond to FIGS. 15A through 15K and which further illustrate the power cinching feature;

FIGS. 15L, 16L and 17L are an isometric view and top and bottom elevational views of the one-motor power latch assembly illustrating a safety latching feature provided during a vehicular collision event;

FIGS. 18A through 18G illustrate a series of sequential isometric views showing the interaction and relative movement of the components of the one-motor power latch assembly upon movement of the closure panel from its third closed position into its open position via operation of a power release feature and which provides a soft open function in accordance with the present disclosure;

FIGS. 19A through 19G illustrate a series of sequential top elevational views corresponding to FIGS. 18A through 18G to further illustrate the soft open function provided by the power release feature of the one-motor power latch assembly;

FIGS. 20A through 20G illustrate a series of sequential bottom elevational views also corresponding to FIGS. 18A through 18G to further illustrate the soft open function provided by the power release feature;

FIGS. 21A through 21E illustrate a series of sequential isometric views showing the interaction and relative movement of various components of the one-motor power latch assembly upon mechanical actuation of an inside latch release mechanism for moving the closure panel from its third closed position to its open position to provide an inside release feature in accordance with the present disclosure;

FIGS. 22A through 22E illustrate a series of sequential isometric views showing the interaction and relative movement of various components of the one-motor power latch assembly upon mechanical actuation of the outside latch release mechanism for moving the closure panel from its third closed position to its door open position to provide an outside release feature in accordance with the present disclosure;

FIG. 23 is an isometric view of an alternative version of the one-motor power latch assembly constructed in accordance with a third embodiment of the present disclosure and showing the components thereof positioned when the closure panel is located in its third or cinched closed position; and FIG. 24 is an isometric view of another alternative version of the one-motor power latch assembly constructed in accordance with a fourth embodiment of the present disclosure showing the position of its components when the closure panel is located in its third or cinched closed position.

Corresponding reference numerals are used to indicate corresponding components throughout the several views of the drawings.

DETAILED DESCRIPTION

Example embodiments will now be described more fully with reference to the accompanying drawings. To this end, the example embodiments are provided so that this disclosure will be thorough, and will fully convey its intended scope to those who are skilled in the art. Accordingly, numerous specific details are set forth such as examples of specific components, devices, and methods, to provide a thorough understanding of embodiments of the present disclosure. However, it will be apparent to those skilled in the art that specific details need not be employed, that example embodiments may be embodied in many different forms, and that neither should be construed to limit the scope of the present disclosure. In some example embodiments, well-known processes, well-known device structures, and well-known technologies are not described in detail.

In the following detailed description, the expression "power latch assembly" will be used to generally indicate any power-operated latch device adapted for use with a vehicle closure panel to provide a power cinch feature in combination with a soft opening function with or without a power release feature. Additionally, the expression "closure panel" will be used to indicate any element moveable between an open position and at least one closed position, respectively opening and closing an access to an inner compartment of a motor vehicle and therefore includes, without limitations, decklids, tailgates, liftgates, bonnet lids, and sunroofs in addition to the sliding or pivoting side passenger doors of a motor vehicle to which the following description will make explicit reference, purely by way of example.

Figure 1:
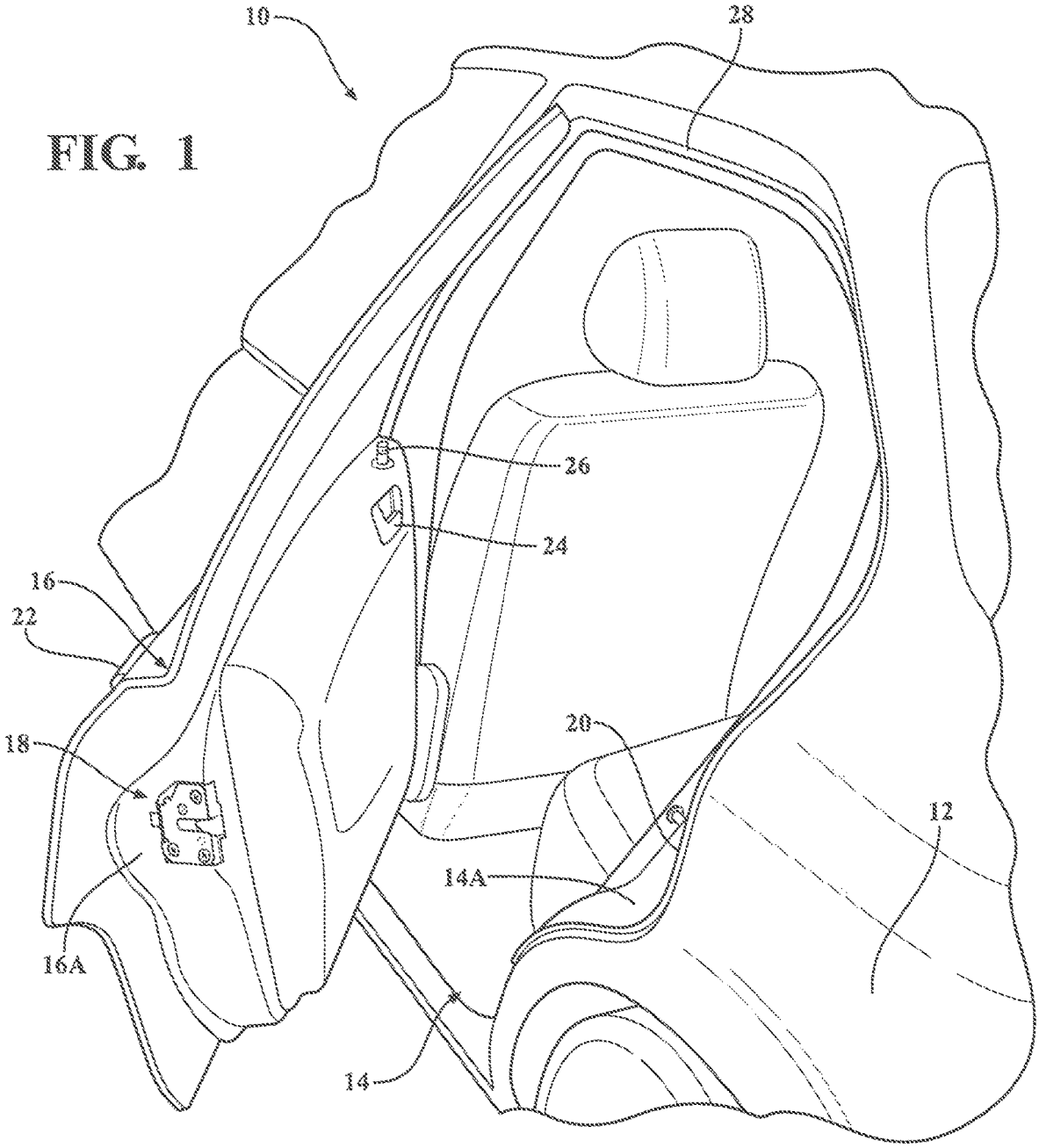
FIG. 1 is a partial perspective view of a motor vehicle having a closure panel equipped with a power latch assembly that is constructed in accordance with the teachings of the present disclosure.

Referring initially to FIG. 1 of the drawings, a motor vehicle 10 is shown to include a vehicle body 12 defining an opening 14 to an interior passenger compartment. A closure panel 16 is pivotably mounted to body 12 for movement between an open position (shown) and a fully closed position to respectively open and close opening 14. A power latch assembly 18 is rigidly secured to closure panel 16 adjacent to an edge portion 16A thereof and is releasably engageable with a striker 20 that is fixedly secured to a recessed edge portion 14A of opening 14. As will be detailed, power latch assembly 18 is operable to engage striker 20 and releasably move closure panel 16 into its fully closed position. An outside handle 22 and an inside handle 24 are provided for actuating power latch assembly 18 to release striker 20 and permit subsequent movement of closure panel 16 to its open position. An optional lock knob 26 is shown which provides a visual indication of the locked state of latch assembly 18 and which may also be operable to mechanically change the locked state of latch assembly 18. A weather seal 28 is mounted on edge portion 14A of opening 14 in vehicle body 12 and is adapted to be resiliently compressed upon engagement with a mating sealing surface of closure panel 16 when closure panel 16 is held by latch assembly 18 in its closed position so as to provide a sealed interface therebetween which is configured to prevent entry of rain and dirt into the passenger compartment while minimizing audible wind noise. For purpose of clarity and functional association with motor vehicle 10, the closure panel is hereinafter referred to as passenger door 16.

Figure 8:
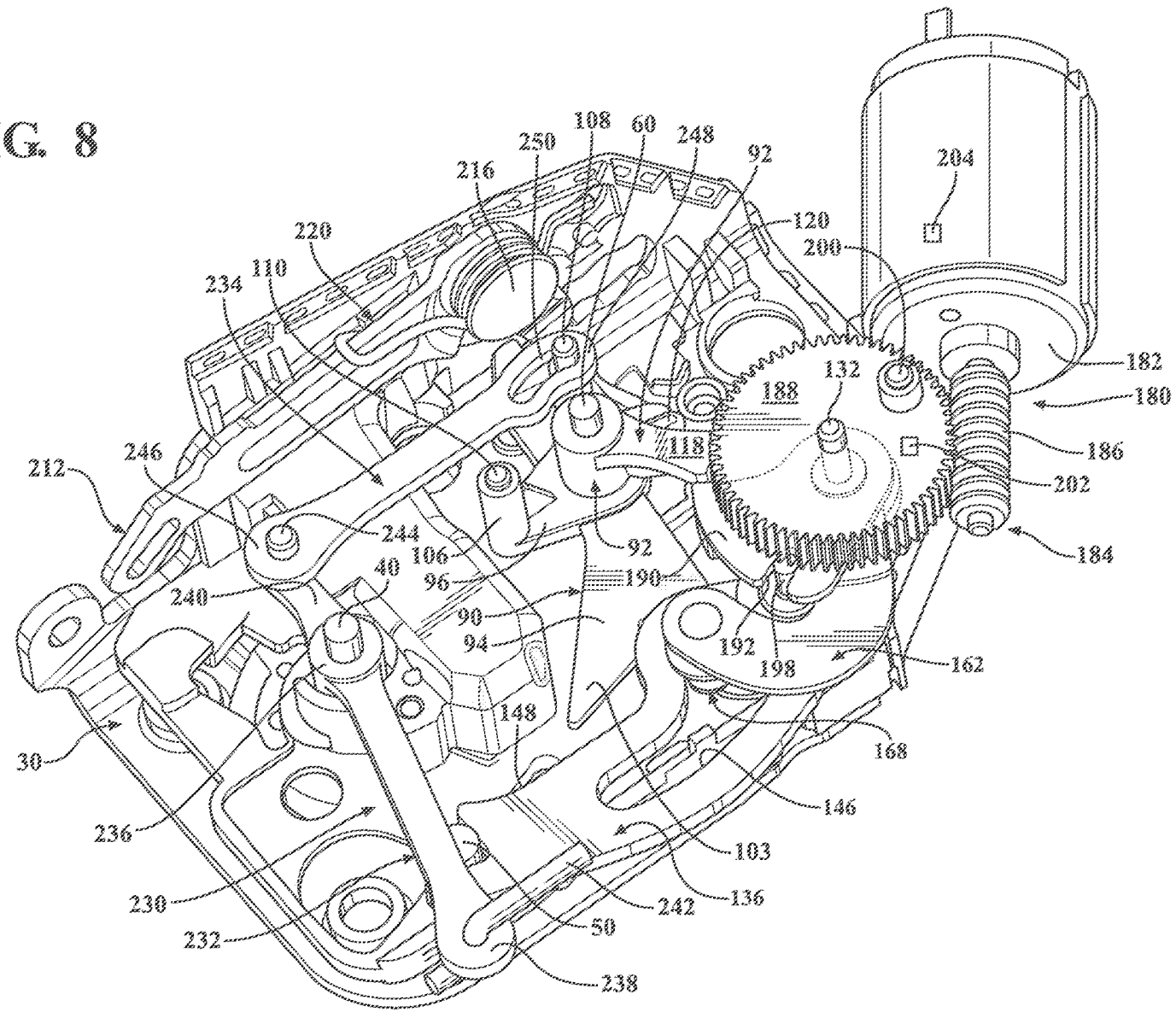
FIG. 8 is another isometric view of the one-motor power latch assembly showing various components of an outside release mechanism operably associated with the latch release mechanism of FIG. 3.
Figure 9B:
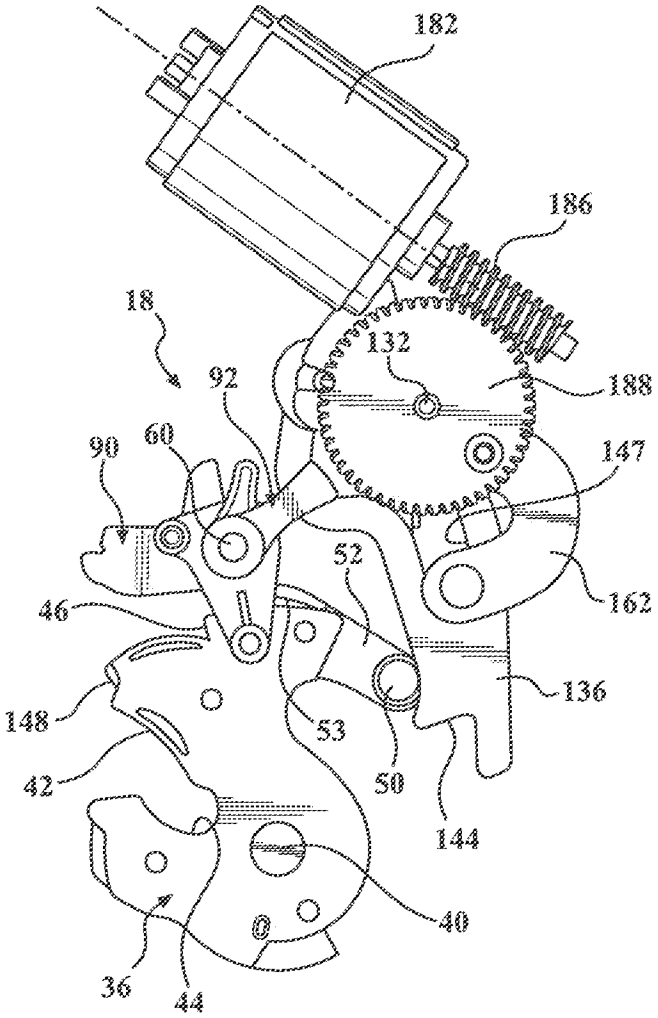
FIGS. 9A and 9B are views of the one-motor power latch assembly showing the position of its various components when the closure panel is located in an open position.
Figure 9A:
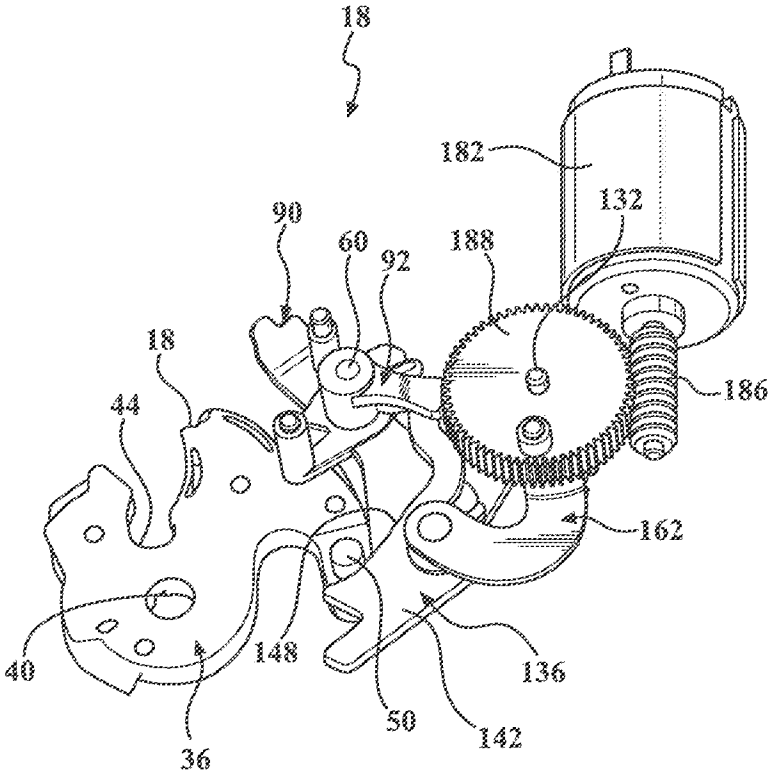
Figure 10B:
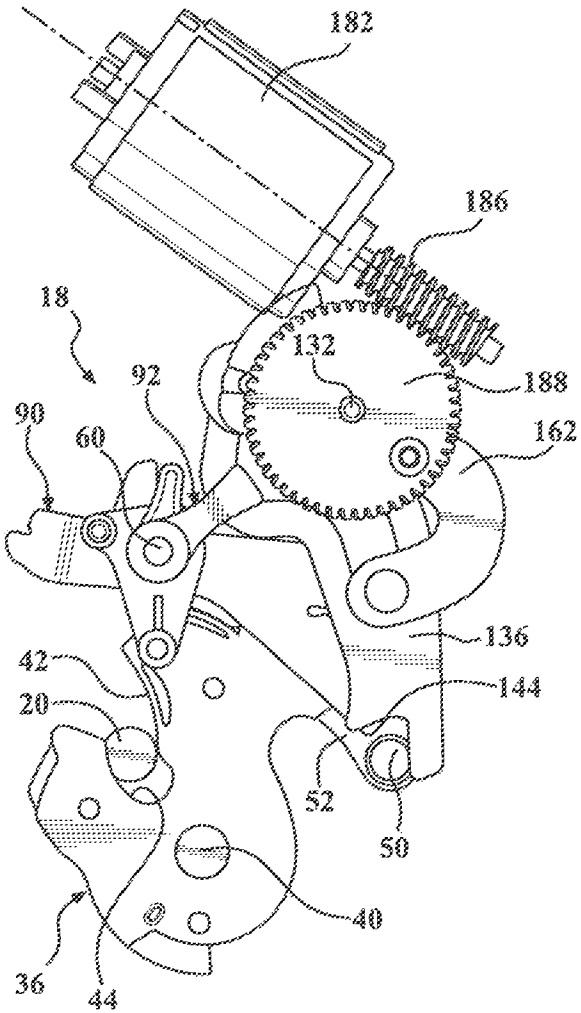
FIGS. 10A and 10B are views of the one-motor power latch assembly showing the position of its various components when the closure panel has moved from the open position into a first or "soft" closed position.
Figure 10A:
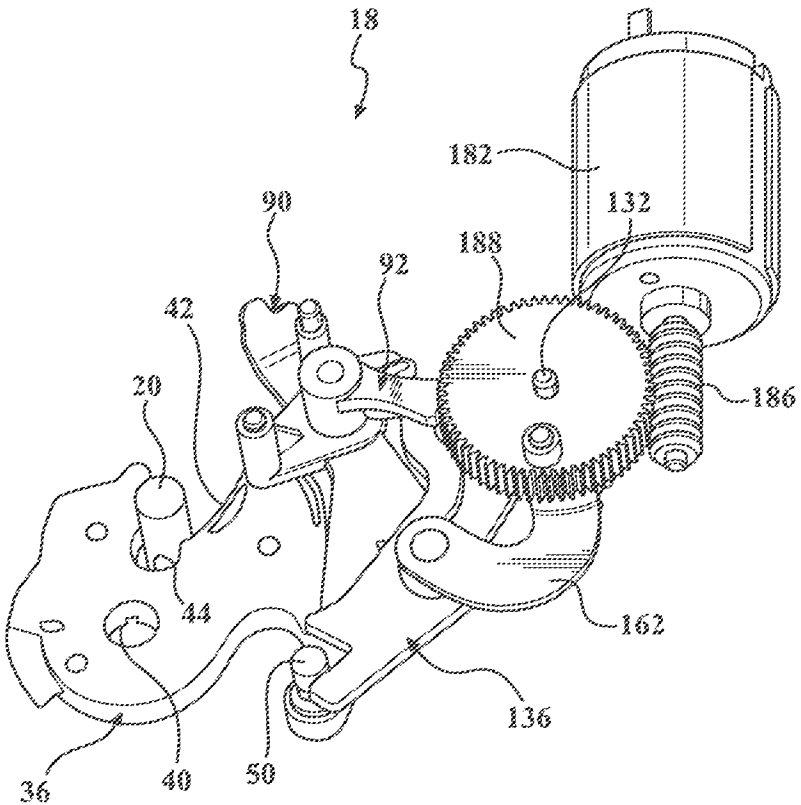
Figure 11B:
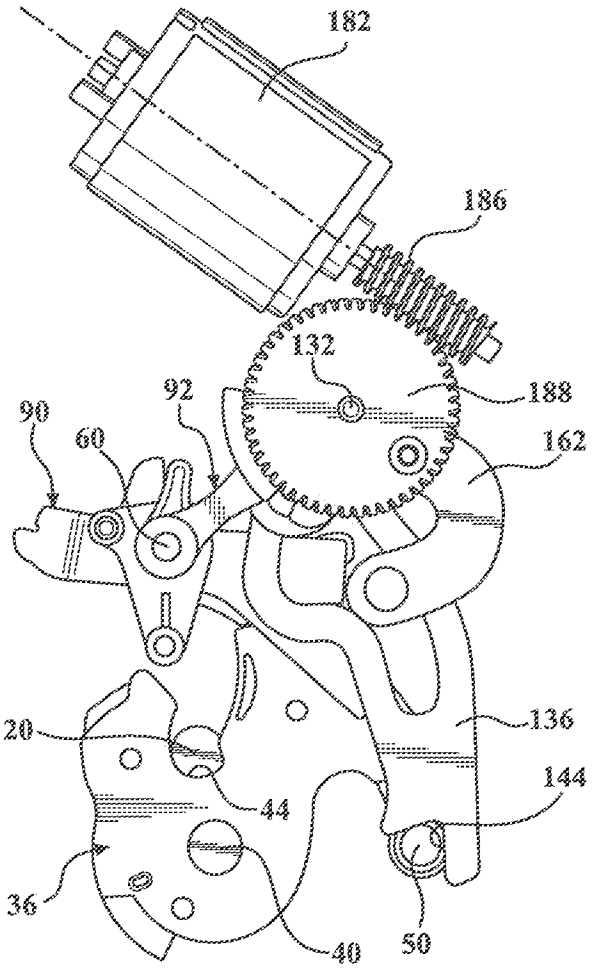
FIGS. 11A and 11B are views of the one-motor power latch assembly showing the position of its various components when the closure panel has moved from the first closed position into a second or "hard" closed position.
Figure 11A:
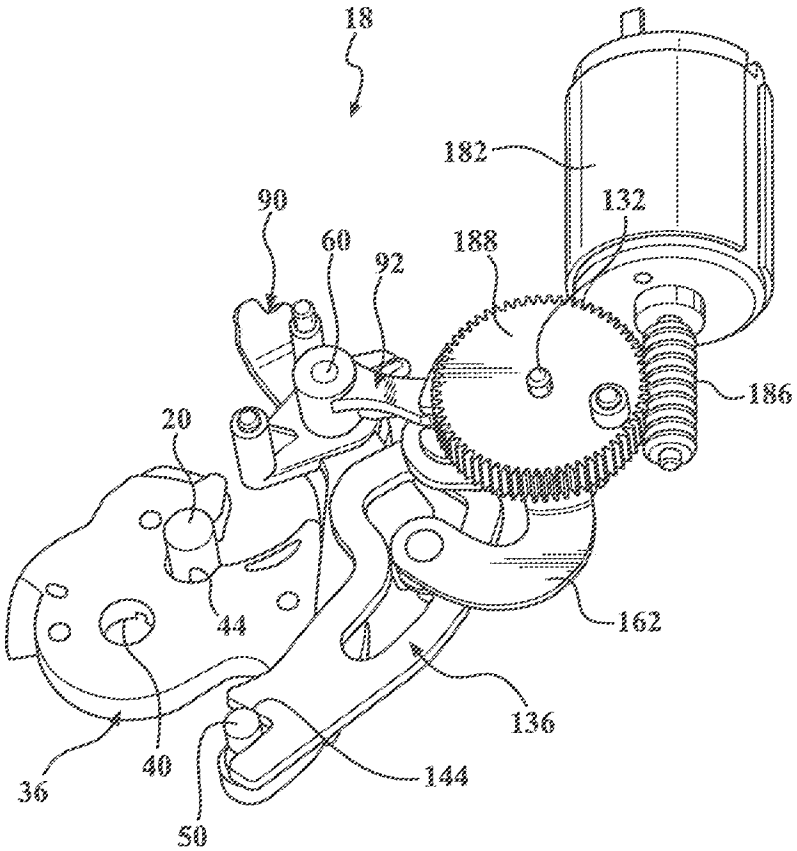
Figure 12B:
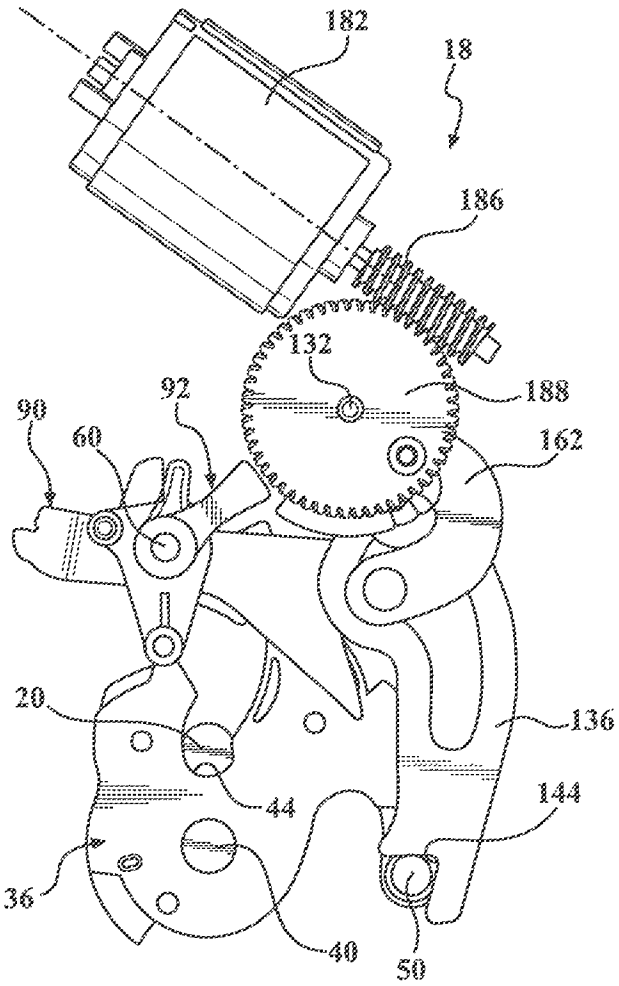
FIGS. 12A and 12B are views of the one-motor power latch assembly showing the position of its various components when the closure panel has moved from the second closed position into a third or "cinch" closed position.
Figure 12A:
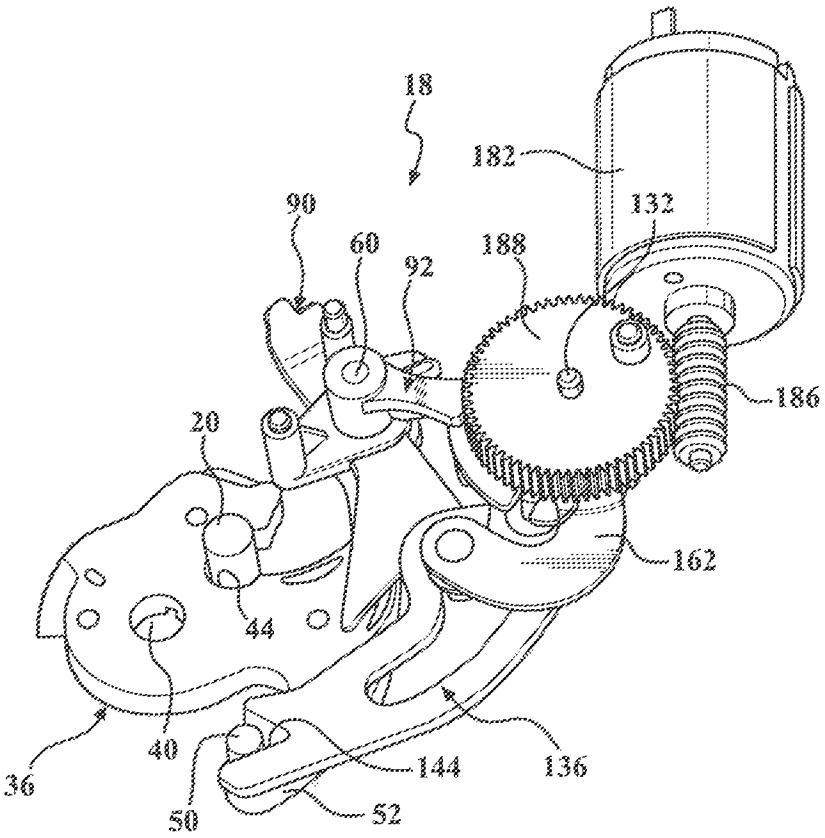

A detailed description of non-limiting embodiments of a single-motor power latch assembly 18, constructed in accordance with the teaching of the present disclosure, will now be provided. In general, FIGS. 2 through 8 illustrate a series of similar views sequentially showing a "built-up" construction of power latch assembly 18 comprising: a latch mechanism 32 (FIG. 2); a latch release mechanism 72 (FIG. 3); a latch cinch mechanism 130 (FIG. 4); a cinch disengage mechanism 160 (FIG. 5); an actuator mechanism 180 (FIG. 6); an inside release mechanism 210 (FIG. 7); and an outside release mechanism 230 (FIG. 8). FIGS. 9A and 9B illustrate various components of power latch assembly 18 oriented to establish a "released" mode when door 16 is located in an open position. FIGS. 10A and 10B illustrate various components of power latch assembly 18 oriented to establish a "first safety latched" mode when door 16 is located in a first or soft closed position. FIGS. 11A and 11B illustrate various components of power latch assembly 18 oriented to establish a "second safety latched" mode when door 16 is located in a second or hard closed position. Finally, FIGS. 12A and 12B illustrate various components of power latch assembly 18 oriented to establish a "cinch latched" mode when door 16 is located in a third or cinched closed position.

FIGS. 15A through 15K, FIGS. 16A through 16K and FIGS. 17A through 17K provide a coordinated series of sequential views which clearly illustrate the relative movement of various components associated with power latch assembly 18 to provide a "power cinch" feature and establish the cinch latched mode. Additionally, FIGS. 15L, 16L and 17L illustrate various components of power latch assembly 18 oriented to provide a mechanical latching feature upon motor vehicle 10 experiencing a collision impact for establishing a "blocking safety latched" mode. Similarly, FIGS. 18A through 18G, FIGS. 19A through 19G and FIGS. 20A through 20G provide a coordinated series of sequential views illustrating the relative movement of various components associated with power latch assembly 18 to provide a "power release" feature and establish the released mode. As will be detailed, FIGS. 18A-18C, FIGS. 19A-19C and FIGS. 20A-20C also illustrate the various components of power latch assembly 18 positioned for shifting from the cinch latched mode into a "cinch released" mode as part of an uncinching/soft opening function provided by the power release feature. FIGS. 21A through 21E provide a series of sequential views illustrating actuation of inside release mechanism 210 for opening door 16 using inside door handle 24 during certain non-powered conditions. Finally, FIGS. 22A through 22E provide a series of sequential views illustrating actuation of outside release unit 230 for opening door 16 using outside door handle 22 during certain non-powered conditions.

Figure 2:
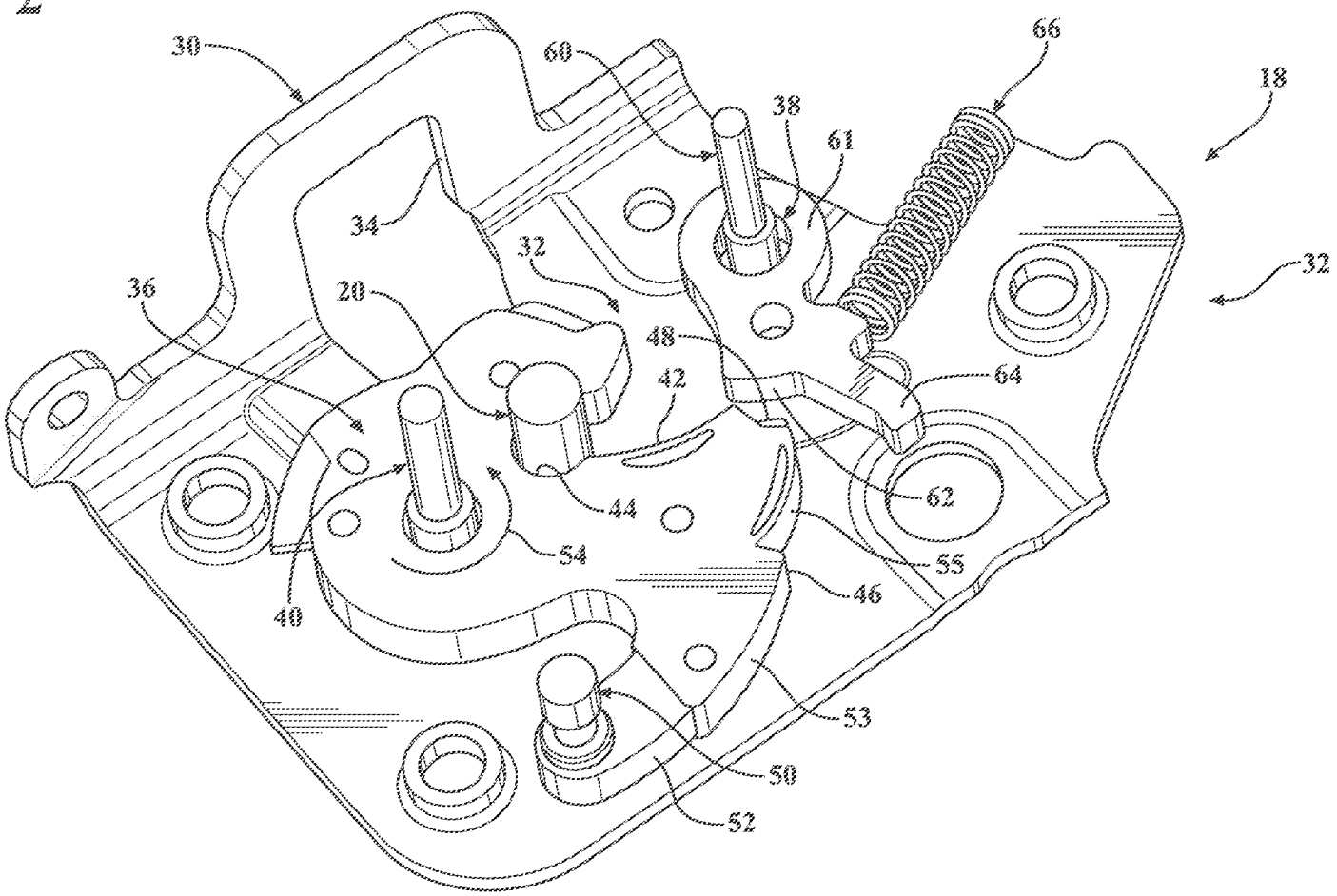
FIG. 2 is an isometric view of a one-motor power latch assembly constructed in accordance with a first embodiment of the present disclosure and showing various components associated with a pawl and ratchet type of latch mechanism.

Referring now to FIG. 2, the one-motor version of power latch assembly 18 is shown to include a frame plate 30 and latch mechanism 32. Frame plate 30 is a rigid component configured to be fixedly secured to edge portion 16A of door 16 and defines an entry aperture 34 through which striker 20 travels upon movement of door 16 toward and away from its closed positions. Latch mechanism 32 is shown, in this non-limiting example, as a single pawl arrangement generally including a ratchet 36 and a pawl 38. Ratchet 36 is supported for pivotal movement on a ratchet pivot pin 40 extending outwardly from frame plate 30. Ratchet 36 is configured to include a contoured guide channel 42 which terminates in a striker capture pocket 44, a first safety latch surface 46 and a second safety latch surface 48. A projection, such as an upstanding ratchet lug or rivet 50, extends outwardly from a leg segment 52 of ratchet 36. Ratchet 36 is further configured to include a first cam edge surface 53 formed between leg segment 52 and first safety latch surface 46, and a second cam edge surface 55 formed between first safety latch surface 46 and second safety latch surface 48. A ratchet biasing member, schematically shown by arrow 54, is adapted to normally bias ratchet 36 to rotate in a first or releasing direction (counterclockwise in FIG. 2). Ratchet 36 is shown in FIG. 2 rotated and held in a second or latching direction such that striker 20 is retained in capture pocket 44 and prevented from release through guide channel 42. As will be detailed, ratchet 36 is pivotably moveable between a plurality of distinct positions including a striker release position (FIGS. 9A and 9B), a first or "soft close" striker capture position (FIGS. 10A and 10B), a second or "hard close" striker capture position (FIGS. 11A and 11B), and a third or "cinched" striker capture position (FIGS. 12A and 12B).

Pawl 38 is supported for pivotal movement on a pawl pivot pin 60 which extends outwardly from frame plate 30. Pawl 38 is configured to include a body segment 61 having an engagement surface 62 adapted, under certain conditions, to selectively and releasably engage one of first safety surface 46 and second safety latch surface 48 of ratchet 36. Pawl 38 further includes a leg segment 64 extending outwardly from body segment 61. A pawl biasing member, such as coil spring 66, is provided for normally biasing pawl 38 in a first rotary direction (clockwise in FIG. 2) toward a ratchet checking position. Pawl 38 is shown located in its ratchet checking position in FIG. 2 while pawl 38 is shown in FIGS. 9A and 9B rotated in a second rotary direction into a ratchet release position.

Figure 3:
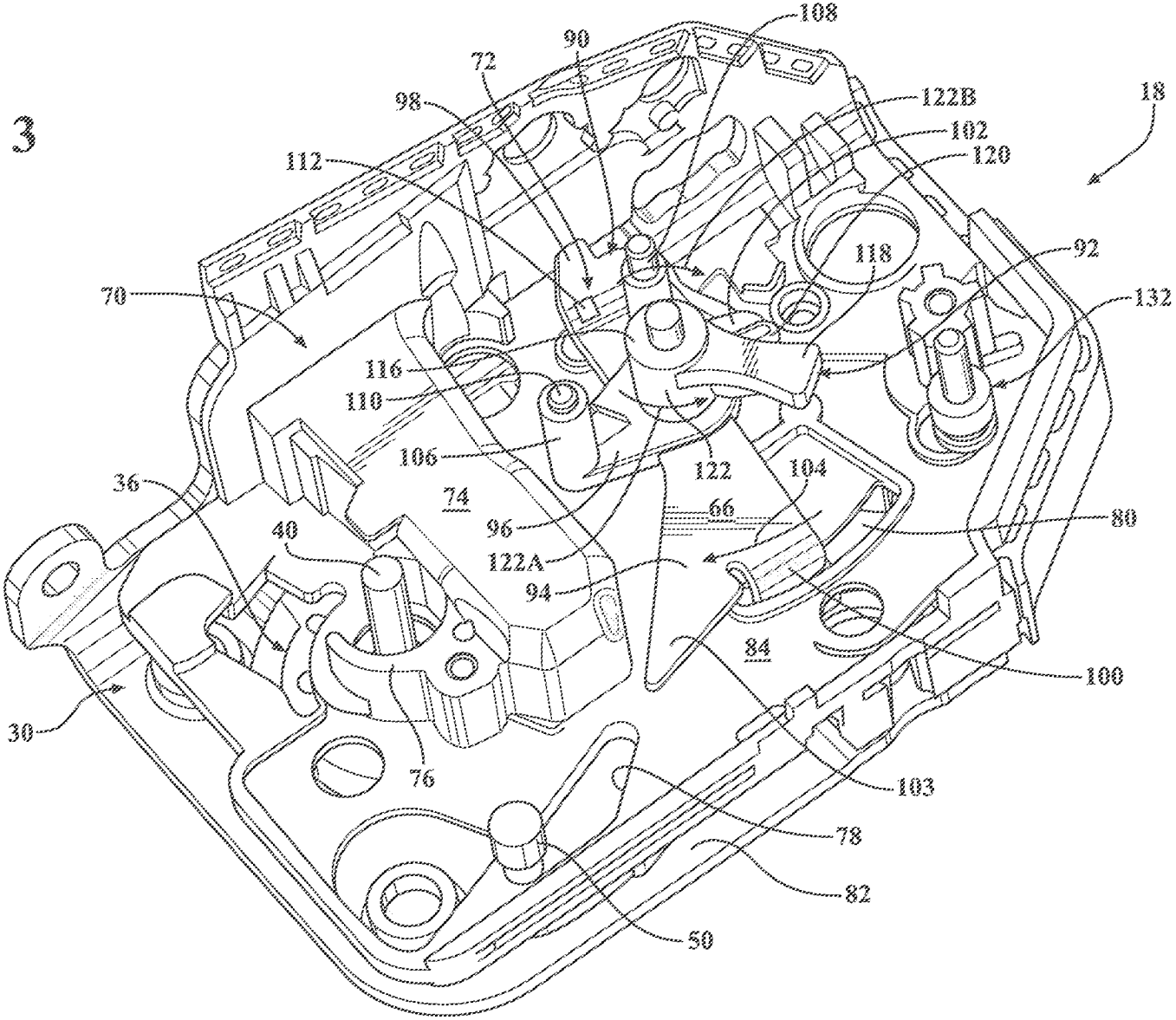
FIG. 3 is another isometric view of the one-motor power latch assembly showing various components of a latch release mechanism operably associated with the latch mechanism of FIG. 2.

FIG. 3 is generally similar to FIG. 2, but further illustrates power latch assembly 18 to include a latch housing 70 and a latch release mechanism 72 installed on frame plate 30. Latch housing 70 is configured to define a raised tunnel section 74 which overlies guide channel 42, a first boss section 76 through which ratchet pivot pin 40 extends, a second boss section (not shown) through which pawl pivot pin 60 extends, a first guide slot 78 through which ratchet rivet 50 extends, and a second guide slot 80. Latch housing 70 is adapted to be secured to frame plate 30 and is configured to locate latch mechanism 32 between a plate segment 82 of frame plate 30 and a plate segment 84 of latch housing 70.

Latch release mechanism 72 is best shown in FIG. 3 for engaging pawl 38 and being operable in a first latch release mode for locating pawl 38 in its ratchet checking position and in a second latch release mode for locating pawl 38 in its ratchet release position. To provide these two modes of operation, latch release mechanism 72 is shown to include a pawl lever 90 and a release lever 92, both of which are mounted for independent pivotal movement on pawl pivot pin 60. Pawl lever 90 includes an elongate plate segment 94 and a flange segment 96 which each define a common pivot bore (not shown) through which pawl pivot pin 60 extends. Plate segment 94 and flange segment 96 are either formed integrally or can be fixedly secured together for common pivotal movement about pawl pivot pin 60. Plate segment 94 is configured to have a first bent end segment 98, a second bent end segment 100, an intermediate lug segment 102, and a tapered cam segment 103. Second bent end segment 100 extends through second guide slot 80 of latch housing 70 and directly engages leg segment 64 of pawl 38. Arrow 104 indicates that pawl biasing member 66 acts to also normally bias pawl lever 90 in a first (clockwise) rotary direction based on direct engagement of leg segment 64 of panel 38 with end segment 100 of pawl lever 90. As will be detailed, pawl lever 90 is pivotable through a range of motion defined between a first pawl lever position and a second pawl lever position. Specifically, the first pawl lever position is established when pawl 38 is located in its ratchet checking position (FIG. 2) while the second pawl lever position is established when pawl 38 is located in its ratchet release position. A pair of upstanding lugs 106 and 108 are shown formed on flange segment 96 of pawl lever 90, with a position sensing device, such as a magnet 110, being mounted on first lug 106. Magnet 110 and a pawl position sensor 112 work in conjunction with a controller 113 associated with a latch control system 114 (FIG. 6) to detect and coordinate movement of pawl 38 and pawl lever 90, as will be detailed hereinafter with greater specificity.

Release lever 92 is shown in FIG. 3 to include a tubular body segment 116 pivotably supported on pawl pivot pin 60, a first drive arm segment 118 and a second drive arm segment 120. Arrows 122A and 122B schematically illustrate an over-center biasing member configured to normally bias release lever 92 to a "centered" non-actuated position (shown) with intermediate lug segment 102 of pawl lever 90 engaging second drive arm segment 120 of release lever 92. As will be detailed, release lever 92 can be rotated in a first rotary direction (clockwise in FIG. 3) from its central non-actuated position into a first actuated position and can be rotated in a second rotary direction (counterclockwise) to a second actuated position, both in opposition to the biasing of over-center biasing member 122.

Figure 4:
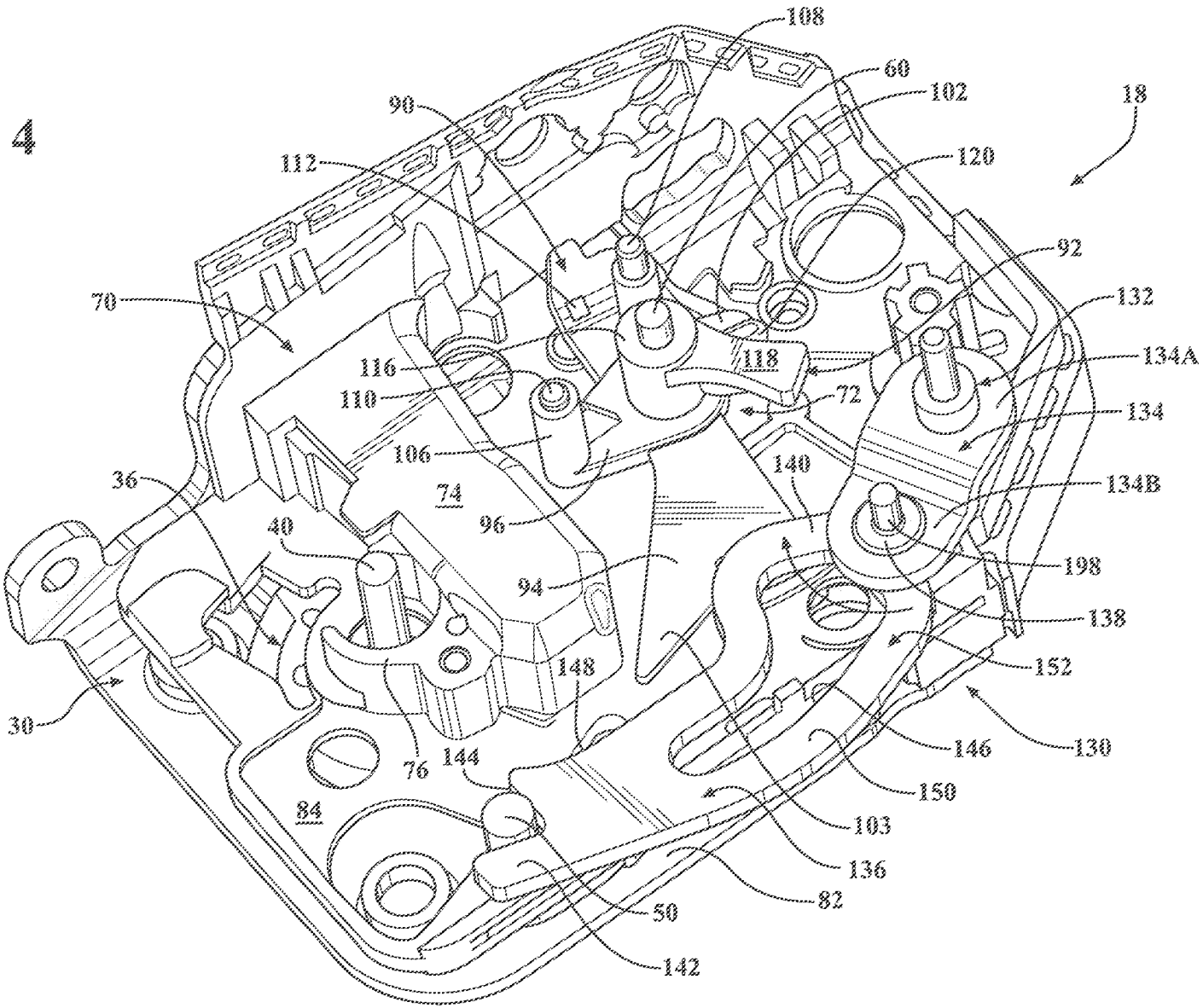
FIG. 4 is another isometric view of the one-motor power latch assembly showing various components of a latch cinch mechanism operably associated with the latch release mechanism of FIG. 3 and the latch mechanism of FIG. 2.

FIG. 4 is generally similar to FIG. 3, but shows power latch assembly 18 to further include the addition of latch cinch mechanism 130 in association with latch release mechanism 72 and latch mechanism 32. To this end, cinch mechanism 130 is shown to generally include a cinch pivot pin 132, a cinch lever 134, and a cinch link lever 136. Cinch lever 134 is shown to include a first segment 134A pivotably mounted on cinch pivot pin 132. A cinch lever pivot pin 138 pivotably interconnects a second segment 134B of cinch lever 134 to a first end segment 140 of cinch link lever 136. A second end segment 142 of cinch link lever 136 is configured to include an engagement shoulder 144 that is shown to be in engagement with ratchet rivet 50 for retaining ratchet 36 in its cinched striker capture position. A contoured follower slot 146 and an external cam surface 148 are formed on an intermediate segment 150 of cinch link lever 136. Intermediate segment 150 of cinch link lever 136 is shown to generally overlie second bent end segment 100 and cam segment 103 of pawl lever 90. Arrow 152 schematically represents a cinch link lever biasing member which, in FIG. 4, is shown to normally bias cinch link lever 136 in a first (clockwise) rotary direction. Pivot pin 132 can be rigidly mounted to latch housing 70 or a cover member (not shown).

Figure 5:
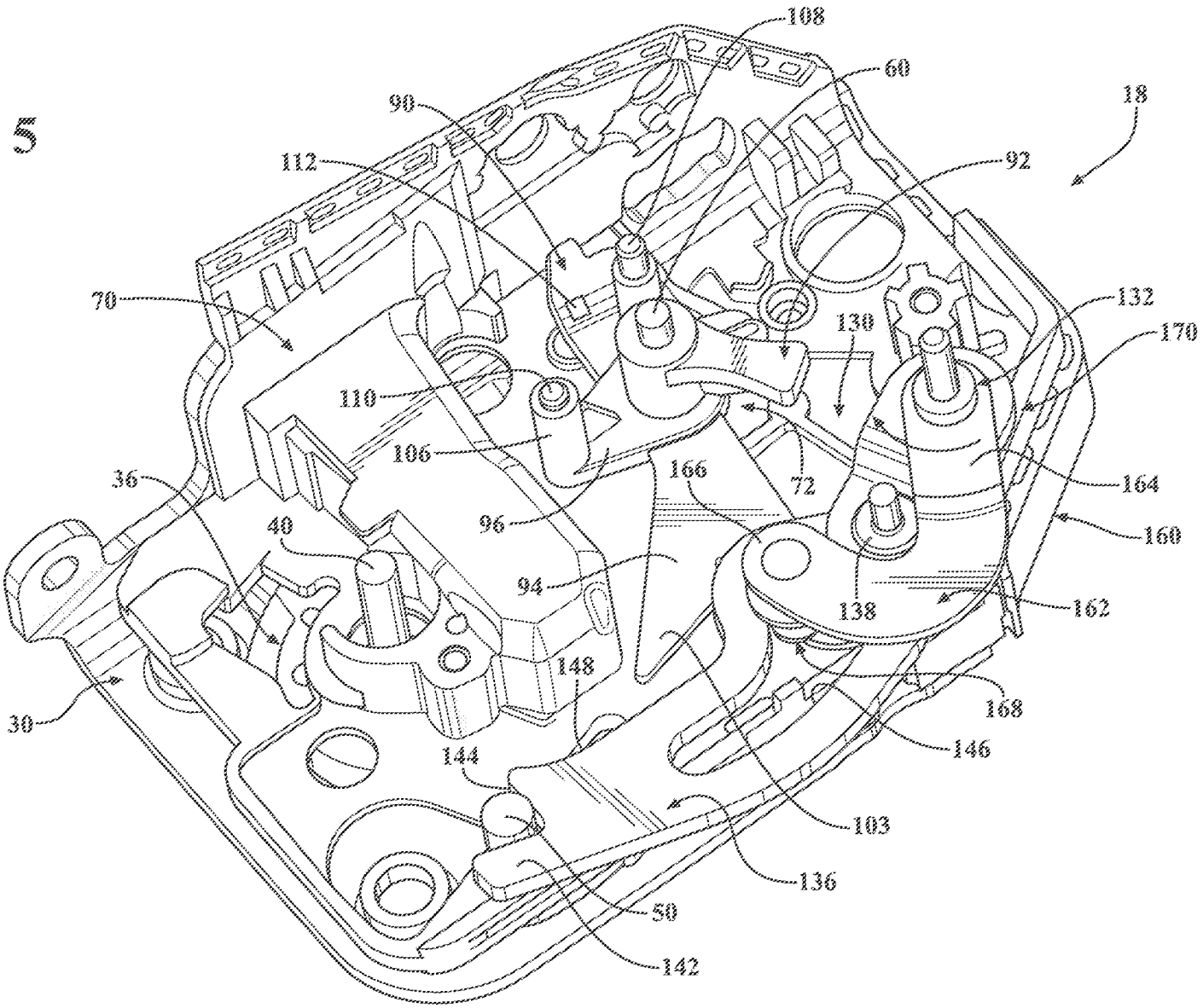
FIG. 5 is another isometric view of the one-motor power latch assembly showing various components of a cinch disengage mechanism operably associated with the latch cinch mechanism of FIG. 4.

Referring now to FIG. 5, power latch assembly 18 is shown to further include cinch disengage mechanism 160 that is operably associated with latch cinch mechanism 130 and has a J-shaped disengage lever 162. A first end segment 164 of disengage lever 162 is supported for pivotal movement on cinch pivot pin 132. A second end segment 166 of disengage lever 162 has a follower 168 that is located within and selectively engages edge portions of follower slot 146 in cinch link lever 136. A disengage lever biasing member, schematically identified by arrow 170, is configured to normally bias disengage lever 162 in a first (clockwise) rotary direction.

Figure 6:
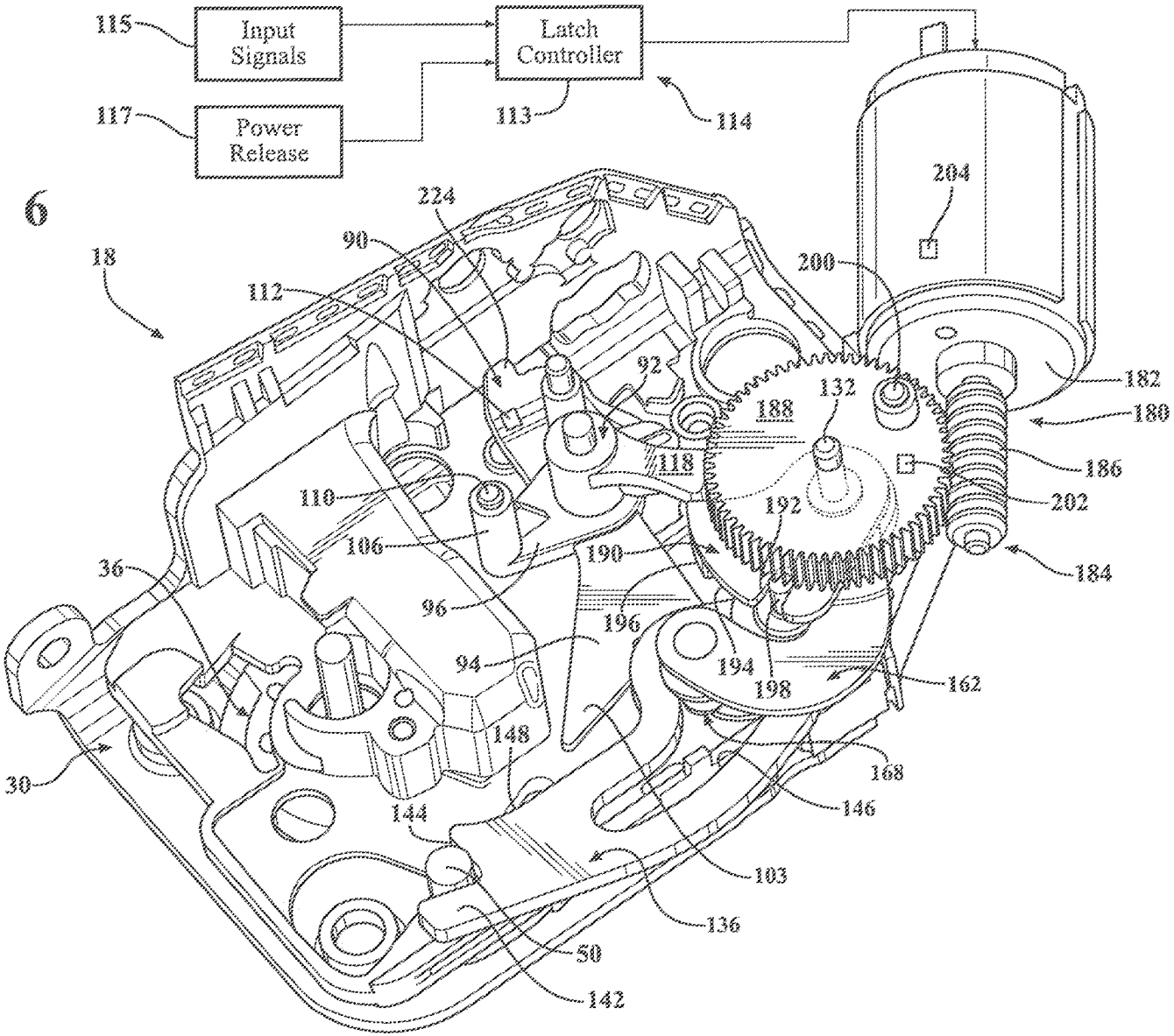
FIG. 6 is another isometric view of the one-motor power latch assembly showing various components of an actuator mechanism operably associated with the latch cinch mechanism of FIG. 4 and the latch release mechanism of FIG. 3.

Power latch assembly 18 is shown in FIG. 6 to further include actuator mechanism 180 having an electric motor 182 and a gearset 184. Gearset 184 is shown, in this non-limiting example, to include a worm 186 driven by a rotary output shaft of electric motor 182, and a worm gear 188 in constant meshed engagement with worm 186. Gear 188 is shown to be rotatably mounted on cinch pivot pin 132. A cam flange 190 is fixed to, or formed integrally with, gear 188 so as to rotate in common therewith. Cam flange 190 has an edge portion configured to define a radial drive slot 192, a recessed segment 194 and a cam segment 196. A drive post 198, extending outwardly from cinch lever pivot pin 138, is retained within drive slot 192 so as to coordinate movement of cinch lever 134 and cinch link lever 136 with rotation of gear 188. As will also be detailed, first drive arm segment 118 of release lever 92 is configured to be selectively retained within recessed segment 194 or engaged with cam segment 196 of cam flange 190 to coordinate pivotal movement of release lever 92 between its first and second actuated position with rotation of gear 188. Rotation of worm 186 in a first rotary direction caused by actuation of electric motor 182 will cause rotation of gear 188 in a first or "cinching" direction (counterclockwise in FIG. 6) while rotation of worm 186 in a second rotary direction causes rotation of gear 188 in a second or "releasing" direction (clockwise in FIG. 6). A position detecting device, such as a magnet 200, is mounted on worm gear 188 and functions in cooperation with a first cinch sensor 202 and a second cinch sensor 204 to provide controller 113 of latch control system 114 with signals indicative of the rotated position of gear 188. Generally speaking, latch control system 114 is adapted to receive sensor input signals from pawl position sensor 112 and cinch sensors 202, 204 (cumulatively identified as input signals 115) and control actuation of electric motor 182 in response thereto.

Figure 7:
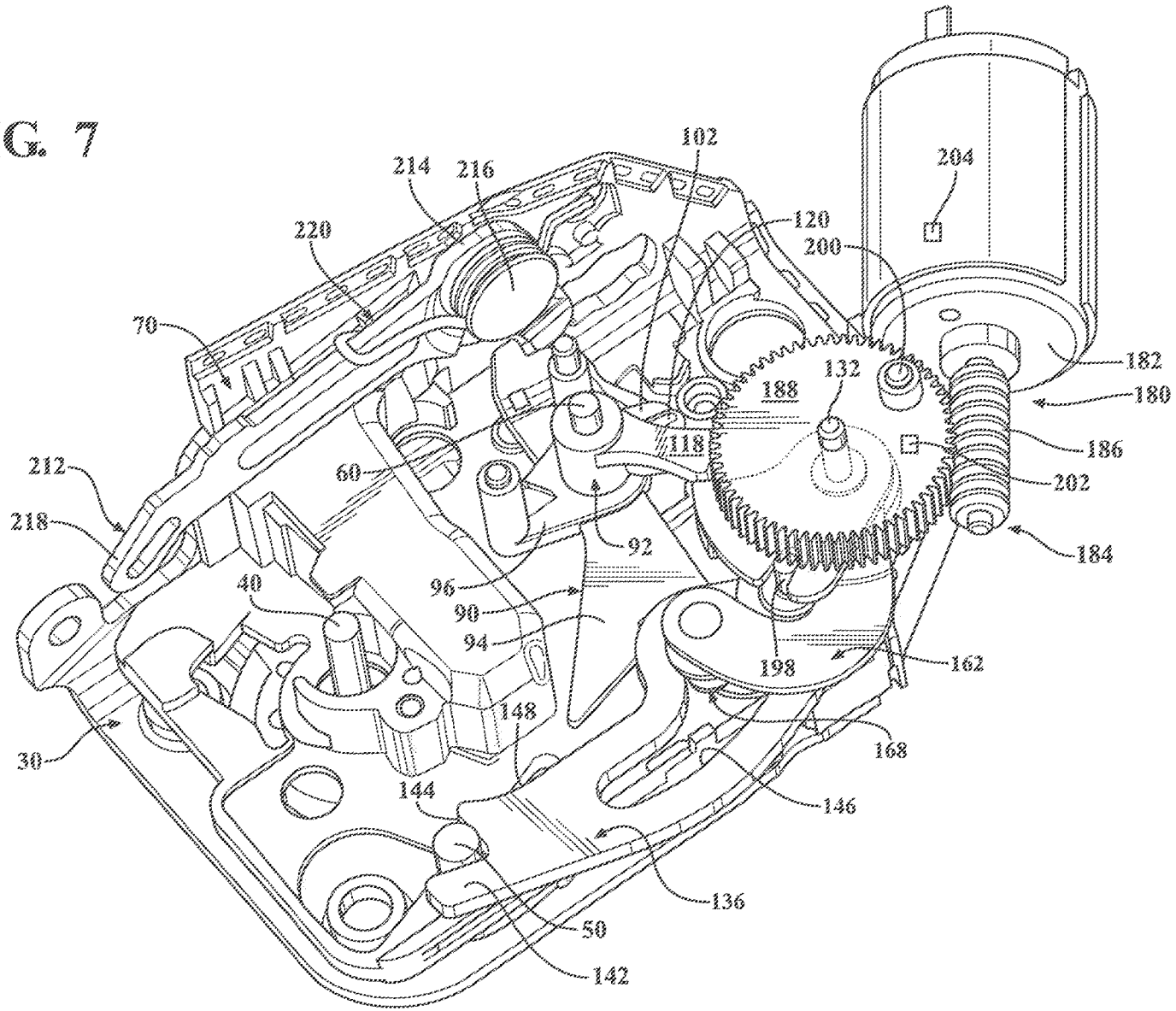
FIG. 7 is another isometric view of the one-motor power latch assembly showing various components of an inside release mechanism operably associated with the latch release mechanism of FIG. 3.

Referring primarily to FIG. 7, power latch assembly 18 is additionally equipped with inside release mechanism 210 to provide a mechanical back-up release system operable for moving pawl 38 from its ratchet checking position into its ratchet release position so as to allow ratchet 36 to rotate to its striker released position for permitting door 16 to be manually opened. Inside release mechanism 210 is shown to include an inside release lever 212 having a first end segment 214 pivotably attached to latch housing 70 via a pivot pin 216 and a second end segment 218 adapted to be mechanically interconnected to inside handle 24 via a suitable inside connection mechanism (not shown). An inside release lever biasing device, such as spring 220, acts between inside release lever 212 and housing 70 to normally bias inside release lever 212 in a first rotary direction (counterclockwise in FIG. 7) toward a non-actuated position (shown). With inside release lever 212 in its non-actuated position, a drive tab 222 on first end segment 214 is disengaged from an engagement lug 224 formed on first bent end segment 98 of plate segment 94 of pawl lever 90. Rotation of inside release lever 212 in a second rotary direction (clockwise in FIG. 7) toward an actuated position (not shown) causes drive tab 222 to engage engagement lug 224 and forcibly pivot pawl lever 90 in a counterclockwise direction from its first pawl lever position into its second pawl lever position which, in turn, causes pawl 38 to be forcibly pivoted from its ratchet checking position into its ratchet release position due to second bent end segment 100 of pawl lever 90 engaging leg segment 64 of pawl 38, and in opposition to the biasing of pawl spring 66.

Referring now to FIG. 8, power latch assembly 18 is shown to further include outside release mechanism 230 operable to provide a mechanical backup release system for moving pawl from its ratchet checking position into its ratchet release position so as to allow ratchet 36 to rotate from its striker capture positions into its striker release position for permitting door 16 to be manually released and opened. Outside release mechanism 230 is shown to include an outside backup lever 232 and an outside backup link 234. Lever 232 includes an intermediate boss segment 236 and first and second leg segments 238, 240 extending outwardly from boss segment 236. Boss segment 236 includes an aperture through which ratchet pivot pin 40 extends so as to support outside backup lever 232 for pivotal movement. First leg segment 238 of lever 232 is interconnected via a rod 242 (and possibly other linkage components) to outside door handle 22 while second leg segment 240 includes a pivot post 244. A first end segment 246 of outside backup link 234 is pivotably mounted on pivot post 244. A second end segment 248 of outside backup link 234 includes a lost motion slot 250 within which lug 108 on flange segment 96 of pawl lever 90 extends. When pawl 38 is located in its ratchet checking position, lug 108 engages a first end of lost motion slot 250 (as shown in FIG. 8). Actuation of lever 232 via outside door handle 22 causes lever 232 to rotate in a first (counterclockwise) direction such that link 234 causes pawl lever 90 to be forcibly pivoted in the counterclockwise direction which, in turn, causes pawl 38 to be forcibly pivoted from its ratchet checking position into its ratchet release position, again due to second bent segment 100 of pawl lever 90 engaging leg segment 64 of pawl 38. It will be understood that the biasing applied by pawl spring 66 on pawl 38 and pawl lever 90 also functions to bias outside back lever 232 and outside backup link 234 to be located in the non-actuated positions shown in FIG. 8.

Another feature of the present disclosure that will be evident from the drawings and this detailed description is that a power cinching operation is employed to rotate ratchet 36 from either of the "low energy" soft close striker capture position (FIGS. 10A, 10B and 13A) and the "high energy" hard close striker capture position (FIGS. 11A, 11B and 13B) into its fully closed/cinched striker capture position (FIGS. 12A, 12B and 13C). This power cinching operation is an advancement over conventional power cinching latch assemblies which only function to cinch the striker by rotating the ratchet from its initial striker capture position (equivalent to the soft close strike capture position herein) into its primary striker capture position (equivalent to the hard close striker capture position herein). Thus, power latch assembly 18 always functions to provide some perceptible amount of cinching, otherwise referred to as "perceived" cinch, that is recognizable to the vehicle operator. In this regard, FIG. 14A illustrates the angular travel of ratchet 36 required by the power cinching operation of power latch assembly 18 to rotate ratchet 36 from its low energy/soft close striker capture position (hard lines) to its fully closed/cinched striker capture position (phantom lines). This amount of ratchet rotation, referred to as "soft close cinch perception" is identified in FIG. 14A as angle "A." Similarly, FIG. 14B illustrates the angular travel of ratchet 36 required by the power cinching operation to rotate ratchet 36 from its high energy/hard close striker capture position (hard lines) to the fully closed/cinched strike capture position (phantom lines). This lesser amount of ratchet rotation or the "hard close cinch perception" is identified in FIG. 14B as angle "B." As noted in the Background section, conventional power cinching latch assemblies rely on the pawl to retain the ratchet in the primary striker capture position and must be configured to reset the cinching mechanism to a stand-by condition. In contrast, power latch assembly 18 of the present disclosure is configured to employ latch cinch mechanism 130 to mechanically retain ratchet 36 in its fully closed/cinched striker capture position while pawl 38 is displaced from engagement with ratchet 36.

FIGS. 9A and 9B provide elevational views of various components of power latch assembly 18 oriented to establish the released mode when door 16 is located in its open position. Specifically, ratchet 36 is shown located in its striker release position due to the normal biasing of ratchet biasing member 54. With ratchet 36 located in its striker release position, pawl 38 is biased toward its ratchet checking position by pawl spring 66 such that pawl engagement surface 62 is in engagement with first cam edge surface 53 of ratchet 36. In the striker release position of ratchet 36, it is also shown that ratchet rivet 50 on arm segment 52 of ratchet 36 is in close proximity to or engages cam surface 148 on cinch link lever 136. The coordinated biasing of ratchet biasing member 54, cinch link lever biasing member 152, and disengage lever biasing member 170 act to assist in maintaining engagement of ratchet rivet 50 with cam surface 148. Also, follower 168 of disengage lever 162 is shown positioned within a dwell segment 147 of contoured follower slot 146 in cinch link lever 136.

FIGS. 10A and 10B, FIG. 13A and FIG. 14A illustrate various components of power latch assembly 18 positioned to establish the first safety latched mode when door 16 located in its first closed position. This mode is established when door 16 has been closed with a low energy closing force such that striker 20 engages an edge surface within guide channel 42 and forcibly rotates ratchet 36 from its striker release position into its first/soft close striker capture position. In this ratchet position, pawl 38 is biased into its ratchet checking position such that its engagement surface 62 engages first safety latch surface 46 of ratchet 36, thereby preventing striker 20 from being released from capture pocket 44. In addition, such initial rotation of ratchet 36 caused by engagement with striker 20 causes ratchet rivet 50 on ratchet 36 to move into engagement with engagement shoulder 144 of cinch link lever 136. As will be detailed, actuation of the power cinching feature can now be initiated to cause further rotation of ratchet 36 in its latching direction for moving ratchet 36 from its first/soft close striker capture position through its second/hard close striker capture position and finally into its third/cinched striker capture position for moving door 16 from its first closed position into its third closed position. This power cinching function is operable to compress weather seal 28 from a first or soft compression state (associated with door 16 located in its first closed position) into a third or cinched compression state (associated with door 16 located in its third closed position) upon powered cinching of door 16 from its first closed position into its third closed position. FIG. 13A illustrates the positioning of striker 20, ratchet 36 and pawl 38 for establishing the first safety latched mode of power latch assembly 18 when door 16 is located in its first closed position for applying a first or low compression force on weather seal 28. Likewise, FIG. 14A illustrates the relative movement of the latch components from the first safety latched mode (hard lines) to the cinch latched mode (phantom lines) to illustrate the angular movement of ratchet 36 through the angle "A" associated with this power cinching operation.

Referring now to FIGS. 11A and 11B, FIG. 13B and FIG. 14B, the components of power latch assembly 18 are shown positioned to establish the second safety latched mode with door 16 located in its second closed position. This mode is established when door 16 has been closed with a high energy closing force such that striker 20 forcibly rotates ratchet 36 from its striker release position into its second/hard close striker capture position. In this ratchet position, pawl 38 is biased into its ratchet checking position such that its engagement surface 62 engages second safety latch surface 48 of ratchet 36 after riding along first and second cam edge surfaces 53 and 55 of ratchet 36 due to the forced rotation of ratchet 36. Obviously, such rotation of ratchet 36 again results in ratchet rivet 50 moving into engagement with engagement shoulder 144 on cinch link lever 136. As will be detailed, the power cinching function can now be initiated to cause latch cinch mechanism 130 to rotate ratchet 36 from its second/hard close striker capture position into its third/cinched striker capture position to move door 16 from its second closed position into its third closed position. This power cinching function is operable to compress weather seal 28 from a second or hard compression state (associated with door 16 in its second closed position) into its cinched compression state upon power cinching of door 16 from its second closed position into its third fully closed position. FIG. 13B illustrates the positioning of striker 20, ratchet 36 and pawl 38 for establishing the second safety latched mode of latch assembly 18 when door 16 is located in its second closed position and as it applies a second or high compression force on weather seal 28. Likewise, FIG. 14B illustrates the relative movement of the components from the second safety latched mode (hard lines) to the cinch latched mode (phantom lines) to illustrate the angular travel of ratchet 36 through angle "B" associated with this power cinching operation.

FIGS. 12A and 12B and FIG. 13C provide various views of the components of power latch assembly 18 oriented to establish the cinch latched mode with door 16 located in its third, fully closed position. Specifically, ratchet 36 is located and held in its third/cinched striker capture position while pawl 36 is located in its ratchet checking position. As best seen in FIGS. 12B and 13C, rotation of ratchet 36 to its third/cinched striker capture position (via the power cinching operation) acts to disengage ratchet 36 from mechanical engagement with pawl 38. As noted, rotation of ratchet 36 from either of its first/soft close striker capture position (FIG. 13A) or its second/hard close striker capture position (FIG. 13B) into its third/cinched striker capture position (FIG. 13C) is accomplished solely via the power cinching function of latch assembly 18. Thus, the first safety latched mode shown in FIG. 13A provides a first mechanical latching in the event that power is lost and no power cinching function is available with door 16 located in its first closed position. In such case, door 16 can be mechanically opened via inside latch release mechanism 210 or outside latch release mechanism 230 and subsequently re-closed with higher energy to place door 16 in its second closed position.

In accordance with the present disclosure, when the power cinching feature of power latch assembly 18 is available, the soft closed position established by low energy closure of door 16 is not intended to define a first mechanically latched position, but rather establishes a first door closure position from which the power cinching operation can be initiated. Similarly, the hard closed position of FIG. 13B established by high energy (i.e., slamming) closure of door 16 is not intended to define a second mechanically latched position, but rather establishes a second door closure position from which the power cinching operation can also be initiated. FIG. 13C illustrates the relationship of pawl 38 and ratchet 36 upon conclusion of the power cinching operation. As will be detailed, components other than pawl 38, such as latch cinch mechanism 130, are used to retain ratchet 36 in its third/cinched striker capture position of FIG. 13C. However, retention of pawl 38 in its ratchet checking position when ratchet 36 is located in its cinched striker capture position provides a mechanical failsafe or the "blocking safety latching" mode since rotation of ratchet 36 in its releasing direction from its third/cinched striker capture position toward its second/hard striker capture position, in response to a vehicle collision for example, will result in mechanical (i.e., "blocking" engagement of ratchet 36 with pawl 38, thereby preventing door 16 from being unintentionally opened.

Referring now to FIGS. 15 through 17, each provides a coordinated series of sequential views for illustrating the relative movement of components of power latch assembly 18 associated with the power cinching function for moving door 16 from its first closed position to its third fully closed position. In particular, FIGS. 15A-15K are isometric views while FIGS. 16A-16K and FIGS. 17A-17K are corresponding top and bottom elevational views of the components of power latch assembly 18. The following description is intended to provide sufficient details, when considered in conjunction with these figures, to clearly disclose the interaction of components and movement thereof associated with power latch assembly 18 to provide the power cinching function.

Starting initially with FIGS. 15A, 16A and 17A, the components of power latch assembly 18 are shown to establish the released mode when door 16 is opened such that ratchet 36 is biased into its striker release position and pawl 38 is held in its ratchet release position via engagement of pawl engagement surface 62 with ratchet edge surface 53. It should also be noted that ratchet rivet 50 can be maintained in engagement with cam surface 148 on cinch link lever 136 and gear 188 is located in a "cinch start" position with magnet 200 offset from first cinch sensor 202. With pawl 38 located in its ratchet release position, release lever 92 is maintained in its centered non-actuated position such that lug segment 102 on pivot pawl 90 is disengaged from second drive arm segment 120 of release lever 92.

FIGS. 15B-15D, FIGS. 16B-16D, and FIGS. 17B-17D illustrate initial mechanical rotation of ratchet 36 due to engagement with striker 20 as door 16 moves from its open position into it first closed position (FIGS. 15D, 16D, 17D) whereat engagement surface 62 of pawl 38 disengages first cam edge surface 53 and engages first safety latch surface 46 of ratchet 36 such that pawl 38 is subsequently biased into its ratchet checking position. Ratchet 36 is shown located in its first/soft close striker capture position such that ratchet rivet 50 has also moved off of cam surface 148 and is now positioned against and retained by engagement shoulder 144 of cinch link lever 136. Cinch link lever spring 152 assists in maintaining rivet 50 within engagement shoulder 144. Movement of pawl 38 into its ratchet checking position causes concurrent clockwise rotation of pawl lever 90 such that its lug segment 120 is again engaging second drive leg segment 120 of release lever 92. Movement of pawl 38 into its ratchet checking position also causes magnet 110 on pawl lever 90 to overlie and cooperate with pawl sensor 112 for providing an input signal to latch controller unit 113 associated with latch control system 114 that is indicative of the pawl's position and to initiate the power cinching function. Specifically, latch controller unit 113 energizes electric motor 182 and causes gear 188 to be driven in the first direction (counterclockwise) from its cinch start position. This action initiates a Cinch mode.

FIGS. 15E, 16E and 17E illustrate that this initial actuation of electric motor 182 causes gear 188 to be rotatably driven in the first rotary direction, as indicated by arrow 270, from its cinch start gear position (shown in FIG. 15D). In response to such gear rotation, cinch link lever 136 is caused to rotate clockwise such that it forcibly rotates ratchet 36 which, in turn, causes engagement surface 62 of pawl 38 to slide against second cam edge surface 55 on ratchet 36. Specifically, since drive post 198 is retained within drive slot 192 of cam flange 190, such rotation of gear 188 in the first direction from its cinch start position causes concurrent pivotal movement of cinch lever 134 about cinch pivot pin 132 which, in turn, causes pivotal and sliding movement of cinch link lever 136. Such movement of cinch link lever 136 causes engagement shoulder 144 to drivingly engage ratchet rivet 50 and forcibly rotate ratchet 36 from its first/soft close striker capture position toward its second/hard close striker capture position. As also seen in FIGS. 15F, 16F and 17F, first drive arm segment 118 of release lever 92 rides within recessed segment 194 of cam flange 190 so as to maintain release lever 92 in its centered position. As noted, arrow 270 indicates the rotation of gear 188 during the power cinching function.

FIGS. 15G, 16G and 17G illustrate continued rotation of gear 188 in its latching direction due to continued energization if electric motor 182 until ratchet 36 has been forcibly rotated into and then past its second/hard close striker capture position (See FIGS. 15H, 16H and 17H). These illustrations further show the continued rotation of cinch lever 134 about cinch pivot 132 due to the interaction between drive post 198 and drive slot 192 on cam flange 190. Release lever 92 is maintained in its centered non-actuated position with first drive arm segment 118 continuing to travel within recessed segment 194 of cam flange 190. As noted, contact between engagement shoulder 144 on cinch link lever 136 and ratchet rivet 50 causes the continued rotation of ratchet 36 from its first striker capture position (FIG. 17D) into its second striker capture position (See FIG. 11C) and then past its second striker capture position (FIG. 17H) due to the movement of cinch link lever 136 resulting from rotation of gear 188.

FIGS. 15I, 16I and 17I, as well as FIGS. 15J, 16J and 17J, illustrate continued rotation of gear 188 in its cinching direction as ratchet 36 is forcibly rotated past its second/hard close striker capture position and toward its third/cinched striker capture position. This continued rotation of gear 188 has now caused first drive arm segment 118 of release lever 92 to engage cam segment 196 of cam flange 190. Such engagement causes release lever 92 to be forcibly rotated in a clockwise direction (FIGS. 15I, 16I) from its central non-actuated position toward its first actuated position. Additionally, the pivotal and translational movement of cinch link lever 136 causes engagement shoulder 144 to continue to engage ratchet rivet 50 and cause the continued rotation of ratchet 36 while pawl 38 is maintained by pawl biasing member 66 in its ratchet checking position. In the ratchet position shown, pawl engagement surface 62 is disengaged from ratchet 36.

FIGS. 15K, 16K and 17K illustrate ratchet 36 completely rotated to its third/cinched striker capture position as gear 188 reaches its "cinch stop" position. As such, magnet 200 works in conjunction with second cinch sensor 204 to signal latch controller unit 113 of latch control system 114 that gear 188 has reached its cinch stop position. Latch controller unit 113 then deenergizes motor 182 and the power cinching function is completed and the Cinch mode has been established. Ratchet 36 is mechanically retained in its third/cinched striker capture position by latch cinch mechanism 130 due to engagement shoulder 144 of cinch link lever 136 engaging ratchet pin 50. Additionally, a comparison of FIGS. 17H through 17K best illustrates cinch link lever 136 moving to an "over-center" position relative to cinch pivot post 132 and cinch lever 134. In addition, release lever 92 is permitted returned to its central non-actuated position as first drive arm segment 118 moves past and disengages cam segment 196 of cam flange 190.

As also noted, in the event of a collision, directional forces are applied to striker 20 (in a door opening direction), as indicated by arrow 280 and to ratchet 36 as indicated by arrow 282 in FIG. 15L. The line of force, indicated by arrow 282, acting through ratchet rivet 50 is oriented to forcibly rotate gear 188 in the cinching direction, as indicated by arrow 284, which in turn causes continued rotation of cinch lever 134. The resulting action between the linked components, particularly in view of the over-center relationship between cinch link lever 136 and cinch pivot 132 (See FIG. 17L), will eventually result in rotation of ratchet 36 in its releasing direction until its second safety latch surface 48 engages engagement surface 62 of pawl 38, thereby preventing unintentional opening of door 16. Thus, power latch assembly 18 provides a mechanical safety latched or "blocking" mode.

Referring now to FIGS. 18-20, a coordinated series of sequential views are shown from multiple orientations to illustrate the relative movement of various components of power latch assembly 18 associated with the power release function and which is configured to provide an "uncinching" or "soft open" feature. In general, this soft open feature is operable to slowly and progressively release the compression forces applied to weather seal 28 prior to releasing striker 20 from latched engagement with ratchet 36 so as to eliminate or significantly reduce the audible "pop" noise associated with conventional power latch release systems. As provided in the drawings, FIGS. 18A-18G illustrate a series of sequential isometric view provided to clearly show the interaction of the various components of power latch assembly 18 for facilitating movement of ratchet 36 from its cinched striker capture position into its striker release position in response to power latch assembly 18 being shifted from its cinched latched mode (door 16 located in its third closed position) into its latch released mode (door 16 in its open position). FIGS. 19A-19G and FIGS. 20A-20G are top and bottom elevational views corresponding to FIGS. 18A-18G so as to better illustrate movement of the components during the power release operation.

Figure 20A:
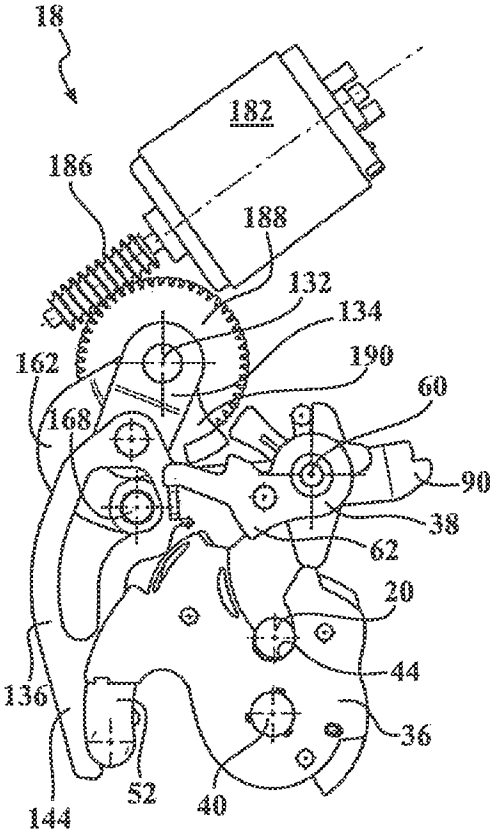
Figure 19A:
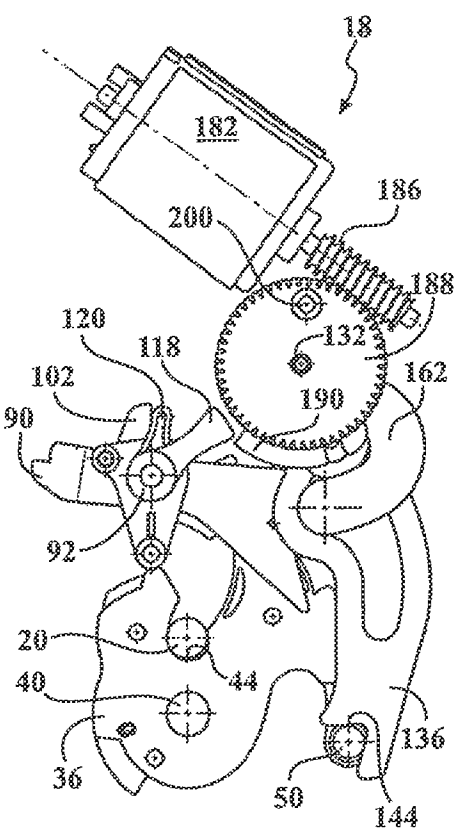
Figure 18A:
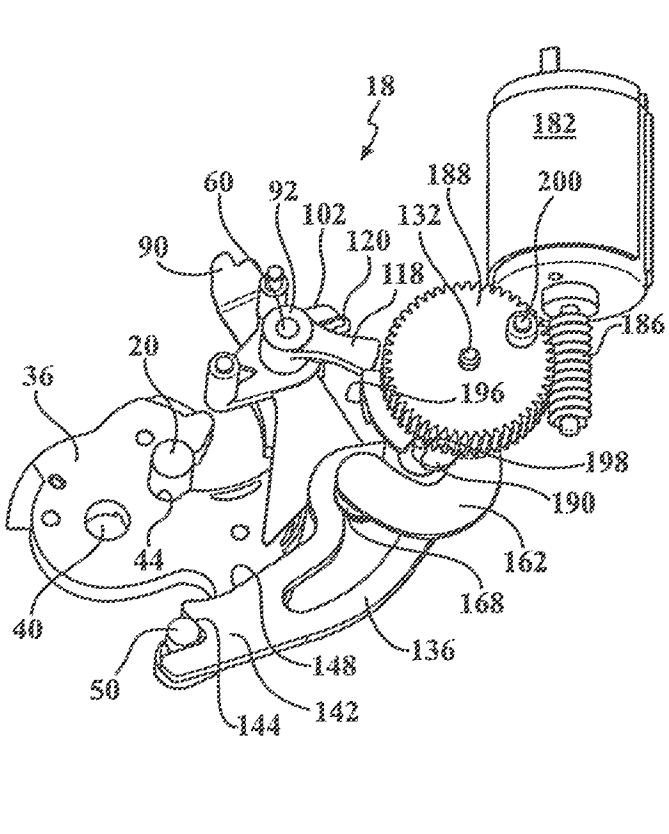
Figure 20B:
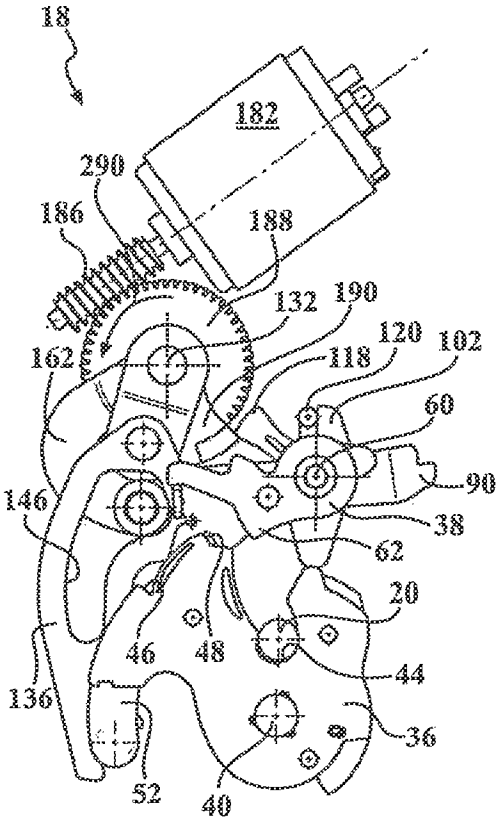
Figure 19B:
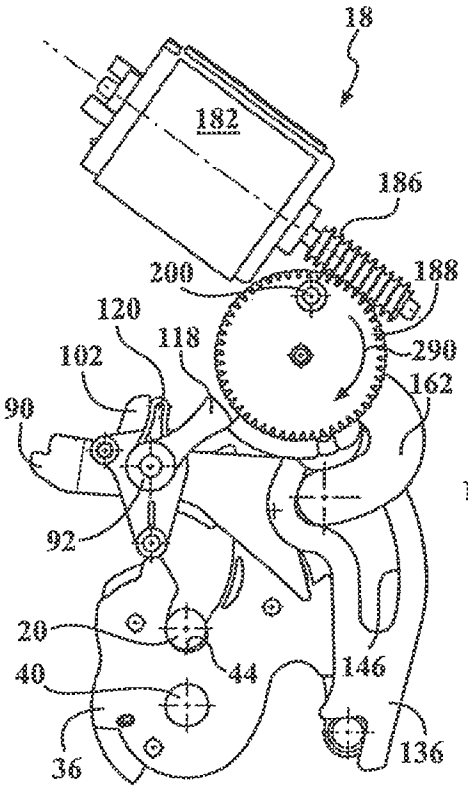
Figure 18B:
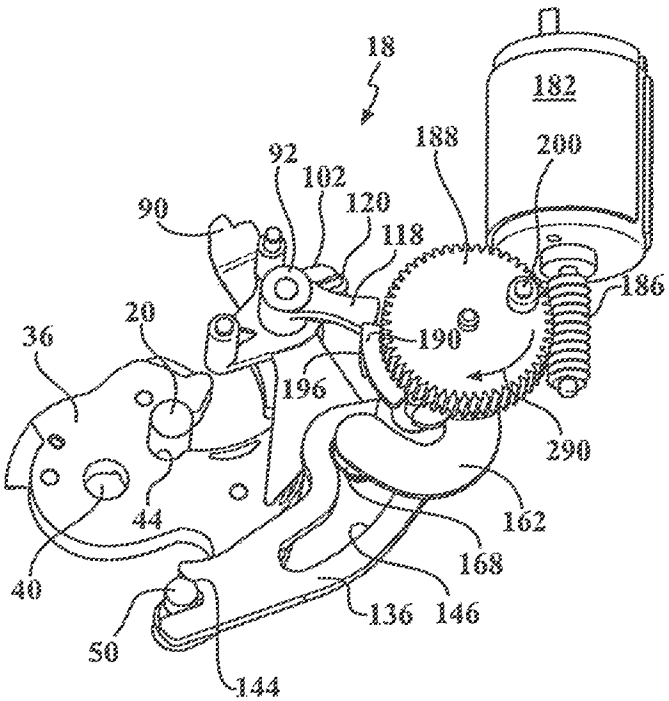
Figure 20C:
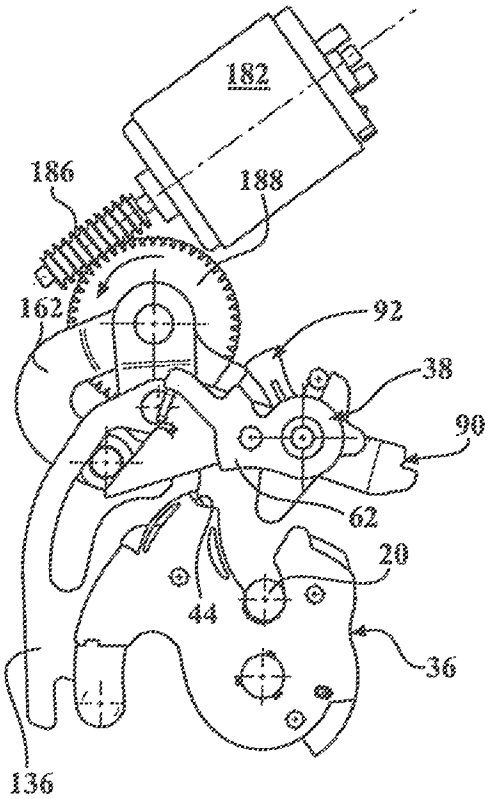
Figure 19C:
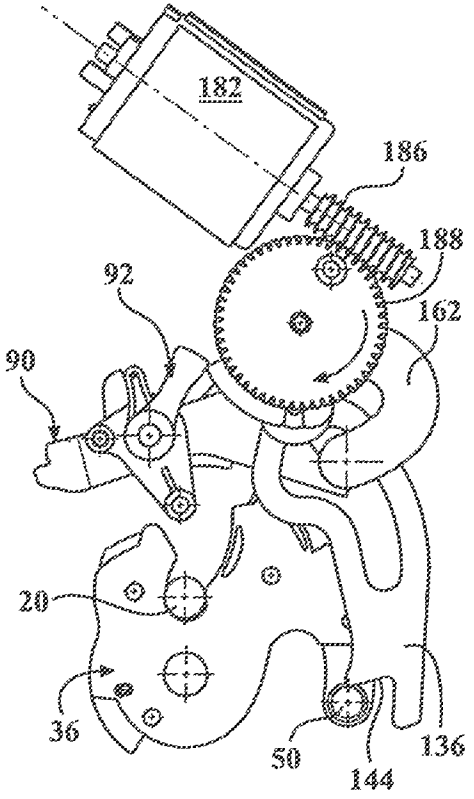
Figure 18C:
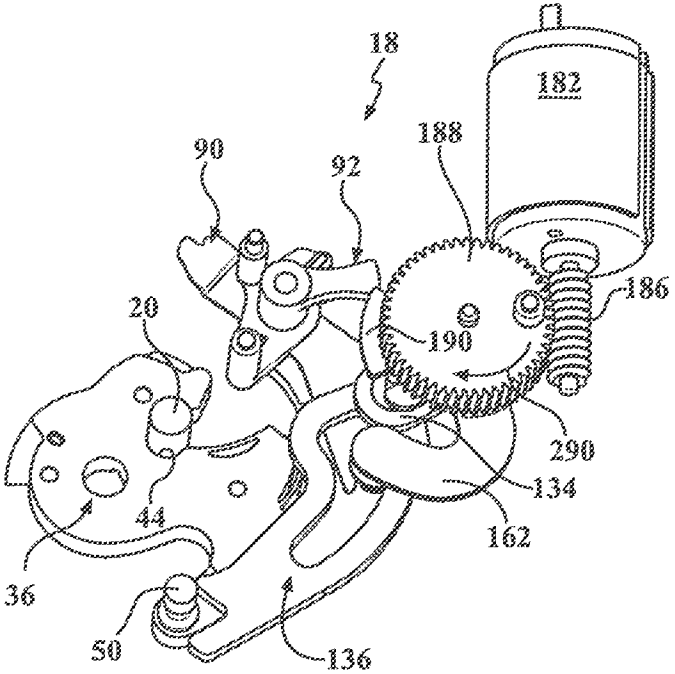

Starting with FIGS. 18A, 19A and 20A, the components of power latch assembly 18 are shown prior to actuation of a power release switch 117 (FIG. 6) with gear 188 located in its cinch stop position, ratchet 36 held in its cinched striker capture position by cinch link lever 136, and pawl 38 held in its ratchet checking position. Power release switch 117 can be, in accordance with non-limiting examples, associated with outside door handle 22 or a remote fob possessed by the vehicle operator. Upon actuation of power release switch 117, motor 182 is energized to rotate gear 188 in its second or releasing rotary direction, as indicated by arrow 290. This action initiates the "Uncinch/Release" mode. Initial rotation of gear 188 in the second direction causes cam segment 196 on drive flange 190 to engage first drive arm segment 118 of release lever 92 and begin rotating release lever 92 in a counterclockwise direction away from its central non-actuated position toward its second actuated position. Such rotation of release lever 92 causes its second drive arm segment 120 to engage lug segment 102 and forcibly pivot pawl lever 90 from its first pawl lever position toward its second pawl lever position which, in turn, forcibly pivots pawl 38 from its ratchet checking position toward its ratchet release position. FIGS. 18B, 19B and 20B illustrate the orientation of the components upon initial rotation of gear 188 in its releasing direction while FIGS. 18C, 19C and 20C illustrate the same components following continued rotation of gear 188 until pawl 38 is located in its ratchet release position. In addition, such pivotal movement of pawl lever 90 to its second pawl lever position results in its cam segment 103 engaging follower 168 and pivoting disengage lever 162 about cinch pivot pin 132 until follower 168 is in engagement with an edge portion of slot 142 in cinch link lever 136. This engagement, in combination with pivotal movement of cinch lever 134 about cinch pivot 132 in response to rotation of gear 188, begins to move engagement shoulder 144 on cinch link lever 136 out of engagement with ratchet rivet 50 and permits a limited amount of "uncinching" rotation of ratchet 36 out of its cinched striker capture position into a "cinch released" striker capture position, thereby establishing a "cinch released" mode for power latch assembly 18. This limited amount of uncinching rotation of ratchet 36, prior to complete release of ratchet rivet 50 from engagement shoulder 144, provides the soft opening feature and functions to partially unload weather seal 28.

Figure 20D:
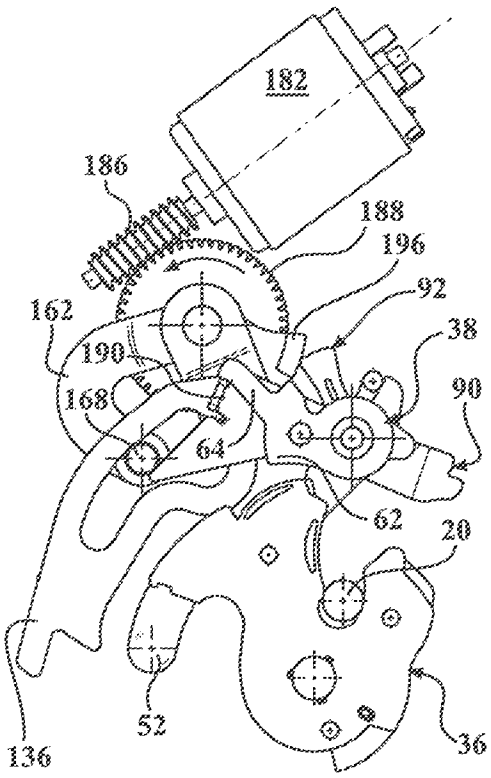
Figure 19D:
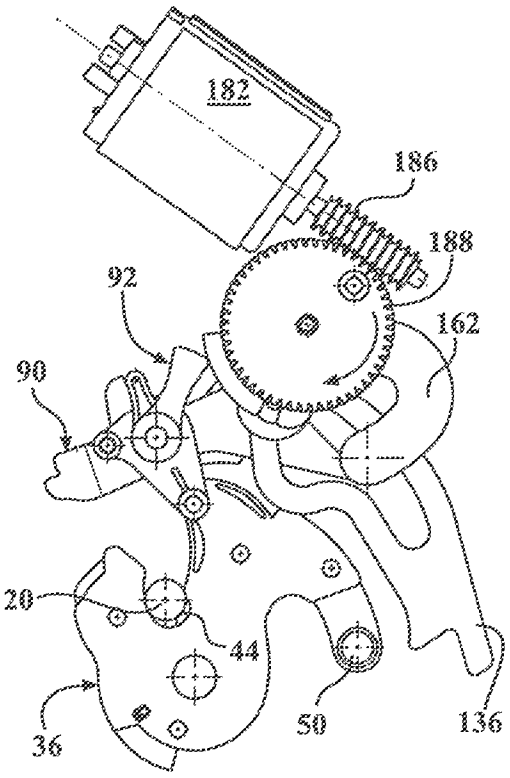
Figure 18D:
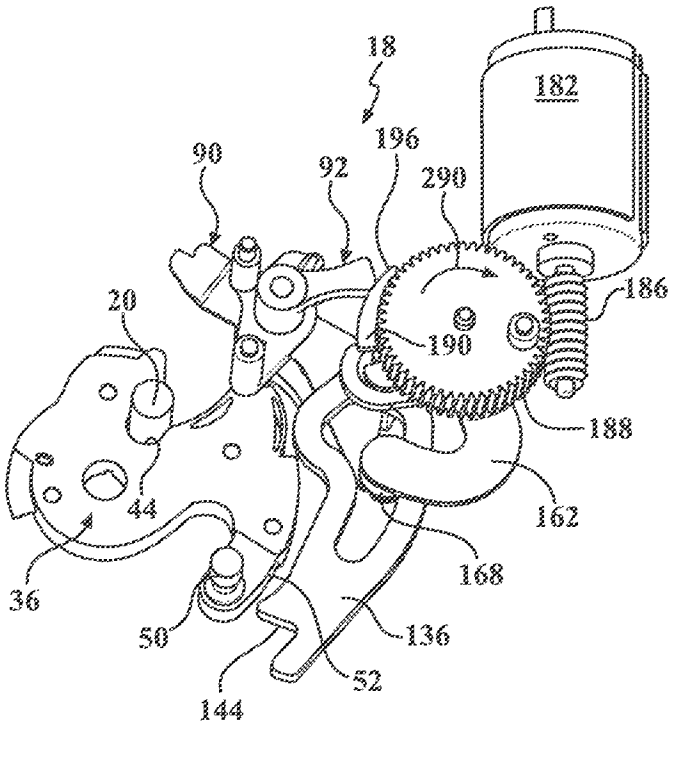
Figure 20E:
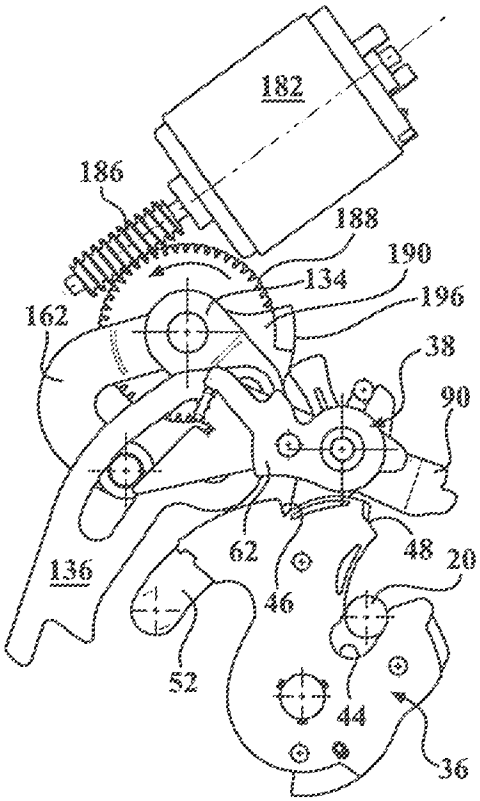
Figure 19E:
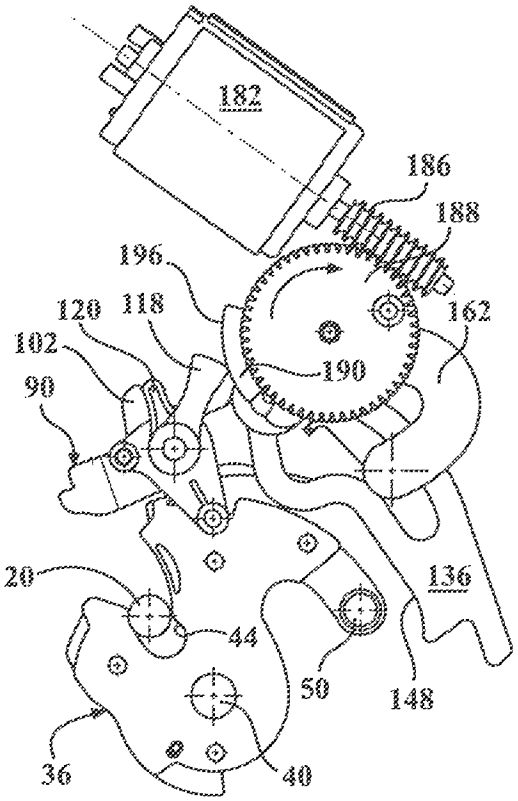
Figure 18E:
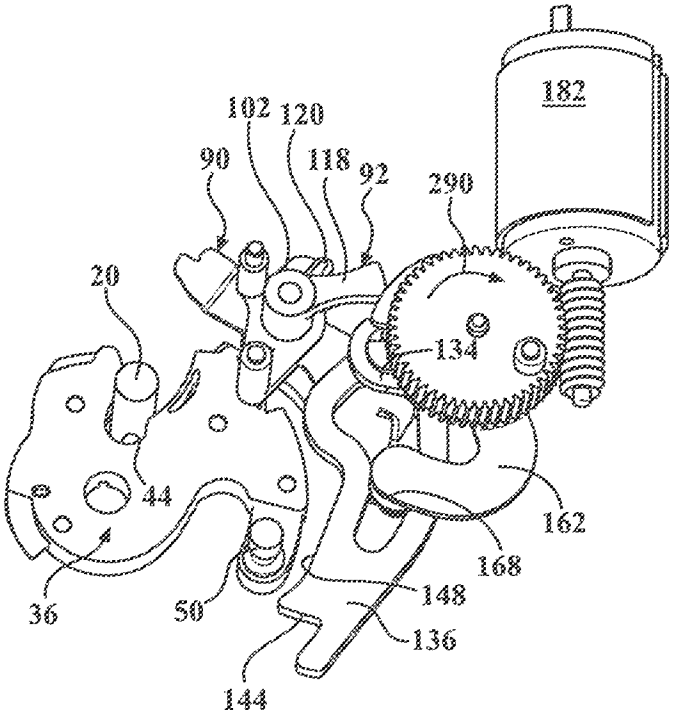
Figure 20F:
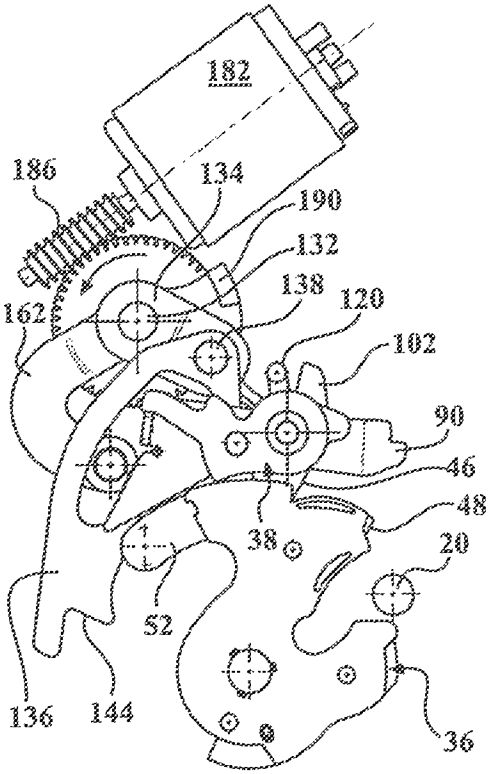
Figure 19F:
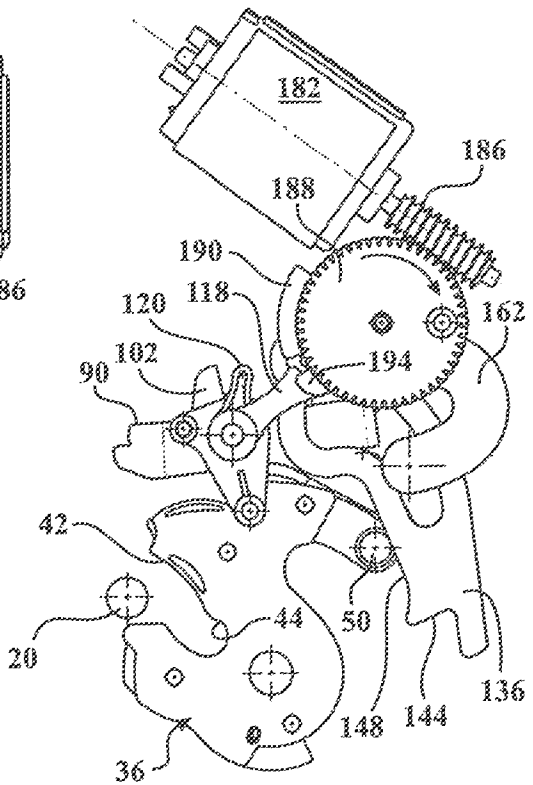
Figure 18F:
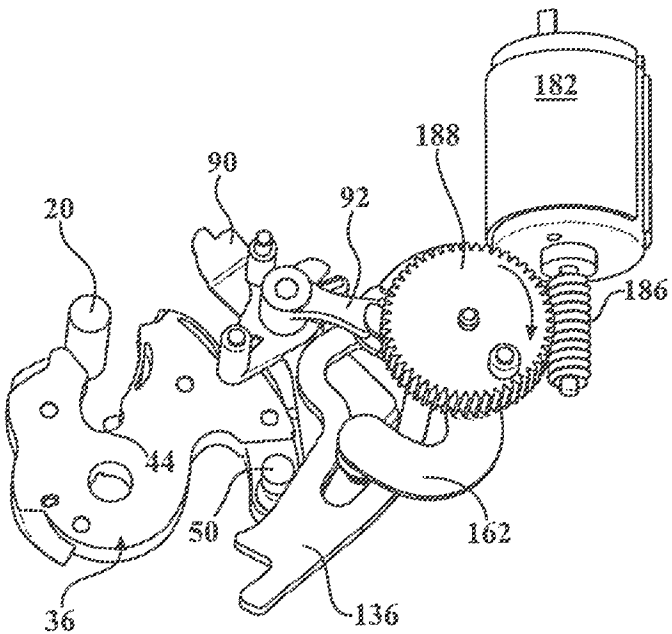
Figure 20G:
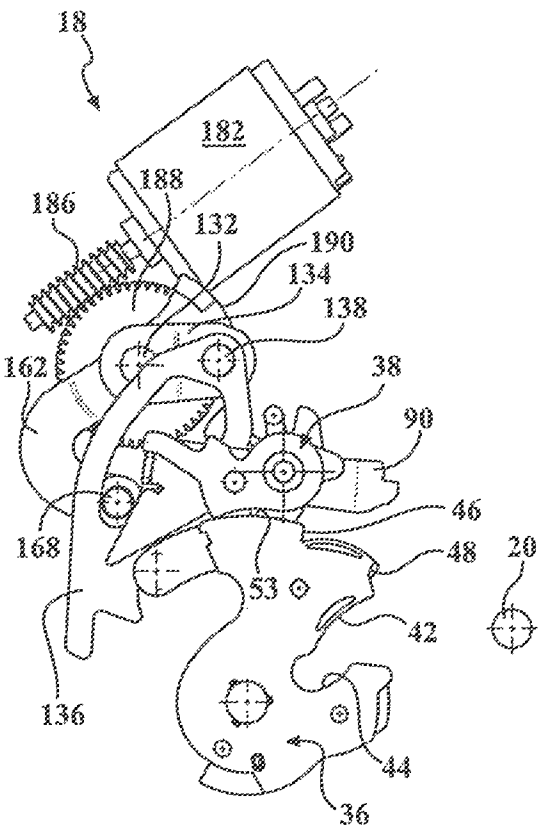
Figure 19G:
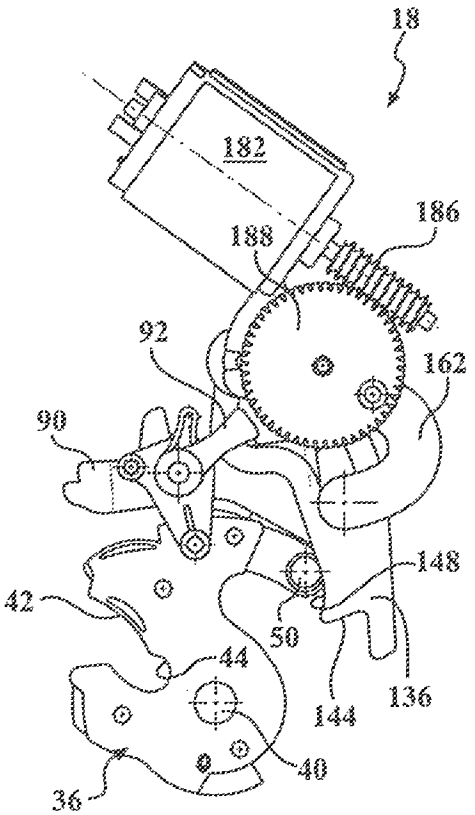
Figure 18G:
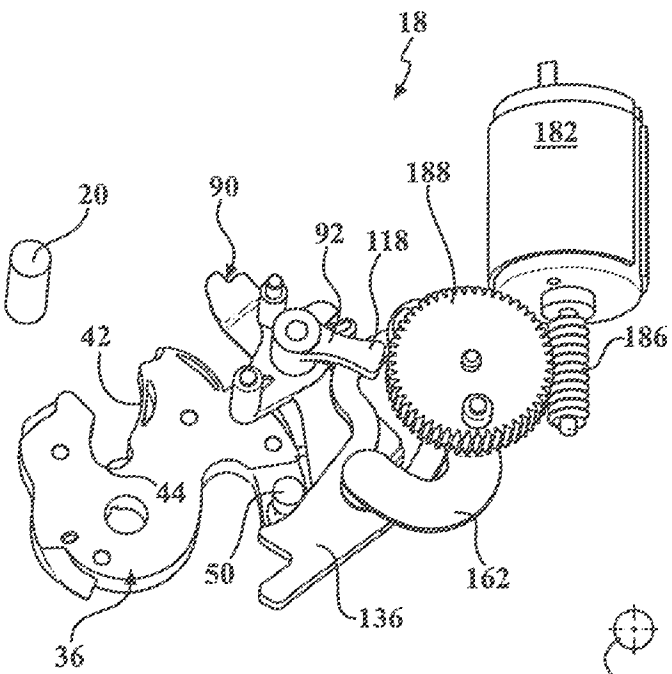

FIGS. 18D, 19D and 20D, illustrate that the continued rotation of gear 188 causes first drive arm segment 118 to continue to engage cam segment 196 and rotate release lever 92 such that second drive arm segment 120 forcibly engages lug 102 on pawl lever 90 for pivoting and holding pawl 38 (via engagement of bent end segment 100 of pawl lever 90 and pawl leg 64) in its ratchet release position while ratchet rivet 50 is shown released from engagement with engagement shoulder 144 on cinch link 136. In this position, ratchet 36 is located in a "ratchet released" position. As such, ratchet 36 is thereafter permitted to rotate from its ratchet released position into its striker release position due to ratchet biasing mechanism 54. Rotation of gear 188 is stopped upon it reaching its cinch start position shown in FIGS. 18G, 19G and 20G. As also shown in these views, drive arm segment 118 of release lever 92 has disengaged cam segment 196 and is permitted to return to its central non-actuated position. Also note that pawl 38 has been biased toward its ratchet checking position such that its engagement surface 62 is shown engaging edge surface 53 of ratchet 36.

Figure 21A:
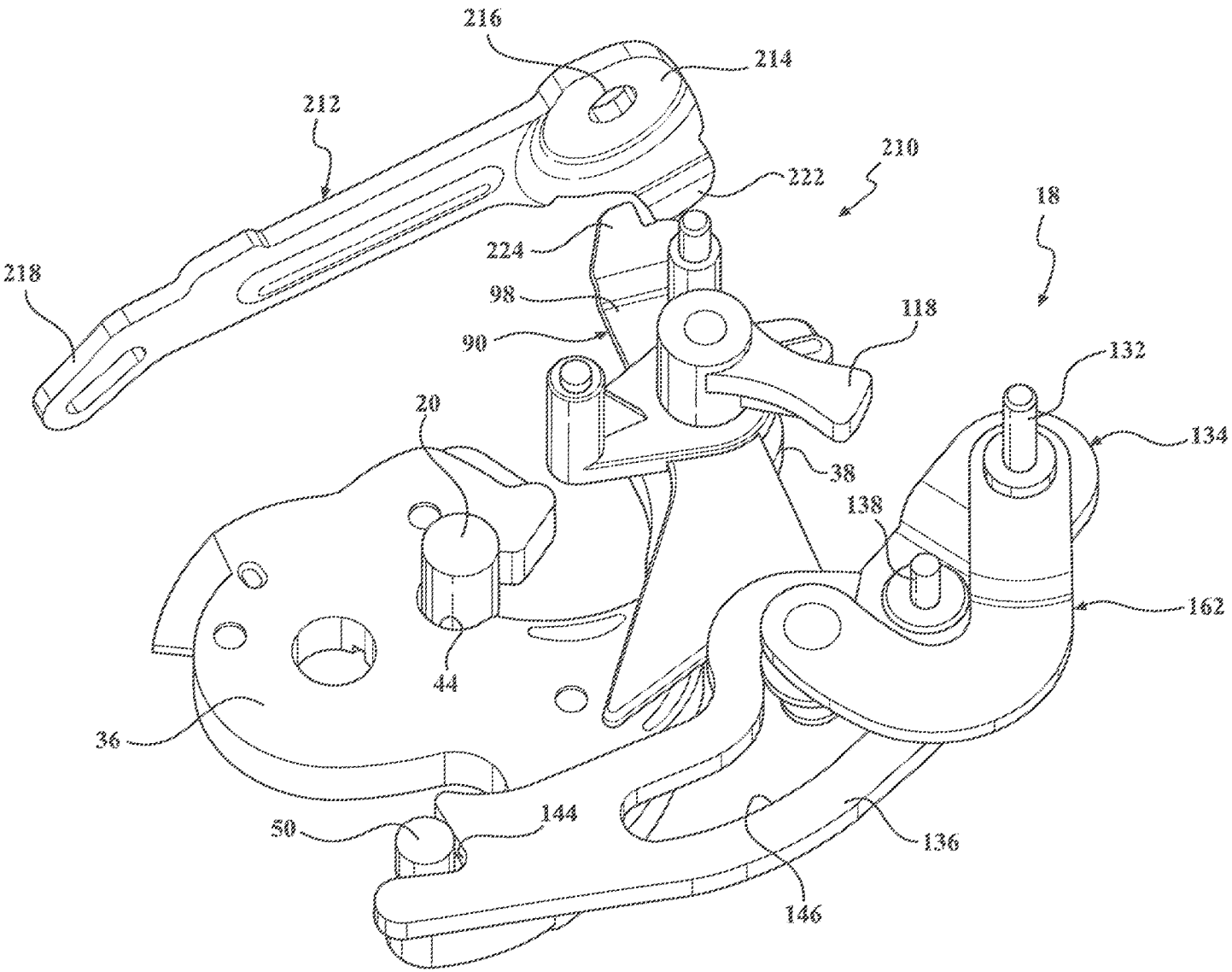
Figure 21B:
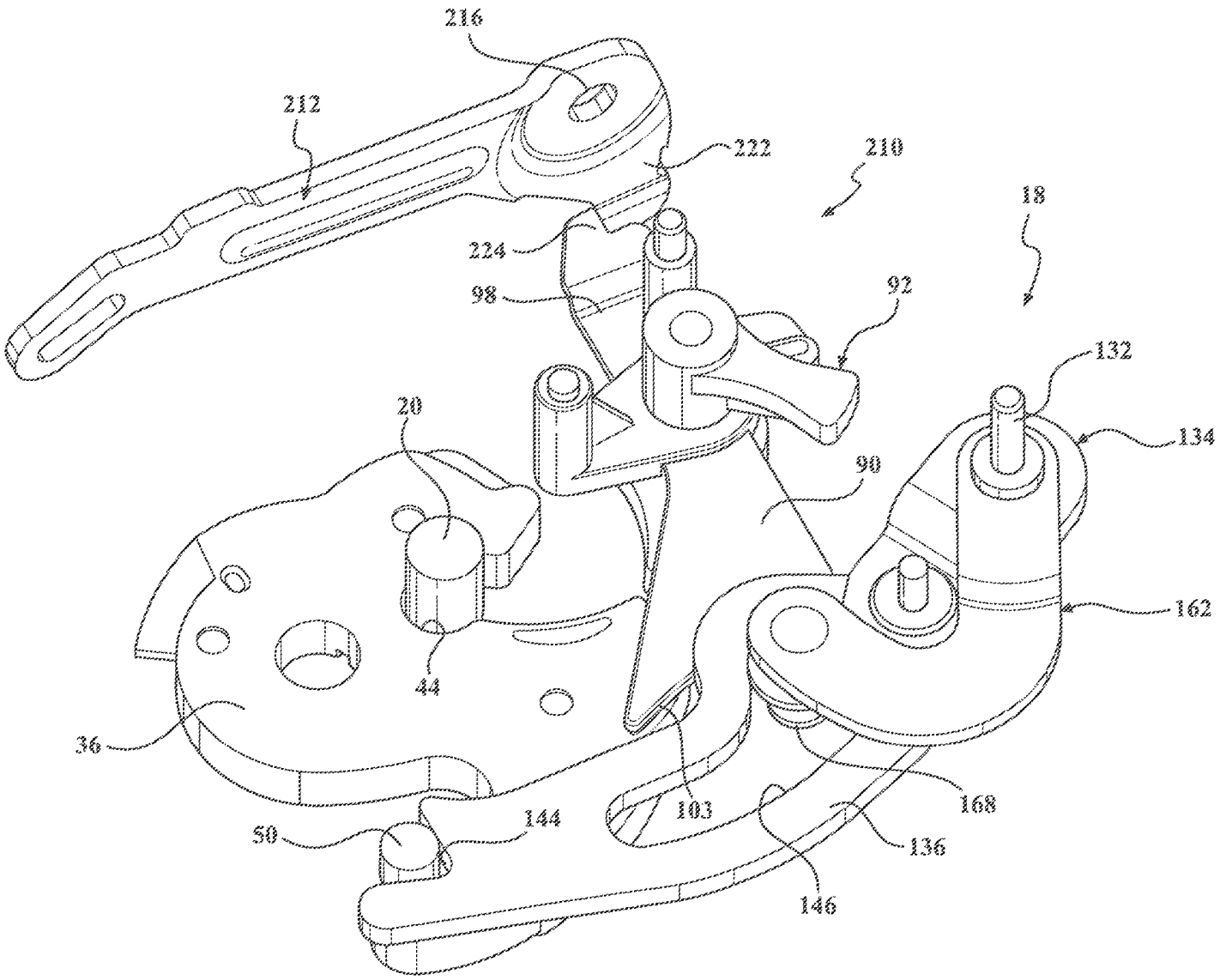
Figure 21C:
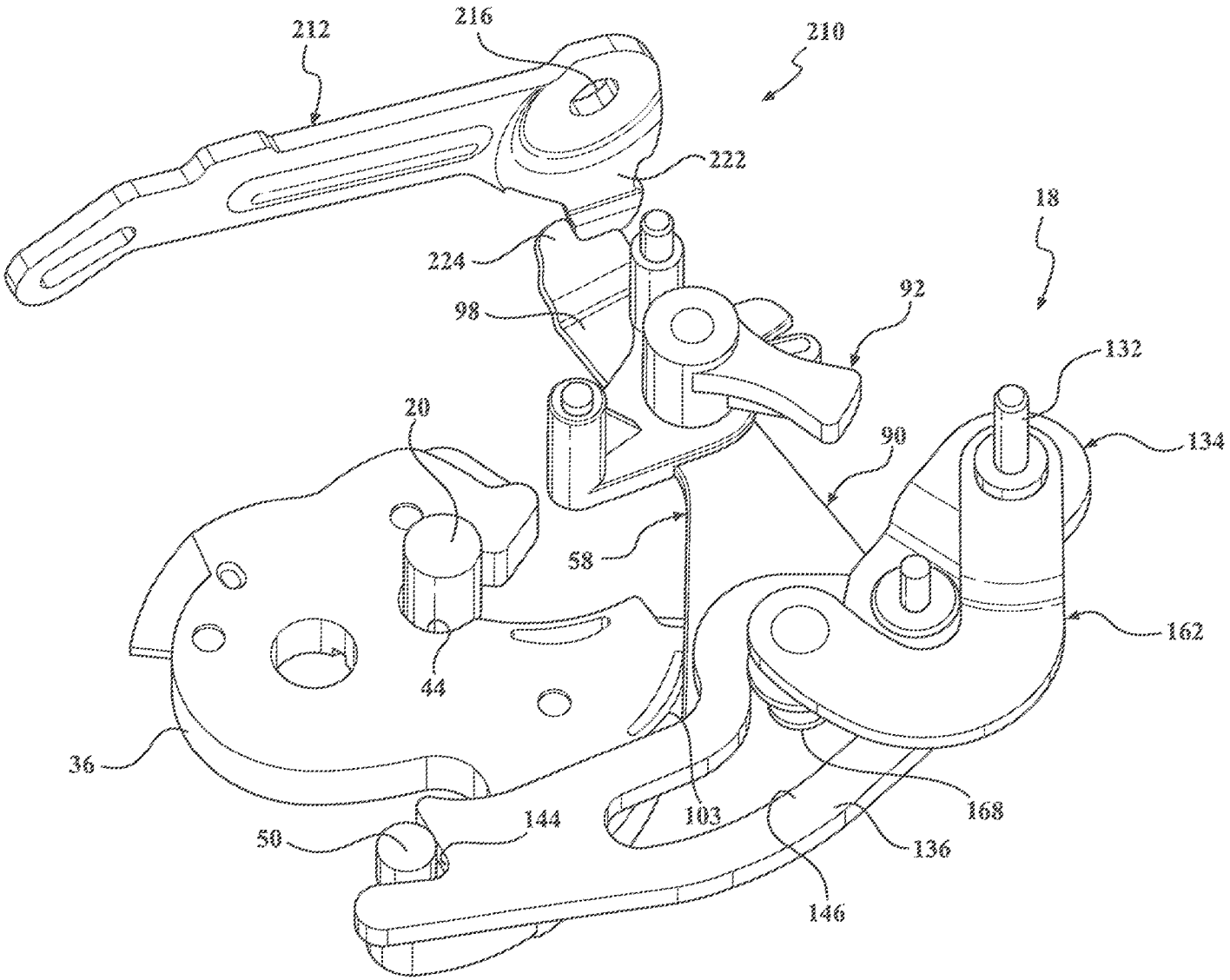
Figure 21D:
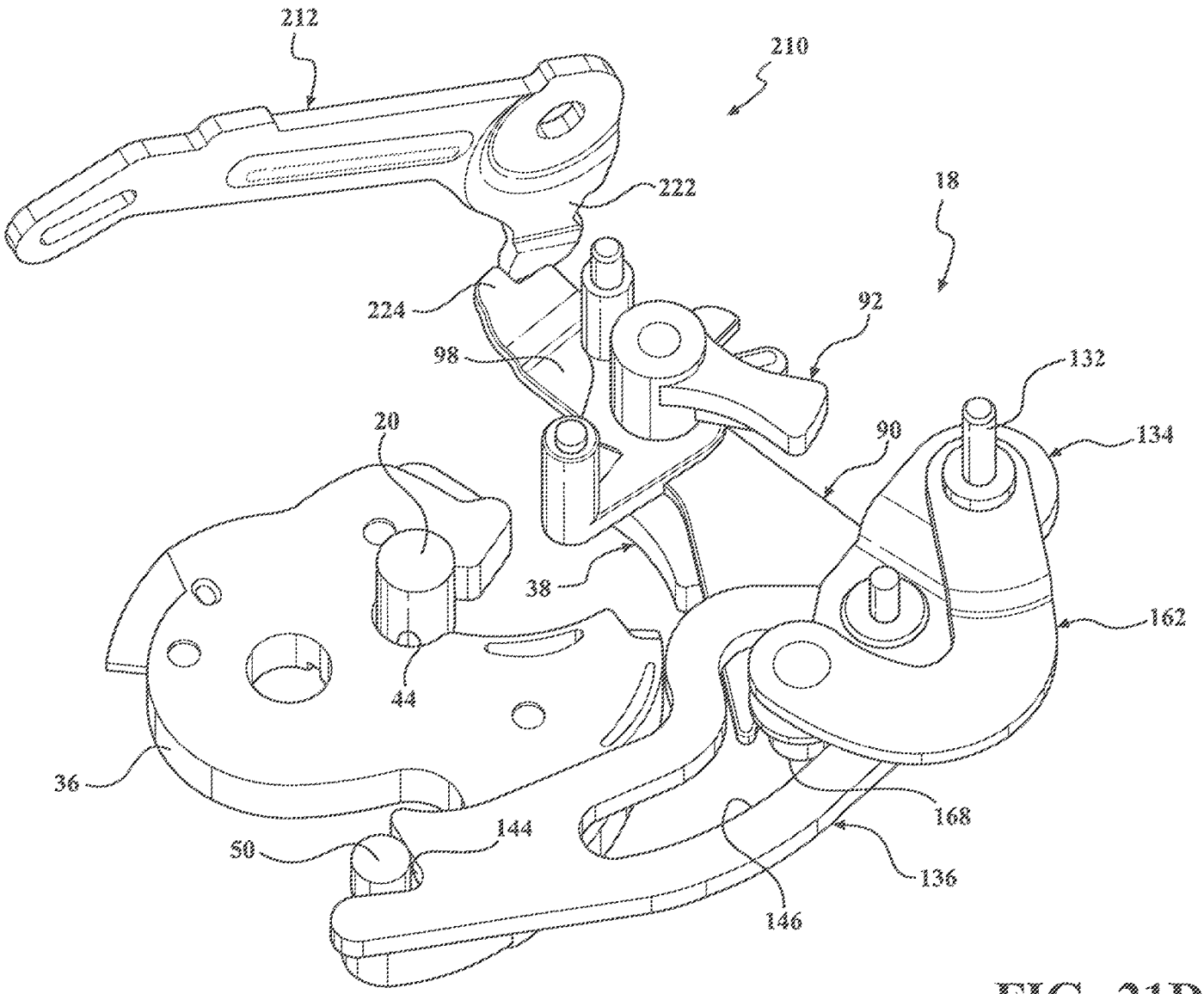
Figure 21E:
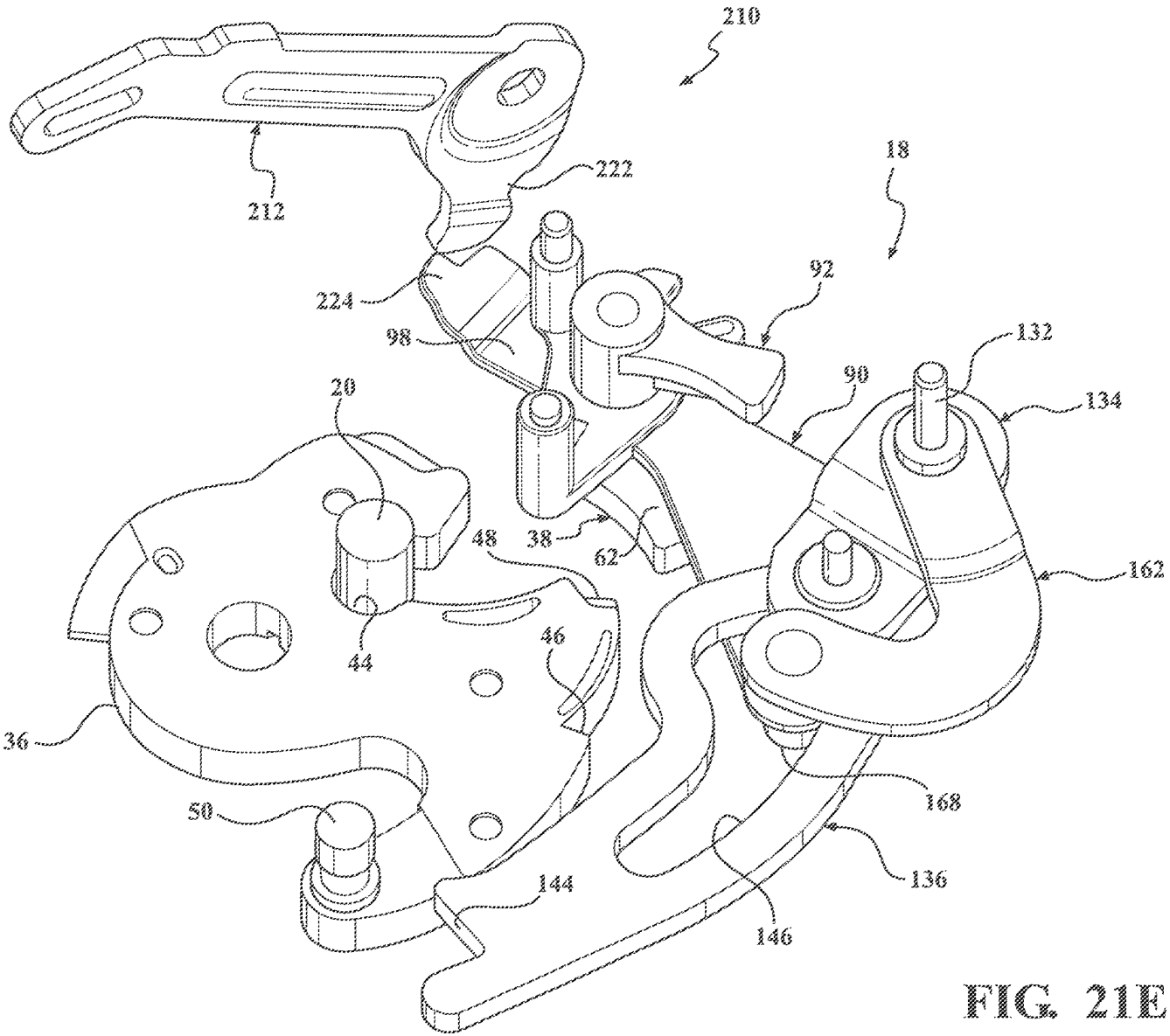

FIGS. 21A-21E illustrate a sequence of isometric views showing actuation of inside release mechanism 210 via pivotal movement of inside backup lever 212 from its non-actuated position (FIG. 21A) into its actuated position (FIG. 21E) which, in turn, causes pivotal movement of pawl lever 90 from its first pawl lever position (FIG. 21A) into its second pawl lever position (FIG. 21E). As previously noted, such movement of pawl lever 90 causes concurrent movement of pawl 38 from its ratchet checking position into its ratchet release position due to engagement of second bent end segment 100 with pawl leg 64. FIGS. 21D and 21E illustrate that such movement of pawl lever 90 also causes sliding and pivotal movement of cinch link lever 136 due to tapered cam segment 103 of pawl lever 90 acting on follower 168 of disengage lever 162. Specifically, follower 168 engages edges surface of slot 146 which forcibly moves cinch link lever 136. This movement of cinch link lever 136, in turn, results in the release of ratchet rivet 50 from engagement with shoulder 144 of cinch link lever 136 so as to subsequently permit rotation of ratchet 36 from its ratchet released position into its striker released position.

Figure 22A:
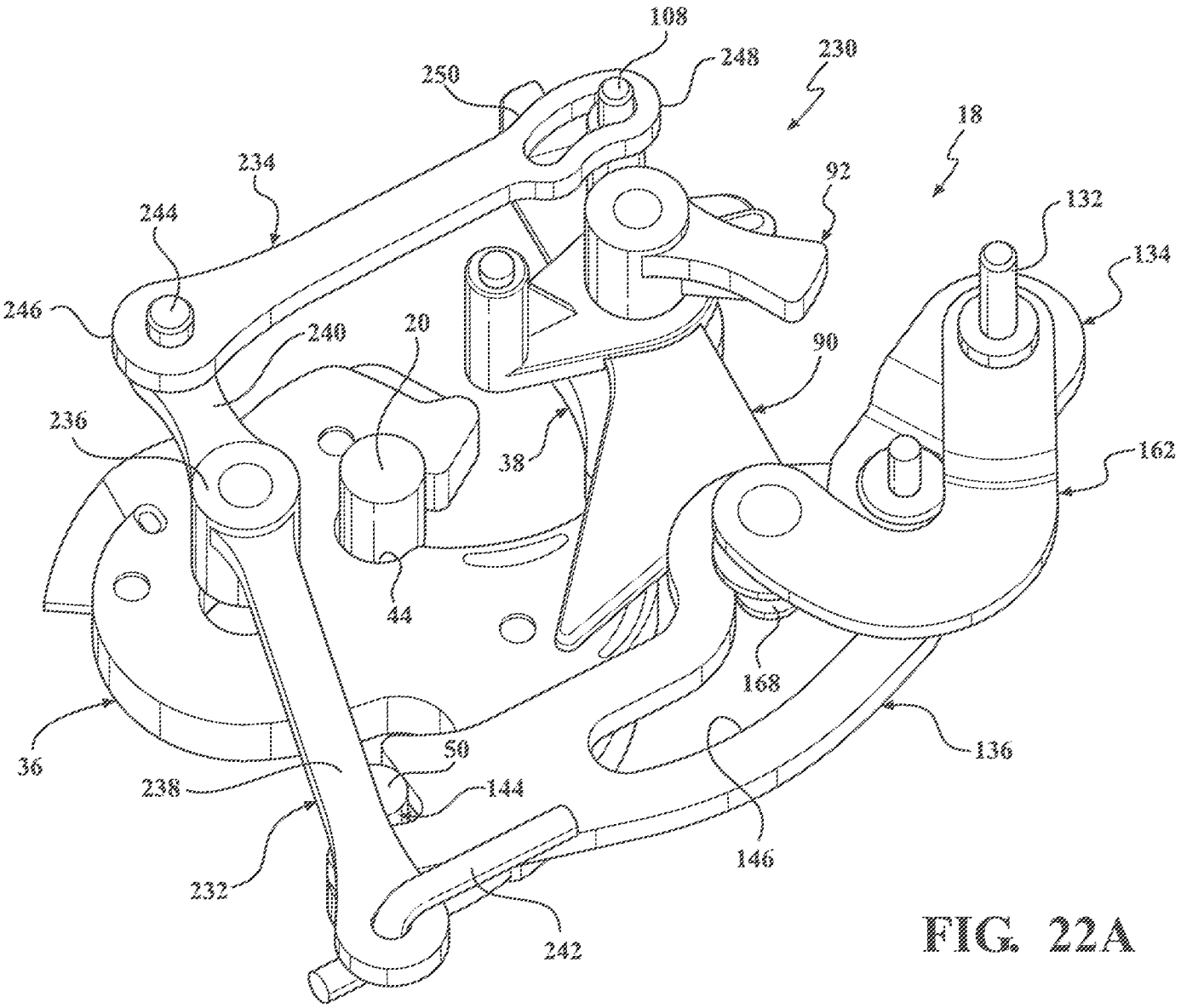
Figure 22B:
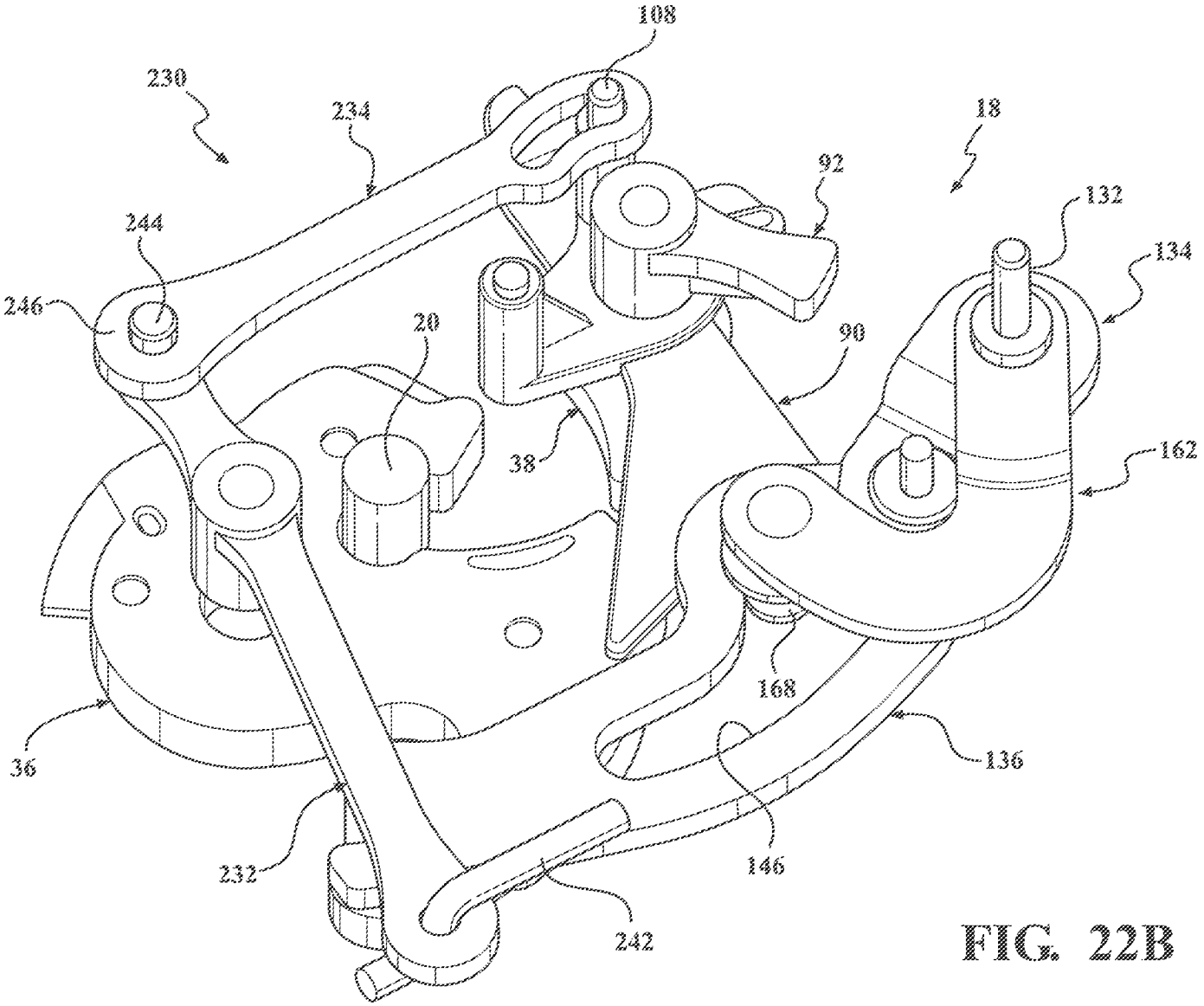
Figure 22C:
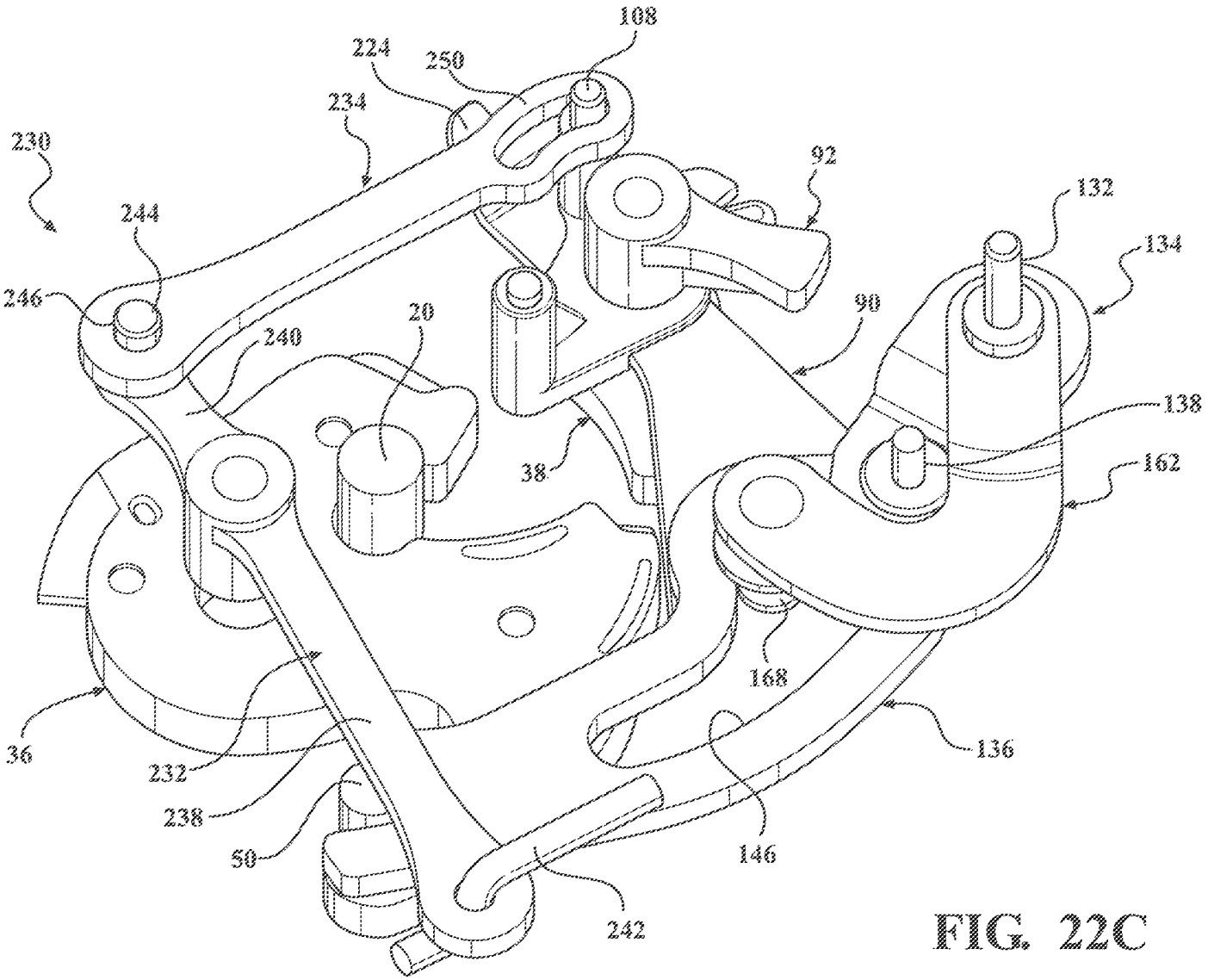
Figure 22D:
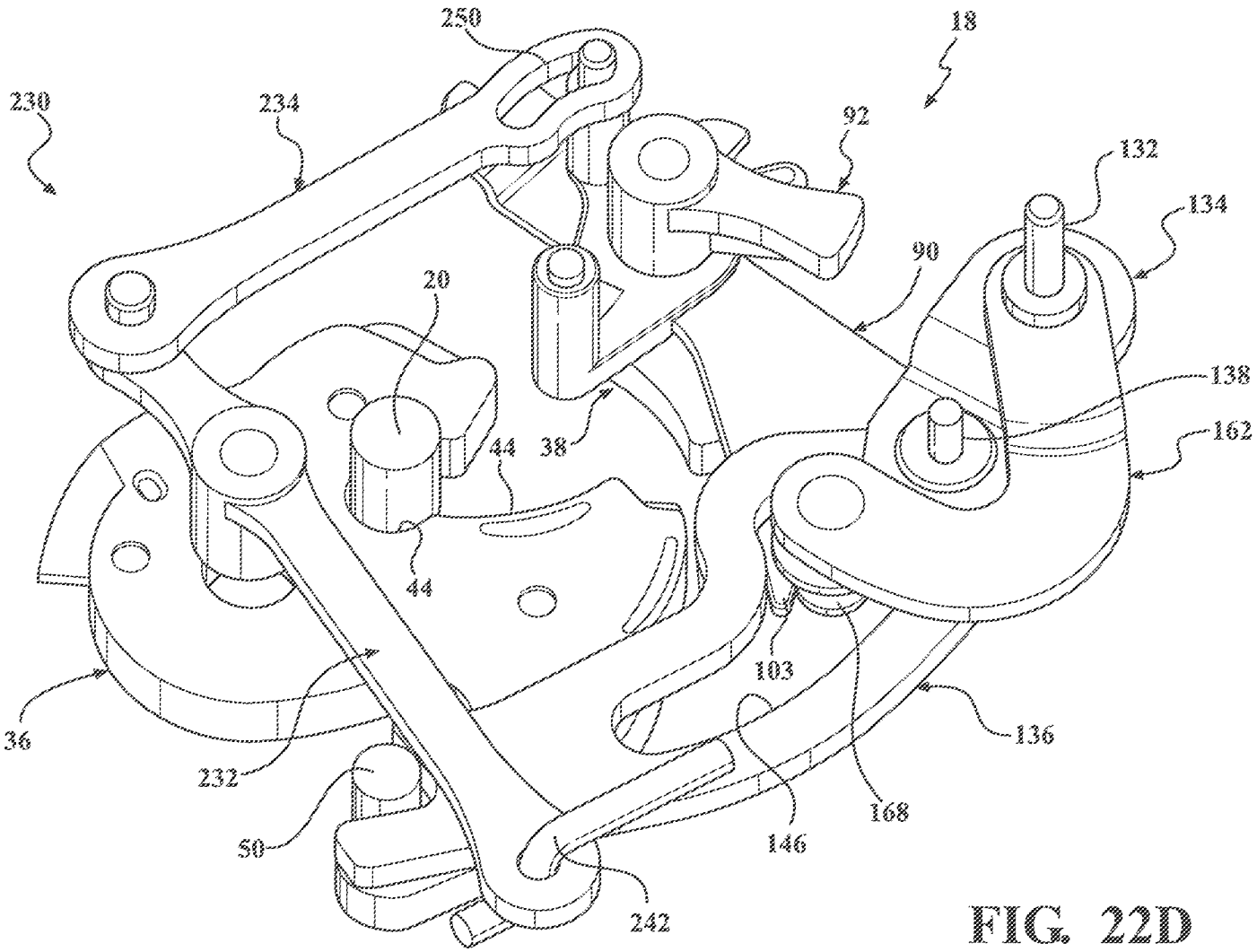
Figure 22E:
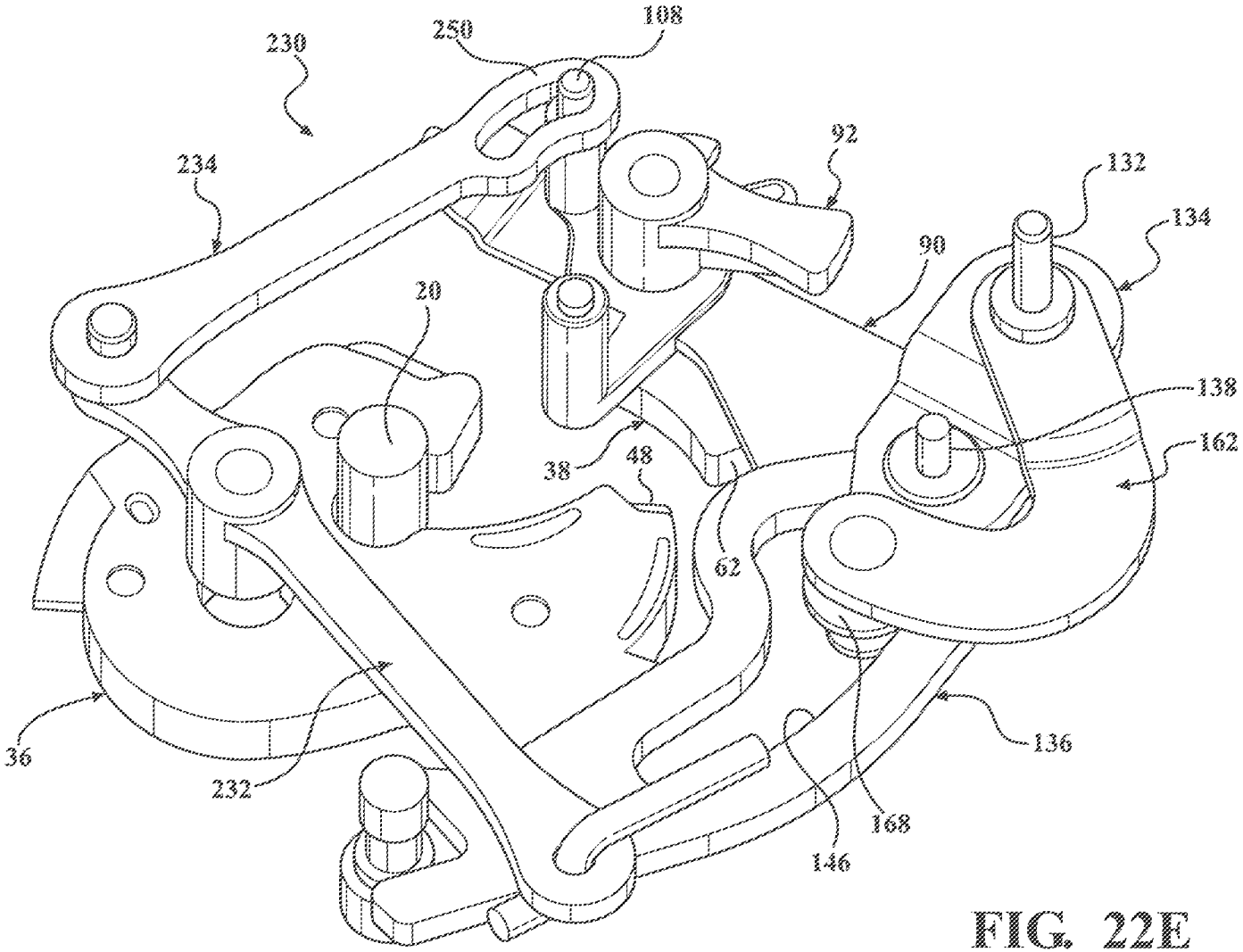

FIGS. 22A through 22E illustrate a sequence of isometric views showing actuation of outside release mechanism 230 via pivotal movement of outside backup lever 232 from its non-actuated position (FIG. 22A) into its actuated position (FIG. 22D) which, in turn, causes pivotal movement of pawl lever 90 from its first pawl lever position into its second pawl lever position. As seen, pivotal movement of backup lever 232 causes outside backup link 234 to pivot and slide such that engagement of lug 108 on pawl lever 90 with an edge of lost motion slot 250 results in coordinated movement of pawl lever 90 with backup lever 232. Again, such movement of pawl lever 90 results in movement of pawl 38 from its ratchet checking position (FIG. 22A) into its ratchet release position (FIG. 22E). Such movement of pawl lever 90 also causes its cam segment 103 to forcibly engage follower 168 and pivot disengage lever 162 to cause sufficient movement of cinch link lever 136 to release ratchet rivet 50, thereby releasing ratchet 36 for biased movement toward its striker release position.

Referring now to FIG. 23, an alternative version of one-motor power latch assembly 18 is now generally identified as power latch assembly 18A. As is clear, the components of power latch assembly 18A are substantially similar to those shown for power latch assembly 18, and as specifically shown in FIG. 12A, to illustrate the cinch latched mode. To this end, ratchet 36 is held in its cinched striker capture position via latch cinch mechanism 130 while pawl 38 (not shown) is located in its ratchet checking position. Cinch gear 188 is shown located in its cinch stop position with motor 182 deenergized. As seen, a mechanical end stop 400, adapted to be rigidly secured to a structural frame portion of latch assembly 18A, is located in close proximity to a magnet hub 402 formed on gear 188. The force direction resulting from the seal loads or the strength condition, as indicated by arrows 404, attempts to rotate gear 188 in the cinching direction (indicated by arrow 406) in opposition to the releasing direction (indicated by arrow 408). This arrangement prevents gear 188 from rotating in the releasing direction in the event of a collision. Sensor 204 is again used to stop motor 182 for positively locating gear 188 in its cinch stop position such that gear hub 402 engages, or is slightly displaced from, end stop 400. Preferably, the cinch stop position is selected at a position where the forces and components create an "over-center" arrangement. This over-center arrangement and the mechanical end stop arrangement cumulatively assist in maintaining ratchet 36 in its cinched striker capture position without reliance on the gear geometry of gearset 184 or motor resistance. Those skilled in the art will recognize that this mechanical stop arrangement can likewise be integrated into power-operated cinch actuator arrangement 321 associated with two-motor power latch assembly 18'.

FIG. 24 is another alternative version of one-motor power latch assembly 18 (or two-motor power latch assembly 18'), and is identified as power latch assembly 18B. This arrangement is generally similar to that shown in FIG. 23 for power latch assembly 18A with the exception that mechanical end stop 400 is now located to interact with cinch lever 134 instead of cinch gear 188 to provide the identical functions.

Each of the power latch assemblies described above is adapted to overcome acknowledged shortcomings of conventional power latch devices including the elimination of the audible "pop" sound generated upon quick release of the seal loads and use of the cinch actuator to always assist in completing the door closing function independently of the closing energy applied to the door. The cinch actuator associated with the power latch assemblies of the present disclosure is configured to drive the ratchet slowly in a release direction from its cinched striker capture position to its cinch released striker capture position to provide a predetermined amount of striker travel selected to significantly reduce the seal load prior to complete release of the ratchet. While latch control system 114 is only schematically shown in association with controller 113 and various sensors that are configured to provide input signals used to control coordinated control of electric motor 182 in the one-motor versions of power latch assembly 18, 18A and 18B, those skilled in the art will appreciate that any suitable controllers, sensors and control schemes can be used to provide the required functionality disclosed herein.

In addition, each of the power latch assemblies described above is adapted to provide a mechanical coupling arrangement between the ratchet and the cinch link lever that is configured to cause movement of the ratchet to its cinched striker capture position during the power cinching operation, to hold the ratchet in its cinched striker capture position, and to cause movement of the ratchet from its cinched striker capture position to its cinch released striker capture position during the soft opening power release operation. While this mechanical coupling arrangement has been disclosed to include a projection extending from the ratchet that is releasably engageable with an engagement shoulder formed on the cinch link lever, those skilled in the art will understand that the present disclosure contemplates and includes alternative mechanical coupling arrangements. For example, a projection could extend from the cinch link lever for releaseable engagement with an engagement shoulder formed on the ratchet. As a further alternative, engageable lugs can be formed on each of the ratchet and the cinch link lever that are configured to provide a releaseable mechanical coupling arrangement. Thus, the present disclosure embodies a mechanical coupling arrangement having a first engagement member associated with the cinch link lever that is releasably engageable with a second engagement member associated with the ratchet.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A latch assembly for a motor vehicle, comprising:

a ratchet moveable between a striker release position whereat said ratchet is positioned to release a striker and three distinct striker capture positions whereat said ratchet is positioned to retain the striker, wherein said three distinct striker capture positions include a soft close striker capture position, a hard close striker capture position and a cinched striker capture position;

a ratchet biasing member for normally biasing said ratchet toward its striker release position;

a pawl moveable between a ratchet checking position whereat said pawl is positioned to hold said ratchet in one of its soft close and hard close striker capture positions and a ratchet release position whereat said pawl permits movement of said ratchet to its striker release position;

a pawl biasing member for normally biasing said pawl toward its ratchet checking position;

a latch cinch mechanism including a cinch link lever having a first engagement member configured to selectively engage a second engagement member on said ratchet when said ratchet is rotated from its striker release position into one of its soft close striker capture and hard close striker capture positions; and an actuation mechanism operably moveable in a cinching direction from a cinch start position to a cinch stop position to provide a power cinching function when said ratchet is rotated by the striker into one of its soft close striker capture and hard close striker capture positions and said pawl is located in its ratchet checking position, wherein movement of said actuation mechanism from its cinch start position to its cinch stop position causes pivotal movement of said cinch link lever which forcibly rotates said ratchet into its cinched striker capture position due to engagement of said first and second engagement members, and wherein said pawl is located in its ratchet checking position and positioned to hold said ratchet in the hard close striker capture position but the entire pawl is fully disengaged and spaced apart from said ratchet when said ratchet is held in its cinched striker capture position by said cinch link lever;

wherein movement of said actuation mechanism to its cinch stop position causes said ratchet to be forcibly rotated by the cinch link lever past the hard close striker capture position to the cinched striker capture position to angularly space the ratchet from the pawl.

2. The latch assembly of claim 1 wherein a power releasing function is provided by moving said actuation mechanism in a releasing direction from its cinch stop position toward its cinch start position which causes said cinch link lever to move to a position releasing said second engagement member from engagement with said first engagement member, whereby said ratchet is permitted to rotate to its striker release position.

3. The latch assembly of claim 2 wherein said power releasing function includes a soft opening feature operable for uncinching the striker prior to release of said second engagement member from engagement with said first engagement member, said soft opening feature provided by moving said actuation mechanism in said releasing direction from its cinch stop position toward its cinch start position for moving said ratchet from its cinched striker capture position into a cinch release striker capture position before said cinch link lever is disengaged from said ratchet.

4. The latch assembly of claim 1 wherein a soft release function is provided for uncinching the striker prior to release of said second engagement member on said ratchet from engagement with said first engagement member on said cinch link lever by moving said actuation mechanism in a releasing direction from its cinch stop position toward its cinch start position for moving said ratchet from its cinched striker capture position to a cinch release striker capture position.

5. The latch assembly of claim 1 further comprising an inside release mechanism interconnecting a latch release mechanism to an inside door handle and which is operable to shift said latch release mechanism from a first latch release mode in which said pawl is located in its ratchet checking position into a second latch release mode for moving said pawl to its ratchet release position, said inside release mechanism being further operable to move said cinch link lever to a position releasing said first engagement member from engagement with said second engagement member, whereby said ratchet is permitted to rotate to its striker release position in response to actuation of said inside release mechanism via the inside door handle.

6. The latch assembly of claim 1 further including an outside release mechanism interconnecting a latch release mechanism to an outside door handle and which is operable to shift said latch release mechanism from a first latch release mode in which said pawl is located in its ratchet checking position into its second latch release mode for moving said pawl to its ratchet release position, said outside release mechanism being further operable to move said cinch link lever to a position releasing said second engagement member from engagement with said first engagement member, whereby said ratchet is permitted to rotate to its striker release position in response to actuation of said outside release mechanism via the outside door handle.

7. The latch assembly of claim 1 further including a latch release mechanism engaging said pawl, wherein said latch release mechanism includes a pawl lever and a release lever, wherein said pawl lever engages said pawl and is moveable between a first pawl lever position whereat said pawl is located in its ratchet checking position and a second pawl lever position whereat said pawl is located in its ratchet release position, wherein said release lever is selectably engageable with said pawl lever and is moveable between a non-actuated position whereat said pawl lever is positioned in its first pawl lever position and an actuated position whereat said pawl lever is moved to its second pawl lever position, and wherein said actuation mechanism includes an electric motor and a gear rotatable between said cinch start and cinch stop positions.

8. The latch assembly of claim 7 wherein said gear includes a drive slot and a cam segment, wherein said latch cinch mechanism further including a cinch lever pivotably connected to said cinch link lever and having a drive post retained in said drive slot for coordinating movement of said cinch link lever with rotation of said gear.

9. A power latch assembly for a motor vehicle, comprising:

a ratchet moveable between a striker release position whereat said ratchet is positioned to release a striker and three distinct striker capture positions whereat said ratchet is positioned to retain the striker, wherein said three distinct striker capture positions include a soft close striker capture position, a hard close striker capture position and a cinched striker capture position;

a ratchet biasing member for normally biasing said ratchet toward its striker release position;

a pawl moveable between a ratchet checking position whereat said pawl is positioned to hold said ratchet in one of its soft close and hard close striker capture positions and a ratchet release position whereat said pawl permits movement of said ratchet to its striker release position;

a pawl biasing member for normally biasing said pawl toward its ratchet checking position;

a latch release mechanism having a pawl lever and a release lever, said pawl lever engaging said pawl and being moveable between a first pawl lever position whereat said pawl is located in its ratchet checking position and a second pawl lever position whereat said pawl is located in its ratchet release position, said release lever selectably engageable with said pawl lever and being moveable between a non-actuated position whereat said pawl lever is positioned in its first pawl lever position and an actuated position whereat said pawl lever is moved to its second pawl lever position;

a latch cinch mechanism having a cinch lever pivotably connected to a cinch link lever, wherein said cinch link lever includes one of an engagement shoulder and a projection, wherein said ratchet includes one of an engagement shoulder and a projection, and wherein said at least one of an engagement shoulder and a projection of said cinch link lever is configured to selectively engage said at least one of an engagement shoulder and a projection of said ratchet when said ratchet is positioned in its soft close striker capture position;

a cinch disengage mechanism including a disengage lever having a follower disposed in a follower slot formed in said cinch link lever; and an actuation mechanism including an electric motor and a gearset having a first gear driven by said motor and which is meshed with a second gear, said actuation mechanism configured to coordinate pivotal movement of said cinch lever with rotation of said second gear;

wherein a power cinching function is provided by actuating said electric motor to rotate said second gear in a cinching direction from a cinch start position to a cinch stop position, said power cinching function being initiated when said ratchet is rotated by the striker into one of its soft close and hard close striker capture positions and said pawl is located in its ratchet checking position such that rotation of said second gear from its cinch start position to its cinch stop position causes pivotal movement of said cinch lever, wherein pivotal movement of said cinch lever causes pivotal movement of said cinch link lever for forcibly rotating said ratchet into its cinched striker capture position due to engagement of said projection with said engagement shoulder, and wherein said pawl is positioned in its ratchet checking position and positioned to hold said ratchet in the hard close striker capture position but the entire pawl is fully disengaged and spaced apart from said ratchet when said ratchet held in its cinched striker capture position by said cinch link lever.

10. The power latch assembly of claim 9 wherein a power release function is provided by actuating said electric motor to rotate said second gear in a releasing direction from its cinch stop position toward its cinch start position when said ratchet is held in its cinched striker capture position by said latch cinch mechanism, and wherein said rotation of said second gear in said releasing direction causes a cam segment to engage and move said release lever from its non-actuated position toward its actuated position for moving said pawl from its ratchet checking position toward its ratchet release position while said cinch link lever is concurrently moved to release said projection from engagement with said engagement shoulder, whereby said ratchet is permitted to rotate to its striker release position.

11. The power latch assembly of claim 9 wherein said a power releasing function is operable to rotate provided by rotating said ratchet from its cinched striker capture position into a cinch released striker capture position while said projection is maintained in engagement with said engagement shoulder for uncinching the striker to provide a soft open feature prior to release of said ratchet to its striker release position.

12. The power latch assembly of claim 9 further including an inside release mechanism interconnecting said pawl lever to an inside door handle and which is operable to move said pawl lever to its second pawl lever position for moving said pawl to its ratchet release position and is further operable to move said cinch link lever to a position releasing said projection from said engagement shoulder so as to release said ratchet for movement to its striker release position in response to actuation of the inside door handle.

13. The power latch assembly of claim 9 further including an outside release mechanism interconnecting said pawl lever to an outside door handle and which is operable to move said pawl lever to its second pawl lever position for moving said pawl to its ratchet release position and which is further operable to move said cinch link lever to a position releasing said projection from said engagement shoulder so as to release said ratchet for movement to its striker release position in response to actuation of the outside door handle.

14. The power latch assembly of claim 9 wherein said pawl lever includes a pawl position sensor for detecting movement of said pawl, and wherein said second gear includes a first cinch position sensor detecting the location of said second gear in its cinch start position and a second cinch position sensor detecting the location of said second gear in its cinch stop position.

15. A power latch assembly for a motor vehicle, comprising:

a ratchet moveable between a striker release position whereat said ratchet is positioned to release a striker and three distinct striker capture positions whereat said ratchet is positioned to retain the striker, wherein said three distinct striker capture positions include a soft close striker capture position, a hard close striker capture position and a cinched striker capture position;

a ratchet biasing member for normally biasing said ratchet toward its striker release position;

a pawl moveable between a ratchet checking position whereat said pawl is positioned to hold said ratchet in one of its soft close and hard close striker capture positions and a ratchet release position whereat said pawl permits movement of said ratchet to its striker release position;

a pawl biasing member for normally biasing said pawl toward its ratchet checking position;

a latch cinch mechanism having a cinch lever pivotably mounted to a cinch link lever, said cinch link lever includes an engagement shoulder configured to selectively direct contact engage a ratchet projection extending from said ratchet when said ratchet is rotated into one of its soft close striker capture and hard close striker capture positions; and an actuation mechanism including an electric motor and a gearset having a first gear driven by said motor and which is meshed with a second gear, wherein said second gear is configured to coordinate pivotal movement of said cinch lever with rotation of said second gear;

wherein a power cinching function is provided by actuating said electric motor to rotate said second gear in a cinching direction from a cinch start position to a cinch stop position, said power cinching function being initiated when said ratchet is rotated by the striker into one of its soft close and hard close striker capture positions and said pawl is located in its ratchet checking position such that rotation of said second gear from its cinch start position to its cinch stop position causes pivotal movement of said cinch lever and said cinch link lever which forcibly rotates said ratchet into its cinched striker capture position when said second gear is rotated by said motor and in its cinch stop position due to direct contact of said ratchet projection with said engagement shoulder on said cinch link lever, and wherein said pawl is positioned in its ratchet checking position and positioned to hold said ratchet in the hard close striker capture position but the entire pawl is fully disengaged and spaced apart out of contact from said ratchet when said ratchet is rotated to and held in its cinched striker capture position when said second gear is in its cinch stop position;

wherein the electric is motor is stopped in the cinch stop position.

16. The power latch of claim 15 further comprising:

a latch release mechanism having a pawl lever and a release lever, said pawl lever engaging said pawl and moveable between a first pawl lever position whereat said pawl is located in its ratchet checking position and a second pawl lever position whereat said pawl is located in its ratchet release position, said release lever being moveable between a non-actuated position and an actuated position; and a cinch disengage mechanism including a disengage lever with a follower disposed in a follower slot formed in said cinch link lever.

17. The power latch assembly of claim 15 wherein a power release function is provided by actuating said electric motor to rotate said second gear in a releasing direction from its cinch stop position toward its cinch start position when said ratchet is held in its cinched striker capture position by said latch cinch mechanism, and wherein said second gear includes a cam segment such that rotation of said second gear from its cinch stop position toward its cinch start position causes said cam segment to engage and move said release lever from its non-actuated position toward its actuated position for causing said pawl lever to move said pawl from its ratchet checking position toward its ratchet release position while said cinch link lever is concurrently moved to release said ratchet projection from engagement with said engagement shoulder, whereby said ratchet is permitted to rotate to its striker release position.

18. The power latch assembly of claim 15 wherein said a power releasing function is operable to rotate said ratchet from its cinched striker capture position into a cinch released striker capture position while said ratchet projection is maintained in engagement with said engagement shoulder on said cinch link lever for uncinching the striker to provide a soft opening feature prior to release of said ratchet to its striker release position.

19. The power latch assembly of claim 15 further including an inside release mechanism interconnecting said pawl lever to an inside door handle and which is operable to move said pawl lever to its second pawl lever position for moving said pawl to its ratchet release position and to move said cinch link lever to a position releasing said ratchet projection from said shoulder so as to release said ratchet for movement to its striker release position in response to actuation of the inside door handle.

20. The power latch assembly of claim 15 further including an outside release mechanism interconnecting said pawl lever to an outside door handle and which is operable to move said pawl lever to its second pawl lever position for moving said pawl to its ratchet release position and move said cinch link lever to a position releasing said ratchet projection from said engagement shoulder so as to release said ratchet for movement to its striker release position in response to actuation of the outside door handle.

21. The power latch assembly of claim 15 wherein said pawl lever includes a pawl position sensor for detecting movement of said pawl, and wherein said second gear includes a first cinch position sensor detecting the location of said second gear in its cinch start position and a second cinch position sensor detecting the location of said second gear in its cinch stop position.

22. A latch assembly for a motor vehicle, comprising:

a ratchet moveable between a striker release position whereat said ratchet is positioned to release a striker and three distinct striker capture positions whereat said ratchet is positioned to retain the striker, wherein said three distinct striker capture positions include a soft close striker capture position, a hard close striker capture position and a cinched striker capture position, said ratchet being normally biased toward its striker release position;

a pawl moveable between a ratchet checking position whereat said pawl is positioned to hold said ratchet in one of its soft close and hard close striker capture positions and a ratchet release position whereat said pawl permits movement of said ratchet to its striker release position, said pawl being normally biased toward its ratchet checking position;

a latch cinch mechanism including cinch link lever having an engagement surface configured to selectively direct contact a ratchet projection extending from said ratchet when said ratchet is rotated from its striker release position into one of its soft close striker capture and hard close striker capture positions; and an actuation mechanism operable with said latch cinch mechanism, said actuation mechanism operably moveable in a cinching direction from a cinch start position to a cinch stop position, to provide a power cinching function initiated when said ratchet has been rotated by the striker into one of its soft close striker capture and hard close striker capture positions and said pawl is located in its ratchet checking position, wherein said actuation mechanism is operable in a Cinch mode to cause movement of said cinch link lever which forcibly rotates said ratchet into its cinched striker capture position due to engagement of said ratchet projection with said engagement surface of said cinch link lever, and wherein said pawl is located in its ratchet checking position but the entire pawl is fully disengaged and not in contact with said ratchet when said ratchet is held in its cinched striker capture position when said actuation mechanism is in its cinch stop position;

wherein said actuation mechanism includes an electric motor, wherein the electric is motor is stopped in the cinch stop position.

23. The latch assembly of claim 22 wherein a power releasing function is provided by shifting said actuation mechanism into an Uncinch/Released mode to cause said cinch link lever to move said ratchet to a ratchet release position for releasing said ratchet projection from engagement with said engagement surface, whereby said ratchet is thereafter permitted to rotate from its ratchet release position to its striker release position.

24. The latch assembly of claim 23 wherein said power releasing function further includes a soft opening feature operable for uncinching the striker prior to release of said ratchet projection from engagement with said engagement surface, said soft opening feature provided by said actuation mechanism operating in its Uncinch/Released mode for causing said cinch link lever to initially move said ratchet from its cinched striker capture position into a cinch release striker capture position before said cinch link lever moves to said ratchet to its ratchet release position.

25. The latch assembly of claim 1, wherein upon a rotation of the ratchet in a releasing direction from the cinched striker capture position to the hard close striker capture position, the pawl is maintained in the ratchet checking position and positioned to engage a safety latch surface of the ratchet to hold said ratchet in the hard close striker capture.

26. The latch assembly of claim 1, wherein when the ratchet is in the cinched striker capture position and the pawl is located in the ratchet checking position and positioned to hold said ratchet in the hard close striker capture position, the pawl is entirely disengaged from a safety latch surface of the ratchet, and wherein an engagement of the pawl with the safety latch surface of the ratchet holds said ratchet in the hard close striker capture position.

27. The latch assembly of claim 1, wherein when the entire pawl is fully disengaged from the ratchet in the cinched striker capture position, the pawl is rotationally aligned with a safety latch surface of the ratchet, such that rotation of the ratchet toward the striker release position is blocked by the pawl.

28. The power latch of claim 15, wherein the cinch link lever stops in the cinch stop position without returning towards the cinch start position.

29. The latch assembly of claim 22, wherein the cinch link lever stops in the cinch stop position without returning towards the cinch start position.

* * * * *